US009879474B2

(12) United States Patent
Lorenzo et al.

(10) Patent No.: US 9,879,474 B2
(45) Date of Patent: Jan. 30, 2018

(54) POLYCARBONATE BASED RAPID DEPLOYMENT COVER SYSTEM

(71) Applicant: Covestro LLC, Pittsburgh, PA (US)

(72) Inventors: James M. Lorenzo, Mars, PA (US); Robert A. Pyles, Bethel Park, PA (US); David Rocco, Bridgeville, PA (US); Jessica Boyer, Coraopolis, PA (US); Keith Whalen, Great Barrington, MA (US)

(73) Assignee: Covestro LLC, Pittsburgh, PA (US)

( * ) Notice: Subject to any disclaimer, the term of this patent is extended or adjusted under 35 U.S.C. 154(b) by 0 days.

(21) Appl. No.: 15/308,862

(22) PCT Filed: May 6, 2015

(86) PCT No.: PCT/US2015/029483

§ 371 (c)(1),
(2) Date: Nov. 4, 2016

(87) PCT Pub. No.: WO2015/171775

PCT Pub. Date: Nov. 12, 2015

(65) Prior Publication Data

US 2017/0074034 A1 Mar. 16, 2017

Related U.S. Application Data

(60) Provisional application No. 61/989,010, filed on May 6, 2014.

(51) Int. Cl.
*E04B 5/12* (2006.01)
*E06B 5/12* (2006.01)
(Continued)

(52) U.S. Cl.
CPC ..... *E06B 5/12* (2013.01); *E04H 9/04* (2013.01); *E04H 9/14* (2013.01); *E06B 3/30* (2013.01);
(Continued)

(58) Field of Classification Search
CPC ..... E06B 5/12; E06B 2009/005; E06B 9/00; E06B 9/24; E06B 3/28; E06B 3/30;
(Continued)

(56) References Cited

U.S. PATENT DOCUMENTS 2,991,273 A 7/1961 Hechelhammer et al.
2,999,835 A 9/1961 Goldberg
(Continued)

FOREIGN PATENT DOCUMENTS

CH 671989 A5 10/1989
CN 1161445 A 10/1997
(Continued)

OTHER PUBLICATIONS

U.S. Statutory Invention Registration H2229, Reason, W., Movable Deck to Mitigate Effects of Shock, Feb. 3, 2009.
(Continued)

*Primary Examiner* — Beth A Stephan
(74) *Attorney, Agent, or Firm* — John E. Mrozinski, Jr.; Richard P. Bender

(57) ABSTRACT

The present invention provides a rapid deployment cover system comprising a polycarbonate laminate or a glass-clad polycarbonate laminate in combination with a versatile and cushioned mounting system to yield a highly durable cover which provides protection from forced-entry, blast, ballistics and/or extreme storms in a wide range of climates.

33 Claims, 56 Drawing Sheets

(51) Int. Cl.

| | |
|---|---|
| ***E06B 3/54*** | (2006.01) |
| ***E06B 5/10*** | (2006.01) |
| ***E06B 9/02*** | (2006.01) |
| ***E04H 9/04*** | (2006.01) |
| ***E04H 9/14*** | (2006.01) |
| ***E06B 3/30*** | (2006.01) |
| *E06B 9/00* | (2006.01) |

(52) U.S. Cl.
CPC ..... *E06B 3/5436* (2013.01); *E06B 5/10* (2013.01); *E06B 9/02* (2013.01); *E06B 2009/005* (2013.01)

(58) Field of Classification Search
CPC ... E06B 3/301; E06B 1/34; E06B 9/02; E06B 5/025; F16B 13/06
USPC ..... 52/202
See application file for complete search history.

(56) References Cited

U.S. PATENT DOCUMENTS 2,999,846 A 9/1961 Schnell et al.
3,001,973 A 9/1961 Piepenbrink
3,028,356 A 4/1962 Shepard
3,028,365 A 4/1962 Schnell et al.
3,036,036 A 5/1962 Howe
3,124,605 A 3/1964 Wagner
3,148,172 A 9/1964 Fox
3,152,162 A 10/1964 Fischer et al.
3,153,008 A 10/1964 Fox
3,191,728 A 6/1965 David
3,271,367 A 9/1966 Schnell et al.
3,381,416 A * 5/1968 De Torres ..... E06B 3/28 49/464
3,394,164 A 7/1968 McClellan
3,401,180 A 9/1968 Pan et al.
3,454,606 A 7/1969 Brotherton et al.
3,492,330 A 1/1970 Trecker et al.
3,520,768 A 7/1970 Peilstocker et al.
3,544,514 A 12/1970 Schnell et al.
3,624,238 A 11/1971 McKenzie
3,659,779 A 5/1972 Berkman et al.
3,666,614 A 5/1972 Snedeker et al.
3,715,018 A 2/1973 Kadowaki et al.
3,737,409 A 6/1973 Fox
3,748,137 A 7/1973 Worth
3,879,347 A 4/1975 Serini et al.
3,879,348 A 4/1975 Serini et al.
3,890,266 A 6/1975 Serini et al.
3,912,688 A 10/1975 Schiller et al.
3,933,386 A 1/1976 Fannin
3,993,448 A 11/1976 Lowery, Sr.
3,993,488 A 11/1976 Oishi
4,027,072 A 5/1977 Molari, Jr.
4,031,978 A 6/1977 Taylor
4,054,311 A 10/1977 Gute
4,061,815 A 12/1977 Poole, Jr.
4,065,410 A 12/1977 Schäfer et al.
4,097,080 A 6/1978 Petry
4,149,742 A 4/1979 Fannin et al.
4,178,028 A 12/1979 Lura
4,210,741 A 7/1980 Baggett
4,241,129 A 12/1980 Marton et al.
4,312,903 A 1/1982 Molari, Jr.
4,365,024 A 12/1982 Frentzel
4,529,745 A 7/1985 Londrigan
4,566,237 A 1/1986 Turner
4,567,100 A 1/1986 Pickett et al.
4,625,659 A 12/1986 Saelzer
4,642,255 A 2/1987 Dlubak
4,644,728 A 2/1987 Stauss et al.
4,795,763 A 1/1989 Gluck et al.
4,812,359 A 3/1989 Hall
4,822,657 A 4/1989 Simpson
4,830,418 A 5/1989 Gest
5,003,832 A 4/1991 Carlqvist
5,059,467 A 10/1991 Berkovitz
5,086,157 A 2/1992 Reuter et al.
5,104,723 A 4/1992 Freitag et al.
5,105,004 A 4/1992 Reuter et al.
5,109,076 A 4/1992 Freitag et al.
5,126,428 A 6/1992 Freitag et al.
5,142,997 A 9/1992 DeLong et al.
5,277,952 A 1/1994 Watras
5,401,826 A 3/1995 Sakashita et al.
5,435,226 A 7/1995 McQuilkin
5,463,929 A 11/1995 Mejia
5,553,422 A * 9/1996 Gazaway ..... E06B 9/01 52/204.53
5,640,824 A 6/1997 Johnson et al.
5,643,666 A 7/1997 Eckart et al.
5,649,782 A 7/1997 Fröhlich et al.
5,654,518 A 8/1997 Dobbs
5,668,344 A 9/1997 Bornstein
5,688,837 A 11/1997 Chao et al.
5,729,951 A 3/1998 Fröhlich et al.
5,743,062 A 4/1998 Fricker
5,765,324 A 6/1998 Schultz
5,765,325 A 6/1998 DeBlock
5,771,489 A 6/1998 Snedeker
5,791,118 A 8/1998 Jordan
5,802,783 A 9/1998 Bayha
5,823,705 A 10/1998 Jackson et al.
5,894,048 A 4/1999 Eckart et al.
5,918,430 A * 7/1999 Rowland ..... E06B 3/28 244/129.3
5,958,539 A 9/1999 Eckart et al.
5,960,606 A 10/1999 Dlubak
5,992,123 A 11/1999 Kies
5,998,028 A 12/1999 Eckart et al.
6,000,738 A 12/1999 Stewart et al.
6,025,069 A 2/2000 Eckart et al.
6,080,495 A 6/2000 Wright
6,174,587 B1 1/2001 Figge, Sr.
6,177,368 B1 1/2001 Fisher
6,237,306 B1 5/2001 Dlubak
6,266,926 B1 7/2001 Figge et al.
6,314,704 B1 11/2001 Bryant
6,349,505 B1 2/2002 Figge et al.
6,367,210 B1 * 4/2002 Trundle ..... E06B 5/10 52/204.5
6,518,389 B1 2/2003 Kaufhold et al.
6,554,530 B2 4/2003 Moore
6,591,562 B2 7/2003 Ting
6,622,607 B1 9/2003 Miller
6,656,858 B1 12/2003 Cahill
6,675,550 B1 1/2004 Dlubak
6,679,008 B2 1/2004 Santa Cruz et al.
6,713,523 B2 3/2004 Nagata et al.
6,715,245 B2 4/2004 Lewkowitz
6,767,158 B1 7/2004 Consolazio et al.
6,807,891 B2 10/2004 Fisher
6,814,246 B2 11/2004 Payne et al.
6,854,219 B1 2/2005 Kelly et al.
6,910,951 B2 6/2005 Balijepalli et al.
6,918,821 B2 7/2005 Balijepalli
6,931,799 B2 * 8/2005 Webb ..... E06B 5/10 156/71
7,037,030 B2 5/2006 McLemore
7,043,884 B2 5/2006 Moreno
7,127,865 B2 10/2006 Douglas
7,134,250 B2 11/2006 Forrester et al.
7,144,186 B1 12/2006 Nolte
7,192,340 B2 3/2007 Ono et al.
7,318,614 B2 1/2008 Steiger
7,360,822 B2 4/2008 Carroll, III et al.
7,398,624 B2 7/2008 Swiszcz et al.
7,404,593 B2 7/2008 Cormier et al.
7,406,806 B2 8/2008 Hallissy et al.
7,469,511 B2 12/2008 Wobber
7,493,844 B2 2/2009 Martin
7,537,836 B2 5/2009 Smith et al.
7,549,366 B2 6/2009 Park et al.

(56) References Cited

U.S. PATENT DOCUMENTS

| | | | | |
|---|---|---|---|---|
| 7,562,508 | B2 | 7/2009 | Dickinson et al. | |
| 7,625,023 | B2 | 12/2009 | Audi et al. | |
| 7,625,036 | B2 | 12/2009 | Cormier et al. | |
| 7,628,444 | B2 | 12/2009 | Cormier et al. | |
| 7,735,427 | B2 | 6/2010 | Gansweidt | |
| 7,784,389 | B2 | 8/2010 | Mardirossian | |
| 7,793,581 | B2 * | 9/2010 | Erskine | B32B 17/10036 89/36.04 |
| 7,913,611 | B2 | 3/2011 | Terry et al. | |
| 7,914,069 | B2 | 3/2011 | Barbe et al. | |
| 7,966,784 | B2 | 6/2011 | Wobber | |
| 8,286,405 | B1 | 10/2012 | Bolton et al. | |
| 8,347,775 | B2 | 1/2013 | Altenhof et al. | |
| 8,413,403 | B2 | 4/2013 | Walker, III et al. | |
| 8,438,974 | B2 | 5/2013 | Stull et al. | |
| 8,544,240 | B2 | 10/2013 | Hughes, Jr. | |
| 8,590,264 | B2 | 11/2013 | Leahy | |
| 2004/0055223 | A1 | 3/2004 | Ono | |
| 2004/0060245 | A1 | 4/2004 | Loblick et al. | |
| 2004/0166779 | A1 | 8/2004 | Balijepalli | |
| 2004/0226231 | A1 | 11/2004 | Dlubak | |
| 2004/0261332 | A1 | 12/2004 | Nanayakkara | |
| 2005/0059755 | A1 | 3/2005 | Lunt | |
| 2006/0248827 | A1 | 11/2006 | Meeker | |
| 2007/0011962 | A1 | 1/2007 | Erskine | |
| 2007/0012168 | A1 | 1/2007 | Weatherwax | |
| 2007/0163189 | A1 | 7/2007 | Venegas, Jr. | |
| 2008/0016794 | A1 | 1/2008 | Tremblay et al. | |
| 2008/0047418 | A1 | 2/2008 | Warren et al. | |
| 2008/0078038 | A1 | 4/2008 | Borazghi | |
| 2008/0092731 | A1 | 4/2008 | Hall | |
| 2008/0105114 | A1 | 5/2008 | Gabrys | |
| 2008/0196317 | A1 | 8/2008 | Duncan et al. | |
| 2008/0248299 | A1 | 10/2008 | Kuwahara | |
| 2009/0100997 | A1 | 4/2009 | Fuqua et al. | |
| 2009/0139091 | A1 | 6/2009 | Tucker et al. | |
| 2009/0169855 | A1 | 7/2009 | Tunis | |
| 2009/0260512 | A1 | 10/2009 | Park et al. | |
| 2009/0317623 | A1 | 12/2009 | Purdy | |
| 2010/0089229 | A1 | 4/2010 | Ackerman et al. | |
| 2010/0095832 | A1 | 4/2010 | Gabrys | |
| 2010/0098929 | A1 | 4/2010 | Dispenza | |
| 2010/0101404 | A1 * | 4/2010 | Lorenzo | F41H 5/0407 89/36.04 |
| 2010/0242714 | A1 | 9/2010 | Piscitelli et al. | |
| 2011/0048219 | A1 | 3/2011 | Pyles et al. | |
| 2011/0107905 | A1 | 5/2011 | Bourque | |
| 2011/0277750 | A1 | 11/2011 | Peguero | |
| 2012/0118134 | A1 | 5/2012 | Swartz et al. | |
| 2014/0329060 | A1 | 11/2014 | Vivier et al. | |

FOREIGN PATENT DOCUMENTS

| | | | | | |
|---|---|---|---|---|---|
| CN | 2450624 | Y | | 9/2001 | |
| CN | 2923308 | Y | | 7/2007 | |
| CN | 201040990 | Y | | 3/2008 | |
| CN | 201059915 | Y | | 5/2008 | |
| DE | 1561518 | | | 11/1970 | |
| DE | 4223538 | C1 | | 11/1993 | |
| DE | 102008063580 | | * | 6/2010 | F16B 13/06 |
| EP | 0009654 | | | 4/1980 | |
| EP | 0284522 | A1 | * | 9/1988 | E06B 3/28 |
| EP | 557636 | A1 | | 1/1993 | |
| FR | 2740211 | A | | 4/1997 | |
| GB | 885442 | | | 12/1961 | |
| GB | 1122003 | | | 10/1965 | |
| GB | 1079821 | | | 1/1966 | |
| GB | 1122003 | A | | 7/1968 | |
| GB | 1229482 | A | | 4/1971 | |
| GB | 1341318 | A | | 12/1973 | |
| GB | 1367789 | | | 9/1974 | |
| GB | 1367790 | | | 9/1974 | |
| GB | 1367790 | A | | 9/1974 | |
| GB | 1368338 | | | 9/1974 | |
| GB | 2146377 | A | * | 4/1985 | E06B 3/28 |
| GB | 2198175 | A | * | 6/1988 | E06B 9/01 |
| GB | 2201183 | A1 | | 8/1988 | |
| GB | 2224533 | A | * | 5/1990 | E06B 3/26 |
| GB | 2442529 | A | | 9/2008 | |
| JP | 2248557 | A | | 10/1990 | |
| JP | 0640238 | U | | 5/1994 | |
| JP | 08252897 | A | | 10/1996 | |
| JP | 3036195 | U | | 4/1997 | |
| JP | 0958975 | A | | 11/1999 | |
| JP | 11320797 | A | | 11/1999 | |
| JP | 2002167894 | | | 6/2002 | |
| JP | 2002327582 | A | | 11/2002 | |
| JP | 2004188764 | A | | 7/2004 | |
| JP | 2005241183 | A | | 9/2005 | |
| JP | 2005282168 | A | | 10/2005 | |
| JP | 2006037414 | A | | 2/2006 | |
| JP | 2009270648 | | | 11/2009 | |
| WO | 03052229 | A1 | | 6/2003 | |
| WO | 2005000577 | A2 | | 1/2005 | |
| WO | 2005014964 | A1 | | 2/2005 | |
| WO | 2007038505 | A2 | | 4/2007 | |
| WO | 2008103989 | A1 | | 8/2008 | |
| WO | 2011053399 | A2 | | 5/2011 | |

OTHER PUBLICATIONS

Whitney, Mark G., Blast Damage Mitigation Using Reinforced Concrete Panels and Energy Absorbing Connectors, prepared for the Department of Defense Explosive Safety Board, 1996 Explosives Safety Seminar.

* cited by examiner

DETAIL I
SCALE 1 : 1

DETAIL I
SCALE 1 : 1

DETAIL E
SCALE 1 : 2

SECTION C-C
SCALE 1 : 2

DETAIL F
SCALE 1 : 2

DETAIL G
SCALE 1 : 2

WALL SIDE

PANEL SIDE

SECTION A-A
SCALE 1 : 5

SECTION B-B
SCALE 1 : 1

DETAIL C
SCALE 2 : 1

DETAIL C
SCALE 2 : 1

DETAIL D
SCALE 2 : 1

DETAIL D
SCALE 2 : 1

DETAIL F

SCALE 2:1

430

DETAIL F

SCALE 2:1

DETAIL G
SCALE 1 : 2

DETAIL G
SCALE 1 : 2

POLYCARBONATE BASED RAPID DEPLOYMENT COVER SYSTEM

RELATED APPLICATIONS

This application is a national stage application under 35 U.S.C. § 371 of PCT/US2015/029483, filed May 6, 2015, which claims the benefit of U.S. Provisional Application No. 61/989,010, filed May 6, 2014, both of which are incorporated by reference herein.

FIELD OF THE INVENTION

The present invention relates in general to protective devices and more specifically to a polycarbonate laminate or glass-clad polycarbonate laminate in combination with a versatile and cushioned mounting system to provide a highly durable cover which provides protection from forced-entry, ballistics, blast and/or extreme storms in a wide range of climates.

BACKGROUND OF THE INVENTION

Due to recent events such as severe storms and terrorist attacks, there is a heightened interest in protecting structures or other sites from forced entry, high velocity winds, from blasts due to bombs or other explosive devices, from ballistic projectiles such as bullets, and to provide physical security to building occupants. The windows and doors in many standing structures were not designed with the intent of resisting high velocity winds and debris associated with natural events such as hurricanes or tornadoes, from forced-entry, or from unnatural events such as bomb blasts and/or high velocity projectiles and thus these structures may be particularly vulnerable to such events.

Bricking up windows, while effective, eliminates their functionality and is usually not a rapidly deployable option. Boarding over windows and doors has limited effectiveness and may contribute to the debris found in high velocity wind events. Also, boards over windows and doors can be easily removed by perpetrators intent on breaching a building's physical security and offer little ballistics resistance.

A number of workers in the art have attempted, with varying degrees of success to address these issues.

U.S. Pat. No. 4,644,728 issued to Strauss et al. discloses a securing element for tensionally fastening additions like roof balustrades, exterior stairways, roofs, arbors, greenhouses, pergolas, advertising elements, poster walls, etc. that function as extensions or expansions, to structures, especially single-story structures erected with a kit of components. The securing element extends over the total length of one side of the main structure and has at least one fastening rail that extends over its own total length.

Frohlich et al., in U.S. Pat. No. 5,649,782 describes a transport anchor for transporting a heavy part. The anchor is embedded in the heavy part, includes a sleeve having an inner thread for receiving a load bearing member. The sleeve has a first section with an exterior end face positioned flush with the exterior surface of the heavy part. The sleeve has a second section with a receiving member for an anchoring element of the heavy part. A first plug with an outer thread is threaded into the inner thread of the sleeve and is moveable along the inner thread. The first plug has a plug end face facing outwardly relative to the heavy part. The load bearing member can frictionally engage the plug end face of the first plug. The load bearing member has a base body with an outer thread for cooperation with the inner thread of the sleeve. The base body has a first end for insertion into the sleeve, whereby the first end has an end face with an axial recess or an axial projection providing at least one matching contact surface for cooperation with the at least one axial contact surface at the plug.

U.S. Pat. No. 5,729,951 issued to Frohlich provides an anchoring device for the construction industry. The device has an anchor rail that is C-shaped in cross-section and has a hollow interior so that the anchor rail has a back and legs connected to the back. The legs have angled free ends pointing toward one another and delimiting therebetween a longitudinal slot. The back has outwardly extending projections, each having an opening. Each opening has a double cone rim widening radially outwardly from the opening with radially outwardly diverging first and second conical surfaces. The double cone has an outer edge facing outwardly relative to the hollow interior. A plurality of anchors is connected to the anchor rail, whereby each one of the anchors is received in one of the openings and attached thereto by plastic material deformation of the anchor rail and/or the anchor. The anchor has a cylindrical shaft with a head and a base opposite the head. The base of the shaft is positioned in the opening. In an initial state of the anchor, before attachment to the anchor rail, the shaft and the base have a cross-section that is smaller than the cross-section of the outer edge. The plastic material deformation of the base engages the double cone of the rim.

Fricker in U.S. Pat. No. 5,743,062 teaches an anchoring device for housing/building construction which has at least one anchoring member with a shaft and a first and a second end. The anchoring track to which the first end is form-fittingly connected has an inner and an outer surface. The second end has a fastening element for anchoring the device in a substrate such as concrete. At least the shaft is made of a pipe section. The anchoring track has an opening with an inner edge. The first end of the shaft penetrates the opening whereby the first end has at least one appendage formed at the free end penetrating through the opening, whereby the at least one appendage engages the opening from behind.

U.S. Pat. No. 5,960,606, issued to Dlubak, discloses a penetration resistant window which includes a sheet of window glass having a penetration resistant layer adhered thereto. A floating sheet made of hard material such as glass is adhered to the penetration resistant layer to provide abrasion resistance. The perimeter of the floating sheet is set back from the perimeter of the window glass. This set back is said to allow the window to be mounted in an existing window or door frame such that the perimeter of the window glass is secured to the frame, but the floating sheet is unconstrained by the frame. The penetration resistant window is said to be useful in architectural, residential and institutional applications for resisting debris penetration during hurricanes.

Kies in U.S. Pat. No. 5,992,123 describes a shear stud assembly which is formed at the construction site by assembling double-headed shear studs with a channel system which engages one-headed end of the shear studs. The shear stud assembly may be positioned in a slab, beam, or horizontal element around columns or vertical elements for reinforcement with the studs hanging downwardly from the channel system through the normally congested steel reinforcing. Several forms of channel system are disclosed, each of which permit the length of the assembly and the spacing of the studs to be adjusted to fit, and yet still remain within the design parameters, all without the use of skilled labor or special tools.

U.S. Pat. No. 6,237,306, issued to Dlubak provides a penetration resistant window including a sheet of window glass having a penetration resistant layer of ionoplast material adhered thereto. A floating sheet made of hard material such as glass is adhered to the penetration resistant layer to provide abrasion resistance. The perimeter of the floating sheet is set back from the perimeter of the window glass. This set back is said to allow the window to be mounted in an existing window or door frame such that the perimeters of the window glass and penetration resistant sheet are secured to the frame, but the floating sheet is unconstrained by the frame. The penetration resistant window is said to be useful in architectural, residential and institutional applications for resisting debris penetration during hurricanes.

Ting in U.S. Pat. No. 6,591,562 teaches a mullion connector connecting a mullion to a building structure, the mullion connector having a first flange and a second flange in a plane generally perpendicular to the first flange with a first flange having a first fastener opening capable of allowing relative motion of the mullion connector relative to the mullion in at least one direction and a second flange having a second fastener opening capable of allowing relative motion of the mullion connector relative to the building in at least two generally perpendicular directions. By placing the second flange on a generally horizontal surface such as a building floor, and loosely fastening the second flange through the second fastener opening to a building anchor, the first flange opening may be attached to the mullion allowing up and down and rotational motion while the second flange opening allows in & out and left to right motion while supporting the mullion. In addition, the pre-assembled mullion connector may also be used to hoist the mullion section and attached mullion connector to its assembly position on the face of the building.

U.S. Pat. No. 6,675,550, issued to Dlubak, discloses a penetration resistant window including a penetration resistant layer sandwiched between exterior and interior transparent sheets. The perimeter of the penetration resistant layer extends from the perimeters of the exterior and interior transparent sheets in a direction plane parallel with the planes of the transparent sheets. This extension is said to allow the laminated window sheets to be mounted in an existing window frame such that the perimeter of the penetration resistant layer is secured within a channel in the frame, preferably by an adhesive such as silicone glue. The penetration resistant window is said to be useful in architectural, residential and institutional applications for resisting debris penetration during hurricanes.

Lewkowitz, in U.S. Pat. No. 6,715,245, describes an impact resistant laminated glass and plastic pane for a hurricane resistant door light or similar opening. A glass pane is attached to a flexible plastic sheet that protrudes beyond the peripheral edge of the glass, preferably as an extension of the plastic laminate between outer glass laminate sheets. The pane body is mounted in a building structural part such as a door or wall, at an opening or at a recess, whereby the surface of the structural part extends up to a point adjacent to the pane. The flexible sheet that is attached to the pane, laps over the surface adjacent to the edge of the structural part around the pane. An elongated molding element that preferably frames the opening, is attached to the structural part so as to capture the flexible sheet between the molding element and the surface.

U.S. Pat. No. 6,854,219 issued to Kelly et al. provides a masonry lintel having a concealed spine which spans between piers to either side of an area to be arched and supports masonry bricks through means of horseshoe shaped plates which ride on the spine. The bricks are supported on the spine by stitching rods which extend through apertures in the plates and the bricks. The plates are received in the grouting space between the bricks and, in the finished lintel, are grouted over to be completely hidden from view. Variations in the relative positions of the piers and the width of bricks used to construct the lintel are accommodated by adjustable supports between the spine and the piers which enable the position of the spine relative to the piers to be selectively adjusted. In the embodiments employing multiple generally parallel spines, these supports provide for adjustable spacing of the spines. Center supports for the spines are adjustable both vertically and horizontally to accommodate various structural design parameters.

Moreno, in U.S. Pat. No. 7,043,884, teaches a stone cladding system for buildings having a support frame formed by a plurality of spaced-apart upright mullions fixed to an exterior of a building by anchor bracket's with a number of horizontal cladding panel support rails mounted in vertically spaced apart rows on the mullions. Each stone cladding panel is mounted between at adjacent pair of vertically spaced-apart rails with a bottom of the cladding panel seated on the lowermost rail and a top of the cladding panel secured to the uppermost rail by a pair of retaining clips. A bottom of each stone cladding panel is fully supported along its length by the lowermost rail.

U.S. Pat. No. 7,469,511 issued to Wobber discloses a masonry coupling system for use in commercial and residential construction. In one aspect, the invention of Wobber includes an anchor channel mounted on a structure. The masonry coupling system further includes a key that interfaces the masonry veneer and interlocks with an anchor channel mounted on a structure.

Smith et al., in U.S. Pat. No. 7,537,836, describe a glazing element having a transparent laminate secured to a structural support, and a process for preparing the same. The laminate comprises at least one layer of glass having self-adhered directly to the layer of glass a layer of thermoplastic polymer having low haze, wherein the layer of thermoplastic polymer is attached to the structural support along the edges of the laminate.

U.S. Pat. No. 7,966,784 issued to Wobber provides a masonry anchoring system for use in commercial and residential construction. In one aspect, the invention includes a brick tie that interfaces the masonry veneer and interlocks with an anchor plate mounted on a structure.

Bolton et al., in U.S. Pat. No. 8,286,405, teach a glazing structure comprising one or more impact and fire resistant window layers comprising; A) a first glass or plastic layer; B) a fire resistant layer of a composition which essentially comprises about 10-40% by weight of tris(hydroxymethyl)-aminoethane aminomethane, about 10 to 30% by weight of a member selected from the group consisting of ammonium phosphate, phosphoric acid, ammonium dibasic phosphate, ammonium dihydrogen phosphate, and triammonium phosphate; and about 35 to 65% by weight of a member selected from the group consisting of alkali metal borates, ammonium borate and its hydrate, sodium teraborate decahydrate, sodium borate, potassium borate, lithium borate, sodium meta borate tetrahydrate, boric acid, boric anhydride, boric oxides and ammonium borate, adjacent said first glass or plastic layer, and C) a second glass or plastic layer adjacent said fire resistant layer. The laminated architectural structures are said to include walls, floors, stairs, doors, bridges, and security windows for automobiles, bank tellers, ships, ocean platforms, locomotives, and the like.

U.S. Pat. No. 8,413,403 issued to Walker, III et al. provides a modular curtain wall system and a method for forming a curtain wall unit. The modular curtain wall system comprises a unit frame and a cassette. The cassette comprises a subframe and an interior portion. The stick unit frame and cassette may be assembled into a curtain wall unit at an offsite facility.

A need continues to exist in the art for highly durable covers which provide protection from forced-entry, ballistics and/or extreme storms in a wide range of climates.

SUMMARY OF THE INVENTION

Accordingly, the present invention provides a polycarbonate laminate or glass-clad polycarbonate laminate in combination with a versatile and cushioned mounting system to provide a highly durable cover which can be rapidly erected with minimal labor and provides protection from forced-entry, ballistics and/or extreme storms in a wide range of climates.

In one embodiment of the invention, a rapid deployment cover system for a wall having an opening comprises a mounting track attached to a wall, a polycarbonate laminate having a first side adjacent to the mounting track, a second side and a plurality of holes through the first and second sides; a pressure plate adjacent to the second side of the polycarbonate laminate; a first plurality of bolts, wherein each such bolt is fixedly attached to the pressure plate, and passes through a corresponding hole in the polycarbonate laminate; and a plurality of elastomeric sleeves, wherein each such sleeve is situated substantially around a bolt and within a hole of the polycarbonate laminate.

In another embodiment of the present invention, the first plurality of bolts of the rapid deployment cover system described in any of the paragraphs herein is fixedly attached to both the pressure plate and the mounting track, and the mounting track is attached to the wall by a second plurality of bolts. In this embodiment, the mounting track may be attached to the wall by 4 to 8 bolts of the second plurality of bolts.

In yet another embodiment of the present invention, the first plurality of bolts of the rapid deployment cover systems described in any of the paragraphs herein, is fixedly attached to the wall. In this embodiment, the mounting track may optionally be attached to the wall by 4 to 8 bolts.

In still another embodiment of the present invention, the rapid deployment cover system described in any of the paragraphs herein may further comprise one or more shims disposed between the mounting plate and the wall. In this embodiment, the shims may optionally be constructed of an elastomeric material, and/or may create a space of at least 0.25 inches between the wall and the mounting plate.

In another embodiment of the present invention, the first plurality of bolts of the rapid deployment cover system described in any of the paragraphs herein may be spaced at least 3 inches apart from each another, or alternatively be spaced at least 6 inches apart from each another.

In an embodiment of the present invention, the plurality of holes in the polycarbonate laminate of any of the rapid deployment cover systems described in any of the paragraphs herein are about 2 inches in diameter.

In again another embodiment of the present invention, at least one of the plurality of holes in the polycarbonate laminate of any of the rapid deployment cover systems described in any of the paragraphs herein has a diameter of about 3.7 times the thickness of an elastomeric sleeve.

In still another embodiment of the present invention, at least one of the elastomeric sleeves of any of the rapid deployment cover systems described in the paragraphs herein, has a thickness of about 0.535 inches, and/or has a Shore A hardness of about 35 to about 45, and/or has a tensile strength of about 1450 psi, and/or is constructed of ethylene propylene diene monomer (EPDM).

In another embodiment of the invention not yet described, the rapid deployment cover systems described in any of the paragraphs herein may further comprise at least one bushing disposed between a bolt and an elastomeric sleeve.

In a different embodiment of the invention, the polycarbonate laminate of any of the rapid deployment cover systems described in any of the paragraphs herein, comprises at least one edge, and the plurality of holes in the polycarbonate laminate are located at least 0.25 inches away from the at least one edge of the polycarbonate laminate, and/or at least 3 inches away from the at least one edge of the polycarbonate laminate.

In another different embodiment of the present invention, the rapid deployment cover system described in any of the paragraphs herein further comprises a pressure plate cover.

In an embodiment of the invention not yet described, a method for installing a cover to a wall having an opening comprises: A) drilling and installing 4 to 8 anchor holes in the wall around the opening; B) fixing a mounting track to the 4 to 8 anchor holes in the wall; and C) hanging a polycarbonate laminate having a first side adjacent to the mounting track, a second side and a plurality of holes through the first and second sides, (i) through the use of a pressure plate adjacent to the second side of the polycarbonate laminate, and (ii) also through the use of a first plurality of bolts, wherein each such bolt is fixedly attached to the pressure plate at one end, and passes through an elastomeric sleeve and a hole of the polycarbonate laminate.

In another embodiment of the invention, the first plurality of bolts described in any of the methods herein is fixedly attached to both the pressure plate and the mounting track, and the mounting track is attached to the wall by a second plurality of bolts.

In a different embodiment of the invention, the first plurality of bolts described in any of the methods herein is fixedly attached to the wall.

In yet another embodiment of the invention herein, any of the methods described in the paragraphs herein further comprises D) installing one or more shims between the mounting plate and the wall, and such shims may, optionally, create a space of at least 0.25 inches between the wall and the mounting plate.

In still another embodiment of the invention, the first plurality of bolts described in any of the methods herein are spaced at least 3 inches apart from each another, and/or spaced at least 6 inches apart from each another.

In an embodiment of the invention, the plurality of holes in the polycarbonate laminate of any of the methods described herein each has a diameter of about 2 inches, and/or has a diameter of about 3.7 times the thickness of an elastomeric sleeve.

In yet another embodiment of the present invention, each of the first plurality of bolts described in any of the methods of any of the paragraphs herein, passes through a bushing.

In another, different embodiment of the invention, the polycarbonate laminate of any of the methods described herein comprises at least one edge, and the plurality of holes in the polycarbonate laminate are located at least 0.25 inches away from the at least one edge of the polycarbonate laminate, or at least 3 inches away from the at least one edge of the polycarbonate laminate.

In still another, different embodiment of the present invention, any of the methods described herein may further comprise E) installing a pressure plate cover.

These and other advantages and benefits of the present invention will be apparent from the Detailed Description of the Invention herein below.

BRIEF DESCRIPTION OF THE FIGURES

The present invention will now be described for purposes of illustration and not limitation in conjunction with the figures, wherein.

DETAILED DESCRIPTION OF THE INVENTION

Figure 1B:
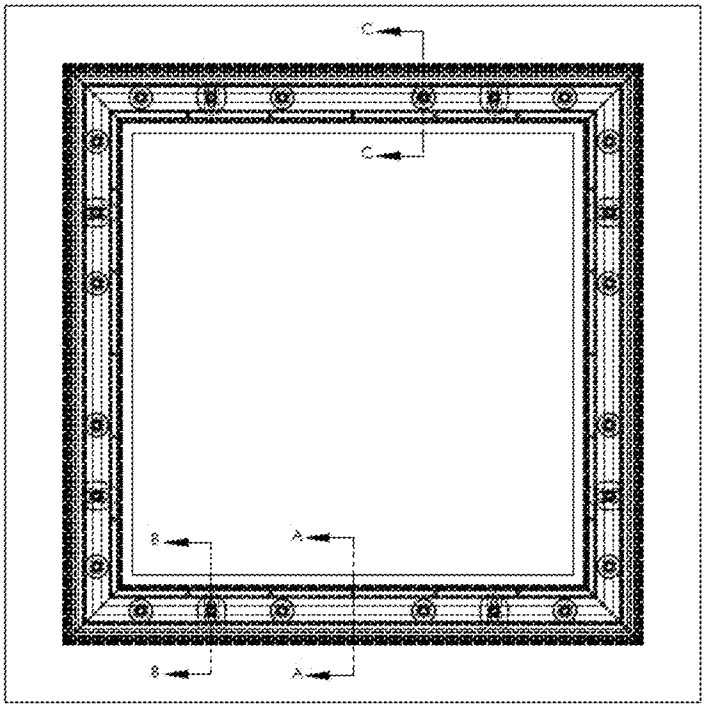
FIG. 1B shows the polycarbonate laminate rapid deployment cover system of the present invention.

The present invention will now be described for purposes of illustration and not limitation. Except in the operating examples, or where otherwise indicated, all numbers expressing quantities, percentages, and so forth in the specification are to be understood as being modified in all instances by the term "about."

The present invention provides a rapid deployment cover system comprising a polycarbonate laminate or a glass-clad polycarbonate laminate in combination with a versatile and cushioned mounting system to provide a highly durable cover over building openings (e.g., architectural openings such as windows and doors, and non-architectural openings such as those openings created by bullets, shells and explosives) which provides protection from forced-entry, ballistics and/or extreme storms in a wide range of climates. The polycarbonate laminate or glass-clad polycarbonate laminate may be opaque, translucent or transparent.

Such laminates may be designed to be held in place by a framing system attached to the building, and surrounding the individual building openings. The framing system must compensate for the following: the coefficient of thermal expansion of polymeric materials, and associated expansion and contraction; the weight of the covers, some in excess of 750 lbs. (340 kg); different building architectures and materials of construction; chemical compatibility of all components; and potential for fastener misalignments and lack of building wall flatness and squareness. Moreover, the installed panels and framing must be forced entry and ballistics certified. The present invention also provides an adjustable framing system and a cushioned mounting system that meets all the above criteria.

The polycarbonate panels useful in the inventive laminate are preferably transparent, but there are situations where the panels may be translucent, or even opaque.

All panels, whether transparent, translucent or opaque, may be also fabricated to include decorative elements such as artwork, graphics and natural grasses. Further, the transparent panels may be fabricated to include mirrored surfaces or graphics which permit one-way viewing from inside a darkened building to the brighter exterior.

Suitable polycarbonate resins for preparing the panels useful in the laminates of the present invention are homopolycarbonates and copolycarbonates, both linear or branched resins and mixtures thereof. Such polycarbonates have a weight average molecular weight (as determined by gel permeation chromatography, or size-exclusion chromatography) of preferably 10,000 to 200,000, more preferably 20,000 to 80,000 and a melt flow rate, per ASTM D-1238 at 300° C., of preferably 1 to 65 g/10 min., more preferably 2 to 35 g/10 min. The polycarbonates may be prepared, for example, by the known diphasic interface process from a carbonic acid derivative such as phosgene and dihydroxy compounds by polycondensation (See, German Offenlegungsschriften 2,063,050; 2,063,052; 1,570,703; 2,211,956; 2,211,957 and 2,248,817; French Patent 1,561,518; and the monograph by H. Schnell, "Chemistry and Physics of Polycarbonates", Interscience Publishers, New York, N.Y., 1964).

In the present context, dihydroxy compounds suitable for the preparation of the polycarbonates of the invention conform to the structural formulae (1) or (2) below.

(1)

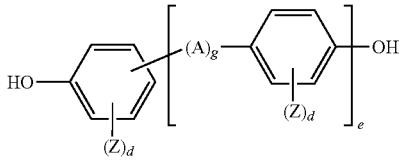

(2)

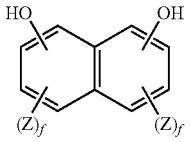

Wherein A denotes an alkylene group with 1 to 8 carbon atoms, an alkylidene group with 2 to 8 carbon atoms, a cycloalkylene group with 5 to 15 carbon atoms, a cycloalkylidene group with 5 to 15 carbon atoms, a carbonyl group, an oxygen atom, a sulfur atom, —SO— or —$SO_2$ or a radical conforming to (3)

(3)

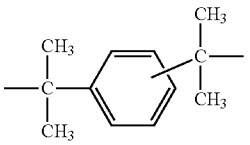

e and g both denote the number 0 to 1;

Z denotes F, Cl, Br or $C_1$-$C_4$-alkyl and if several Z radicals are substituents in one aryl radical, they may be identical or different from one another;

d denotes an integer of from 0 to 4; and f denotes an integer of from 0 to 3.

Among the dihydroxy compounds useful in the practice of the invention are hydroquinone, resorcinol, bis-(hydroxyphenyl)-alkanes, bis-(hydroxyl-phenyl)-ethers, bis-(hydroxyphenyl)-ketones, bis-(hydroxyl-phenyl)-sulfoxides, bis-(hydroxyphenyl)-sulfides, bis-(hydroxyphenyl)-sulfones, and α,α-bis-(hydroxyphenyl)-diisopropylbenzenes, as well as their nuclear-alkylated compounds. These and further suitable aromatic dihydroxy compounds are described, for example, in U.S. Pat. Nos. 5,401,826, 5,105,004; 5,126,428; 5,109,076; 5,104,723; 5,086,157; 3,028,356; 2,999,835; 3,148,172; 2,991,273; 3,271,367; and 2,999,846, the contents of which are incorporated herein by reference.

Further examples of suitable bisphenols are 2,2-bis-(4-hydroxyphenyl)-propane (bisphenol A), 2,4-bis-(4-hydroxyphenyl)-2-methyl-butane, 1,1-bis-(4-hydroxyphenyl)-cyclohexane, α,α'-bis-(4-hydroxy-phenyl)-p-diisopropylbenzene, 2,2-bis-(3-methyl-4-hydroxyphenyl)-propane, 2,2-bis-(3-chloro-4-hydroxyphenyl)-propane, 4,4'-dihydroxy-diphenyl, bis-(3,5-dimethyl-4-hydroxyphenyl)-methane, 2,2-bis-(3,5-dimethyl-4-hydroxyphenyl)-propane, bis-(3,5-dimethyl-4-hydroxyphenyl)-sulfide, bis-(3,5-dimethyl-4-hydroxy-phenyl)-sulfoxide, bis-(3,5-dimethyl-4-hydroxyphenyl)-sulfone, dihydroxy-benzophenone, 2,4-bis-(3,5-dimethyl-4-hydroxyphenyl)-cyclohexane, α,α'-bis-(3,5-dimethyl-4-hydroxyphenyl)-p-diisopropyl-benzene and 4,4'-sulfonyl diphenol.

Examples of particularly preferred aromatic bisphenols are 2,2-bis-(4-hydroxyphenyl)-propane, 2,2-bis-(3,5-dimethyl-4-hydroxyphenyl)-propane, 1,1-bis-(4-hydroxyphenyl)-cyclohexane and 1,1-bis-(4-hydroxy-phenyl)-3,3,5-trimethylcyclohexane. The most preferred bisphenol is 2,2-bis-(4-hydroxyphenyl)-propane (bisphenol A).

The polycarbonates useful in producing the laminates of the invention may entail in their structure units derived from one or more of the suitable bisphenols.

Among the resins suitable in the practice of the invention are phenolphthalein-based polycarbonate, copolycarbonates and terpolycarbonates such as are described in U.S. Pat. Nos. 3,036,036 and 4,210,741, both of which are incorporated by reference herein.

The polycarbonates useful in preparing the laminates of the invention may also be branched by condensing therein small quantities, e.g., 0.05 to 2.0 mol % (relative to the bisphenols) of polyhydroxyl compounds. Polycarbonates of this type have been described, for example, in German Offenlegungsschriften 1,570,533; 2,116,974 and 2,113,374; British Patents 885,442 and 1,079,821 and U.S. Pat. No. 3,544,514, which is incorporated herein by reference. The following are some examples of polyhydroxyl compounds which may be used for this purpose: phloroglucinol; 4,6-dimethyl-2,4,6-tri-(4-hydroxy-phenyl)-heptane; 1,3,5-tri-(4-hydroxyphenyl)-benzene; 1,1,1-tri-(4-hydroxyphenyl)-ethane; tri-(4-hydroxyphenyl)-phenyl-methane; 2,2-bis-[4,4-(4,4'-dihydroxydiphenyl)]-cyclohexyl-propane; 2,4-bis-(4-hydroxy-1-isopropylidine)-phenol; 2,6-bis-(2'-dihydroxy-5'-methylbenzyl)-4-methyl-phenol; 2,4-dihydroxybenzoic acid; 2-(4-hydroxy-phenyl)-2-(2,4-dihydroxy-phenyl)-propane and 1,4-bis-(4,4'-dihydroxytri-phenylmethyl)-benzene. Some of the other polyfunctional compounds are 2,4-dihydroxy-benzoic acid, trimesic acid, cyanuric chloride and 3,3-bis-(4-hydroxyphenyl)-2-oxo-2,3-dihydroindole.

In addition to the polycondensation process mentioned above, other processes for the preparation of the polycarbonates of the invention are polycondensation in a homogeneous phase and transesterification. Suitable processes are disclosed in U.S. Pat. Nos. 3,028,365; 2,999,846; 3,153,008; and 2,991,273 which are incorporated herein by reference.

The preferred process for the preparation of polycarbonates is the interfacial polycondensation process. Other methods of synthesis in forming the polycarbonates useful in the invention, such as disclosed in U.S. Pat. No. 3,912,688, incorporated herein by reference, may be used. Suitable polycarbonate resins are available in commerce, for instance, from Bayer MaterialScience under the MAKROLON trademark. The polycarbonate is preferably used in the form of panels, (sheets) or films in the laminates. Suitable polycarbonate laminates are available from Bayer MaterialScience under the HYGARD trademark.

Aliphatic thermoplastic polyurethanes are preferred in the laminate useful in the present invention such as those prepared according to U.S. Pat. No. 6,518,389, the entire contents of which are incorporated herein by reference. Particularly preferred are thermoplastic polyurethane based on aliphatic chemistries to resist color changes from ultraviolet radiation exposure, especially ultraviolet radiation such as found in natural sunlight.

Thermoplastic polyurethane elastomers are well known to those skilled in the art. They are of commercial importance due to their combination of high-grade mechanical properties with the known advantages of cost-effective thermoplastic processability. A wide range of variation in their mechanical properties can be achieved by the use of different chemical synthesis components. A review of thermoplastic polyurethanes, their properties and applications is given in Kunststoffe [Plastics] 68 (1978), pages 819 to 825, and in Kautschuk, Gummi, Kunststoffe [Natural and Vulcanized Rubber and Plastics] 35 (1982), pages 568 to 584.

Thermoplastic polyurethanes are synthesized from linear polyols, mainly polyester diols or polyether diols, organic diisocyanates and short chain diols (chain extenders). Catalysts may be added to the reaction to speed up the reaction of the components.

The relative amounts of the components may be varied over a wide range of molar ratios in order to adjust the properties. Molar ratios of polyols to chain extenders from 1:1 to 1:12 have been reported. These result in products with hardness values ranging from 80 Shore A to 75 Shore D.

Thermoplastic polyurethanes can be produced either in stages (prepolymer method) or by the simultaneous reaction of all the components in one step (one shot). In the former, a prepolymer formed from the polyol and diisocyanate is first formed and then reacted with the chain extender. Thermoplastic polyurethanes may be produced continuously or batch-wise. The best-known industrial production processes are the so-called belt process and the extruder process.

Examples of the suitable polyols include difunctional polyether polyols, polyester polyols, and polycarbonate polyols. Small amounts of trifunctional polyols may be used, yet care must be taken to make certain that the thermoplasticity of the thermoplastic polyurethane remains substantially un-effected.

Suitable polyester polyols include those which are prepared by polymerizing ϵ-caprolactone using an initiator such as ethylene glycol, ethanolamine and the like. Further suitable examples are those prepared by esterification of polycarboxylic acids. The polycarboxylic acids may be aliphatic, cycloaliphatic, aromatic and/or heterocyclic and they may be substituted, e.g., by halogen atoms, and/or unsaturated. The following are mentioned as examples: succinic acid; adipic acid; suberic acid; azelaic acid; sebacic acid; phthalic acid; isophthalic acid; trimellitic acid; phthalic acid anhydride; tetrahydrophthalic acid anhydride; hexahydrophthalic acid anhydride; tetrachlorophthalic acid anhydride, endomethylene tetrahydrophthalic acid anhydride; glutaric acid anhydride; maleic acid; maleic acid anhydride; fumaric acid; dimeric and trimeric fatty acids such as oleic acid, which may be mixed with monomeric fatty acids; dimethyl terephthalates and bis-glycol terephthalate. Suitable polyhydric alcohols include, e.g., ethylene glycol; propylene glycol-(1,2) and -(1,3); butylene glycol-(1,4) and -(1,3); hexanediol-(1,6); octanediol-(1,8); neopentyl glycol; (1,4-bis-hydroxy-methylcyclohexane); 2-methyl-1,3-propanediol; 2,2,4-tri-methyl-1,3-pentanediol; triethylene glycol; tetraethylene glycol; polyethylene glycol; dipropylene glycol; polypropylene glycol; dibutylene glycol and polybutylene glycol, glycerine and trimethlyolpropane.

Suitable polyisocyanates for producing the thermoplastic polyurethanes useful in the laminates may be, for example, organic aliphatic diisocyanates including, for example, 1,4-tetramethylene diisocyanate, 1,6-hexamethylene diisocyanate, 2,2,4-trimethyl-1,6-hexamethylene diisocyanate, 1,12-dodecamethylene diisocyanate, cyclohexane-1,3- and -1,4-diisocyanate, 1-isocyanato-2-isocyanatomethylcyclopentane, 1-isocyanato-3-isocyanatomethyl-3,5,5-trimethyl-cyclohexane (isophorone diisocyanate or IPDI), bis-(4-isocyanatocyclohexyl)-methane, 2,4'-dicyclohexylmethane diisocyanate, 1,3- and 1,4-bis-(isocyanatomethyl)-cyclohexane, bis-(4-isocyanato-3-methylcyclohexyl)-methane, α,α,α',α'-tetramethyl-1,3- and/or -1,4-xylylene diisocyanate, 1-isocyanato-1-methyl-4(3)-isocyanatomethyl cyclohexane, 2,4- and/or 2,6-hexahydrotoluylene diisocyanate, and mixtures thereof.

Preferred chain extenders with molecular weights of 62 to 500 include aliphatic diols containing 2 to 14 carbon atoms, such as ethanediol, 1,6-hexanediol, diethylene glycol, dipropylene glycol, and 1,4-butanediol in particular, for example. However, diesters of terephthalic acid with glycols containing 2 to 4 carbon atoms are also suitable, such as terephthalic acid-bis-ethylene glycol or -1,4-butanediol for example, or hydroxyalkyl ethers of hydroquinone, such as 1,4-di-(β-hydroxyethyl)-hydroquinone for example, or (cyclo)aliphatic diamines, such as isophorone diamine, 1,2- and 1,3-propylenediamine, N-methyl-propylenediamine-1,3 or N,N'-dimethyl-ethylenediamine, for example, and aromatic diamines, such as toluene 2,4- and 2,6-diamines, 3,5-diethyltoluene 2,4- and/or 2,6-diamine, and primary ortho-, di-, tri- and/or tetraalkyl-substituted 4,4'-diaminodiphenylmethanes, for example. Mixtures of the aforementioned chain extenders may also be used. Optionally, triol chain extenders having a molecular weight of 62 to 500 may also be used. Moreover, customary monofunctional compounds may also be used in small amounts, e.g., as chain terminators or demolding agents. Alcohols such as octanol and stearyl alcohol or amines such as butylamine and stearylamine may be cited as examples.

To prepare the thermoplastic polyurethanes, the synthesis components may be reacted, optionally in the presence of catalysts, auxiliary agents and/or additives, in amounts such that the equivalent ratio of NCO groups to the sum of the groups which react with NCO, particularly the OH groups of the low molecular weight diols/triols and polyols, is 0.9:1.0 to 1.2:1.0, preferably 0.95:1.0 to 1.10:1.0.

Suitable catalysts include tertiary amines which are known in the art, such as triethylamine, dimethyl-cyclohexylamine, N-methylmorpholine, N,N'-dimethyl-piperazine, 2-(dimethyl-aminoethoxy)-ethanol, diazabicyclo-(2,2,2)-octane and the like, for example, as well as organic metal compounds in particular, such as titanic acid esters, iron compounds, tin compounds, e.g., tin diacetate, tin dioctoate, tin dilaurate or the dialkyltin salts of aliphatic carboxylic acids such as dibutyltin diacetate, dibutyltin dilaurate or the like. The preferred catalysts are organic metal compounds, particularly titanic acid esters and iron and/or tin compounds.

In addition to difunctional chain extenders, small quantities of up to about 5 mol. %, based on moles of the bifunctional chain extender used, of trifunctional or more than trifunctional chain extenders may also be used.

Trifunctional or more than trifunctional chain extenders of the type in question are, for example, glycerol, trimethylolpropane, hexanetriol, pentaerythritol and triethanolamine.

Suitable thermoplastic polyurethanes are available in commerce, for example, from Bayer MaterialScience under the TEXIN and DUREFLEX trademarks. The thermoplastic polyurethanes are preferably used in the present invention in the form of films or sheets.

The polycarbonate laminate of the present invention may also include one or more additives that may inhibit harmful effects of sunlight or other radiation, such as UV or IR-blocking additives. In addition, the polycarbonate laminate may further comprise additives, or be composed of materials, which may inhibit the transmission of various radio frequencies, signals or RF-waves. Such compositions or additives may be incorporated into the polycarbonate laminate, or may be in an additional layer that is applied to the surface of the polycarbonate laminate.

As used herein, the term "glass" includes not only window glass, plate glass, silicate glass, aluminosilicate glasses, sheet glass, tempered glass, chemically treated glass and float glass, but also colored glass, specialty glass which includes ingredients to control, for example, solar heating, coated glass with, for example, sputtered metals, such as silver or indium tin oxide, for solar control purposes and other specialty glasses. The type and thickness of the glass selected for a particular laminate depends on the intended use.

EXAMPLE

The present invention is further illustrated, but is not to be limited, by the following description. The thicknesses and other dimensions provided in describing the various aspects of the invention shown in the Figures are for descriptive purposes and those skilled in the art will recognize the invention is not limited to only those dimensions. The inventive rapid deployment cover system and its elements may be of those dimensions necessary to fulfill the intended purpose.

In the following descriptions and Figures, the reference numbers are used to refer to the following: 1—wall; 2—1200 mm×1200 mm Level 8 forced entry/blast resistant (FEBR) glass-clad polycarbonate laminate; 2'—1200 mm×1200 mm Level 3 forced entry/blast resistant (FEBR) polycarbonate laminate; 3—track back plate; 4—track bars; 5—track front plate; 6—3.5 inch hex bolt; 7—4 inch hex bolt; 8—1.75 inch hex bolt; 9—glazing tape; 10—glazing tape; 11—ethylene propylene diene monomer (EPDM) sleeve; 12—bushing; 13—pressure plate; 14—glazing tape; 15—glazing tape; 16—air baffle; 17—setting block; 18—pressure plate cover; 19—ethylene propylene diene monomer (EPDM) washer; 20—lockout, nylon insert; 21—steel washer; 22—steel washer; 23—0.5 inch steel split lock washer; 24—threaded sleeve element (HILTI HIS-RN); 25—injectable mortar (HILTI HIT-HY 150 MAX); 26—backer rod; 27—perimeter silicone sealant (DOW 995); 28—shims; 30—tamper-proof nut and matching key (McGard); and 31—mounting track.

In one embodiment of the present invention, as shown in FIGS. 1-50, the rapid deployment cover system comprises at least a mounting track, a polycarbonate laminate, a pressure plate and, optionally, a pressure plate cover. In this embodiment of the invention, the rapid deployment cover system is installed to cover up an unwanted or unexpected opening in an exterior wall of a building, such as one created by an external blast to a building, or the destruction of a window. The mounting track is first applied to the exterior wall, and is fixed in place by bolts, which are installed inside holes that are drilled into the wall. The holes drilled into the wall are also referred to herein as anchor holes. The bolts that fit into the anchor holes, and/or additional bolts, are used to attach the pressure plate and polycarbonate laminate to the mounting track. The bolts that are attached to the pressure plate are surrounded by elastomeric sleeves, within holes that are drilled into the polycarbonate laminate. The pressure plate and mounting track are located on opposite sides of the polycarbonate laminate, and, when installed, provide a frame for the polycarbonate laminate to keep it in place. The pressure plate may optionally include a pressure plate cover, to give the cover an appearance or resemblance of a window or other architectural feature of an exterior wall, and may also provide additional protection against a forced entry attack. Although a pressure plate cover is shown in the drawings, a preferred embodiment of the present invention does not include a pressure plate cover.

Figure 1A:
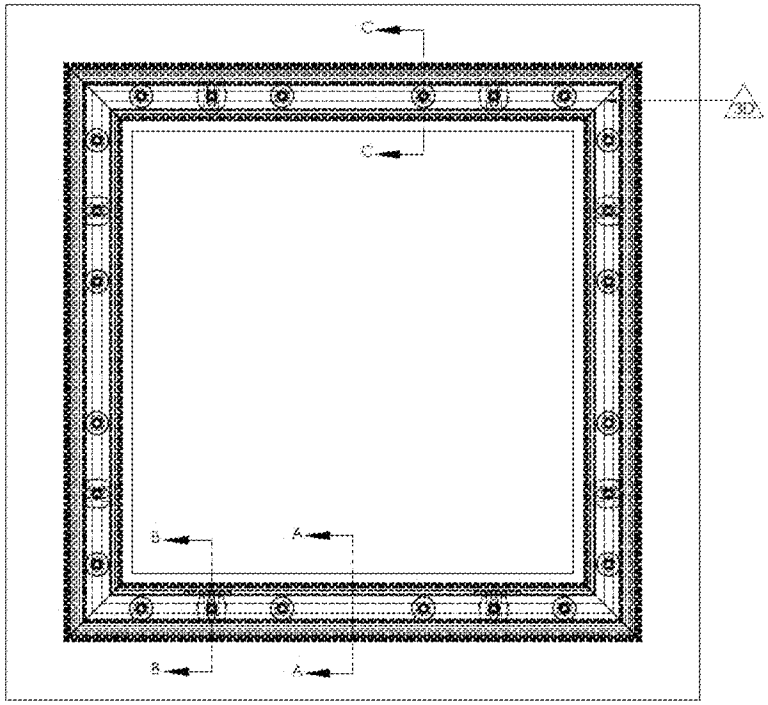
FIG. 1A shows the glass-clad polycarbonate laminate rapid deployment cover system of the present invention.

FIGS. 1A through 14A illustrate various elements of the glass-clad polycarbonate laminate rapid deployment cover system of the present invention. FIG. 1A shows a front view of the glass-clad polycarbonate laminate rapid deployment cover system of the present invention, with the pressure plate and pressure plate cover shown in outline to view the positioning of each component in relationship to the others.

Figure 2A:
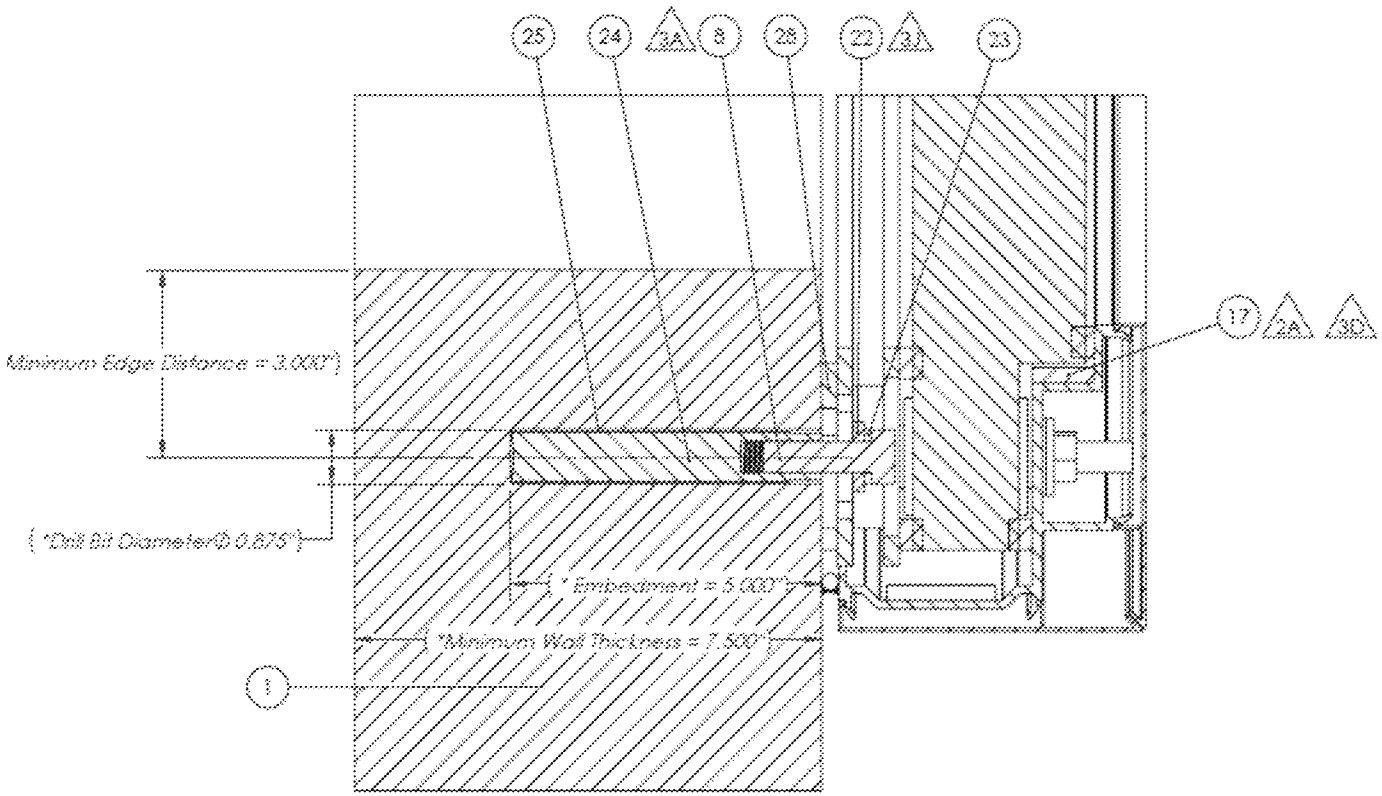
FIG. 2A shows a view of section B-B of the glass-clad polycarbonate laminate rapid deployment cover system depicted in FIG. 1A.

FIG. 2A shows a view of section B-B of the rapid deployment cover system depicted in FIG. 1A. As shown in FIG. 2A, mounting track 31 is fixedly attached to the wall by use of hex bolt 8 within threaded sleeve element 24. Injectable mortar 25 may be used to provide further stability for hex bolt 8 within threaded sleeve element 24. One or more shims 28 are preferably placed in between the mounting track and the wall, about hex bolt 8, to allow the rapid deployment cover system to be as flush as possible with the wall, even when the surface of the wall is uneven, such as when the wall has protrusions or indentations. In another preferred embodiment of the present invention, the one or more shims 28 will provide a space of at least 0.25 inches (or 0.64 cm) between the wall 1 and the mounting track 31. The shims 28 are preferably constructed of an elastomeric material, such as ethylene propylene diene monomer (EPDM). The shims 28 are preferably shaped in a "C" configuration, to allow for quick and easy installation.

Figure 3A:
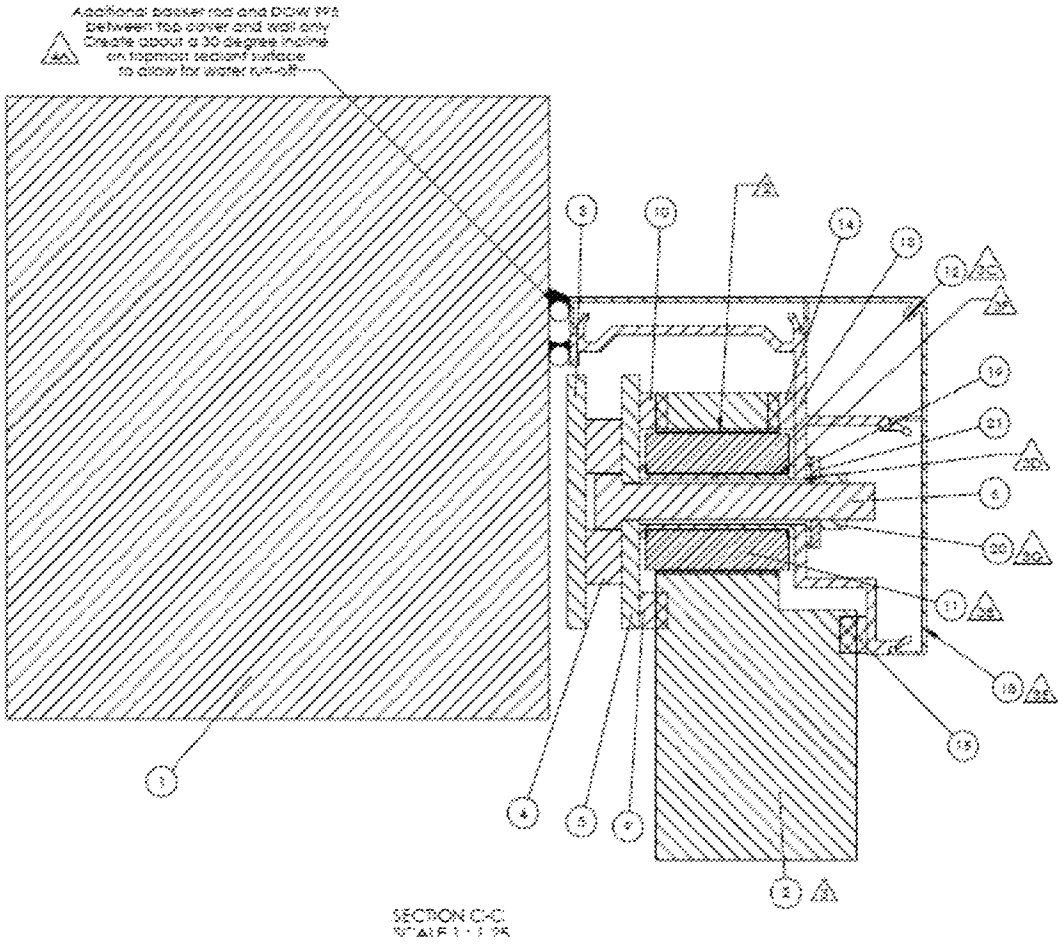
FIG. 3A shows a view of section C-C of the glass-clad polycarbonate laminate rapid deployment cover system depicted in FIG. 1A.

FIG. 3A shows a view of section C-C of the rapid deployment cover system depicted in FIG. 1A. As shown in FIG. 3A, hex bolt 6 is used to secure the polycarbonate/glass laminate 2 to mounting track 31, specifically within mounting track bars 4 and mounting track plate 5, and also to pressure plate 13. Cover 18 is also shown about pressure plate 13, to inhibit external access to hex bolt 6, once the rapid deployment cover system is deployed. Also as shown in FIG. 3A, sleeve 11 surrounds hex bolt 6 within the polycarbonate laminate 2. While sleeve 11 is shown in FIG. 3A to completely surround hex bolt 6, sleeve 11 may only substantially surround hex bolt 6, surrounding only a majority of hex bolt 6, or greater than 180 degrees. As noted above, sleeve 11 may be constructed of an elastomer, such as ethylene propylene diamine monomer (EPDM) which acts to cushion the polycarbonate against stresses relative to hex bolt 6, which may be caused by a temperature change, an external blast, a force against the polycarbonate laminate, or a force against the mounting frame itself, such as one caused by a crowbar. As further shown in FIG. 3A, a bushing 12 may be included between sleeve 11 and hex bolt 6, for ease of installation, as well as retaining the position of each component when a stress is applied. Bushing 12 may be flanged, and may be constructed of aluminum, or other material compatible with the securement of hex bolt 6. It is believed that sleeve 11 may act in conjunction with the polycarbonate laminate 2, to provide additional flexibility, such that the rapid deployment cover system may bend, and not crack, with additional force to greater withstand any attempts to penetrate or remove it. In a preferred embodiment of the present invention, the elastomeric construction of the shims and sleeves offer additional flexibility beyond that offered by the construction of polycarbonate alone. For example, if a blast outside the rapid deployment cover system should occur, the system's components may appropriately bend and/or flex in response to such force.

Figure 4B:
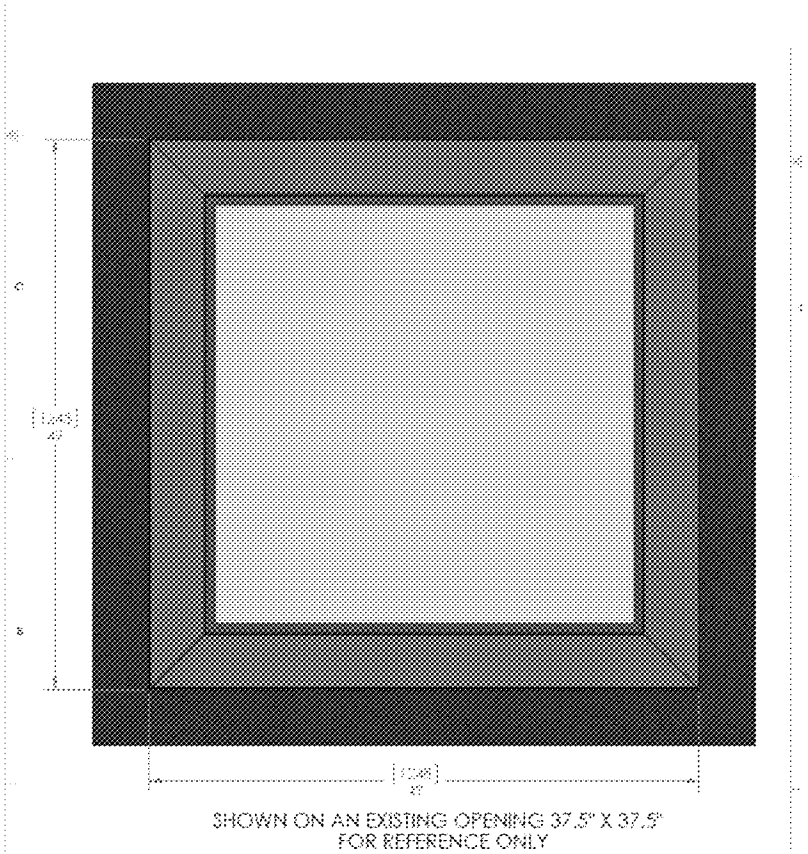
FIG. 4B shows the polycarbonate laminate rapid deployment cover system of the present invention mounted on an existing opening.
Figure 4A:
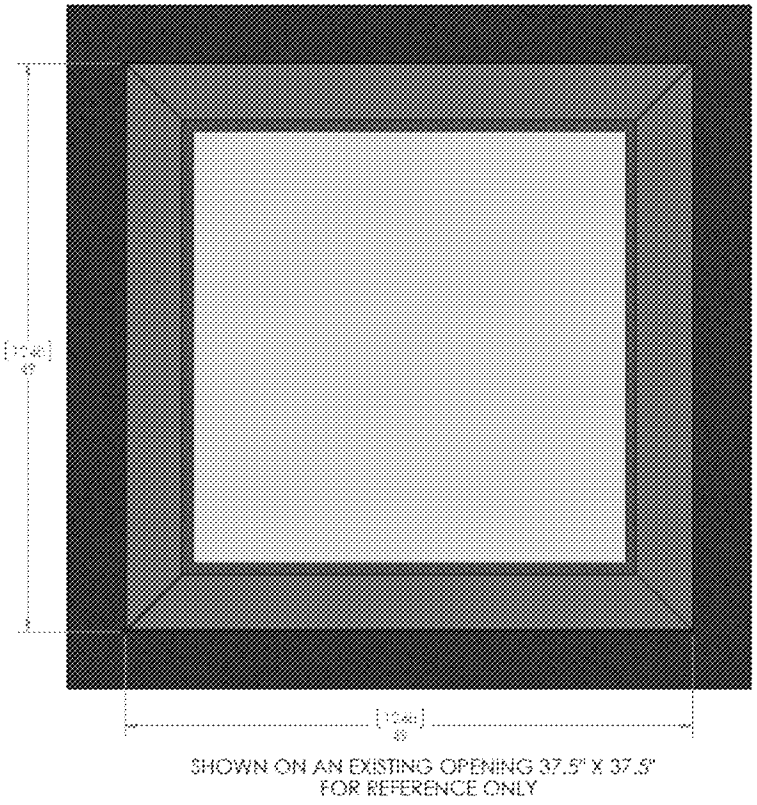
FIG. 4A shows the glass-clad polycarbonate laminate rapid deployment cover system of the present invention mounted on an existing opening.

FIG. 4A shows the rapid deployment cover system of the present invention mounted on an existing opening. As shown in FIG. 4A, none of the bolts, sleeves, shims, or other parts are visible from the outside, and remain inaccessible once installed. However, because of the construction of the rapid deployment cover system, the opening may nonetheless be visible through the use of a transparent polycarbonate laminate.

Figure 5A:
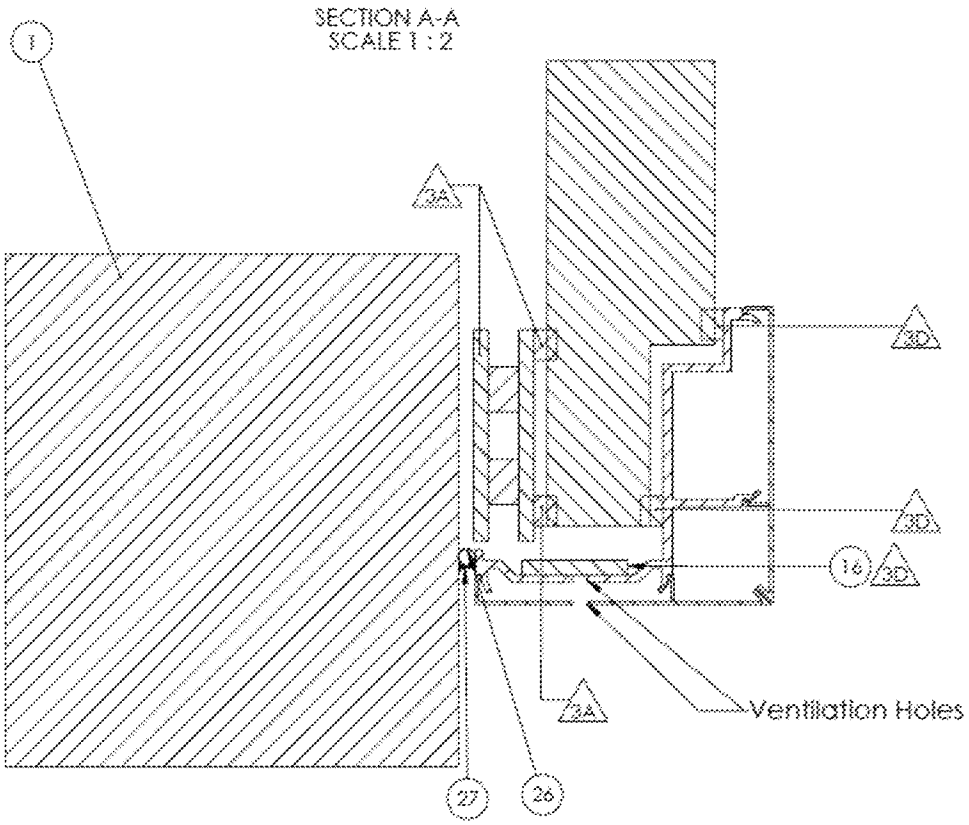
FIG. 5A shows a view of section A-A of the glass-clad polycarbonate laminate rapid deployment cover system depicted in FIG. 1A.

FIG. 5A shows a view of section A-A of the rapid deployment cover system depicted in FIG. 1A, in a location where there is no bolt connecting the components to each other. As shown in FIG. 5A, the mounting track 31 is located adjacent to, but not abutting, the wall, in view of the use of one or more shims at the attachment points (not shown). The polycarbonate/glass laminate 2, pressure plate 13 and pressure plate cover 18 are also shown.

Figure 6A:
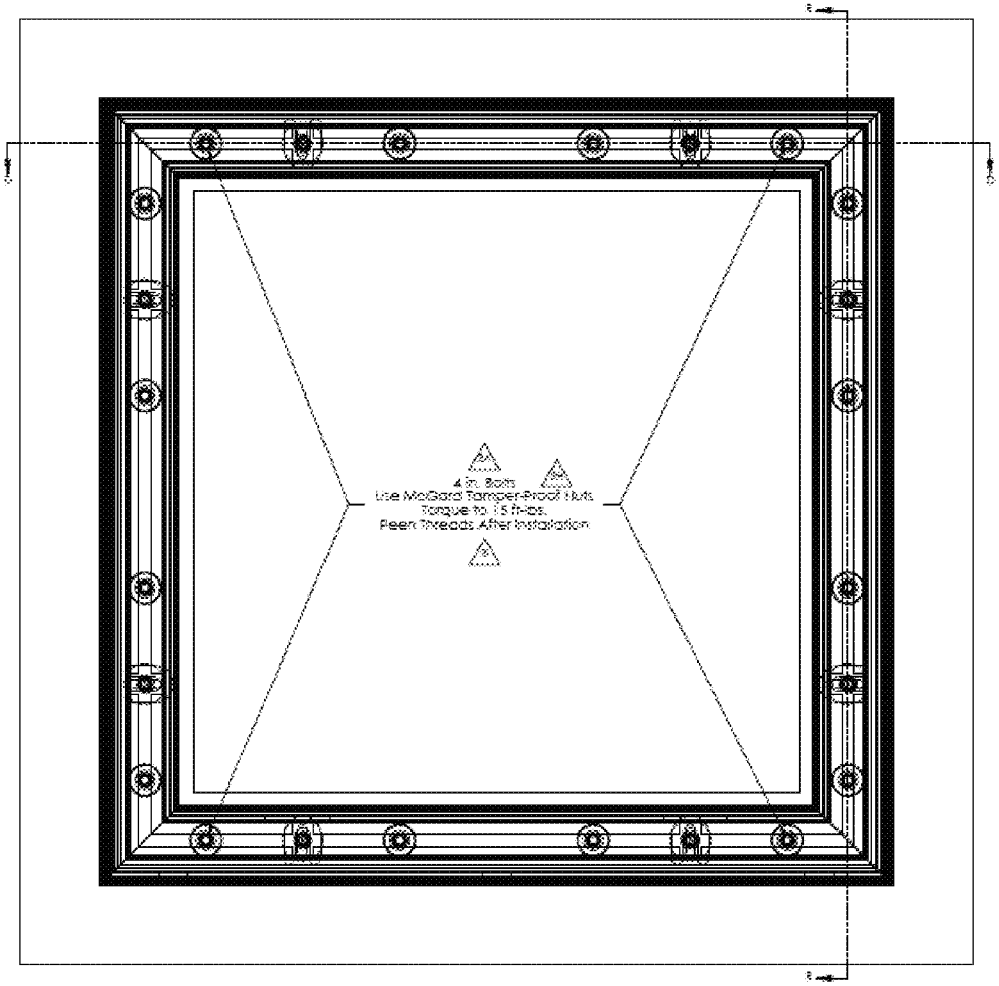
FIG. 6A shows the glass-clad polycarbonate laminate rapid deployment cover system of the present invention with tamper-proof nuts.

FIG. 6A shows the glass-clad polycarbonate laminate embodiment of the rapid deployment cover system of the present invention with tamper-proof nuts. One or more tamper-proof nuts may be used in conjunction with the present invention, such that even if a potential intruder manages to remove the pressure plate cover from the pressure plate, he or she still may encounter great difficulty in untighting and removing bolts that secure the pressure plate to the mounting frame, and/or the rapid deployment cover system to the wall. In another embodiment of the invention, a pressure plate cover may not be used.

Figure 7A:
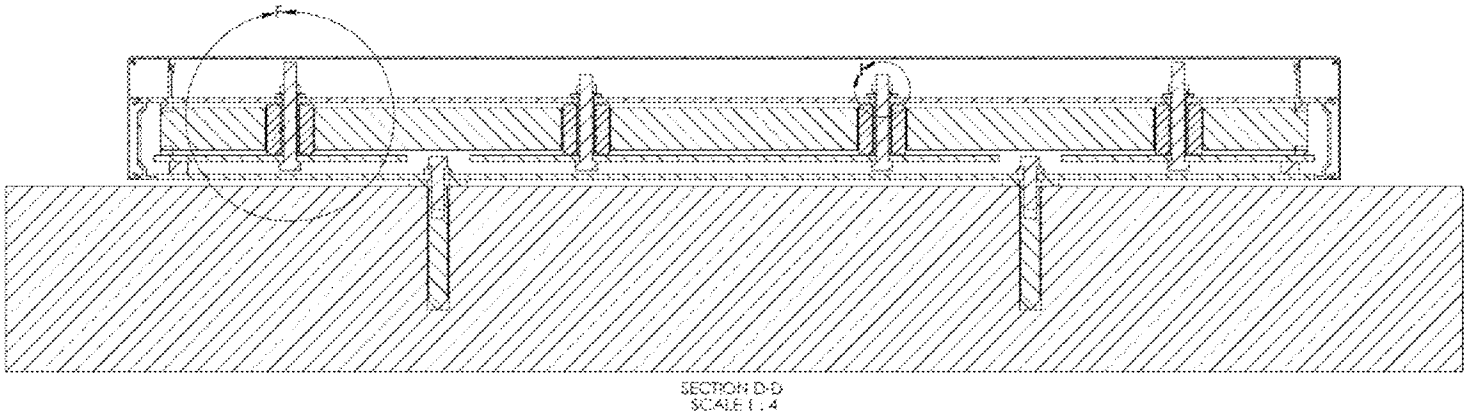
FIG. 7A shows a view of section D-D of the glass-clad polycarbonate laminate rapid deployment cover system depicted in FIG. 6A.

FIG. 7A shows a view of section D-D of one embodiment of the rapid deployment cover system depicted in FIG. 6A. As shown in FIG. 7A, the bolts that affix the mounting track 31 to the wall 1, may not be the same bolts that connect the pressure plate 13 and polycarbonate laminate 2 to the mounting track 31. Furthermore, bolts through the polycarbonate layer 2 should be spaced at least 3 inches (or 7.6 cm) apart from one another, preferably 6 inches (or 13.2 cm) apart from one another, to allow for sufficient flexibility in case of a blast or other force upon the structure of the rapid deployment cover system of the present invention. Further, as shown in FIG. 7A, there may only be two attachments to the wall per side of the rapid deployment cover system, or a total of 8 attachments to the wall. In another embodiment of the invention, there is only one attachment to the wall per side, for a total of 4 attachments to the wall. The small number of attachments to the wall allows for faster and easier installation, which can be especially useful when it is desirable to minimize the time installers may spend outside of a secured building or area.

Figure 8A:
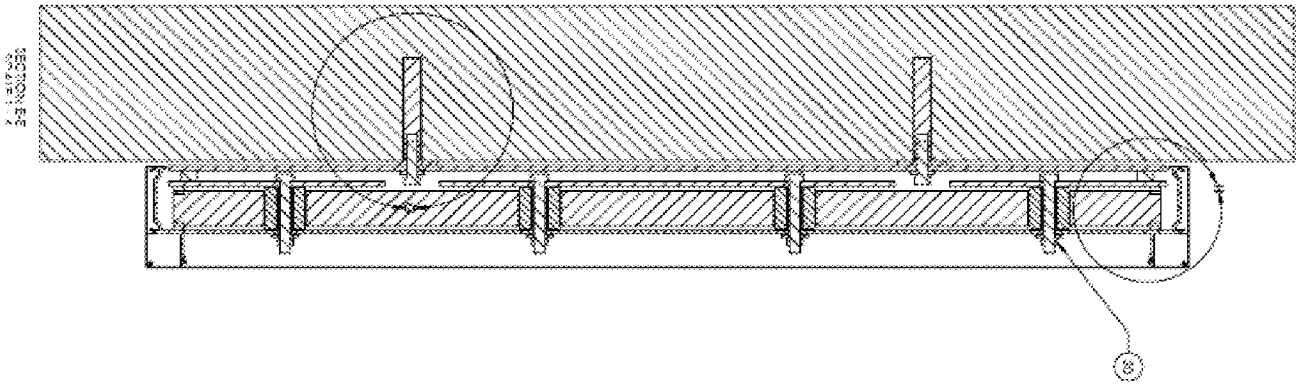
FIG. 8A shows a view of section E-E of the glass-clad polycarbonate laminate rapid deployment cover system depicted in FIG. 6A.
Figure 9A:
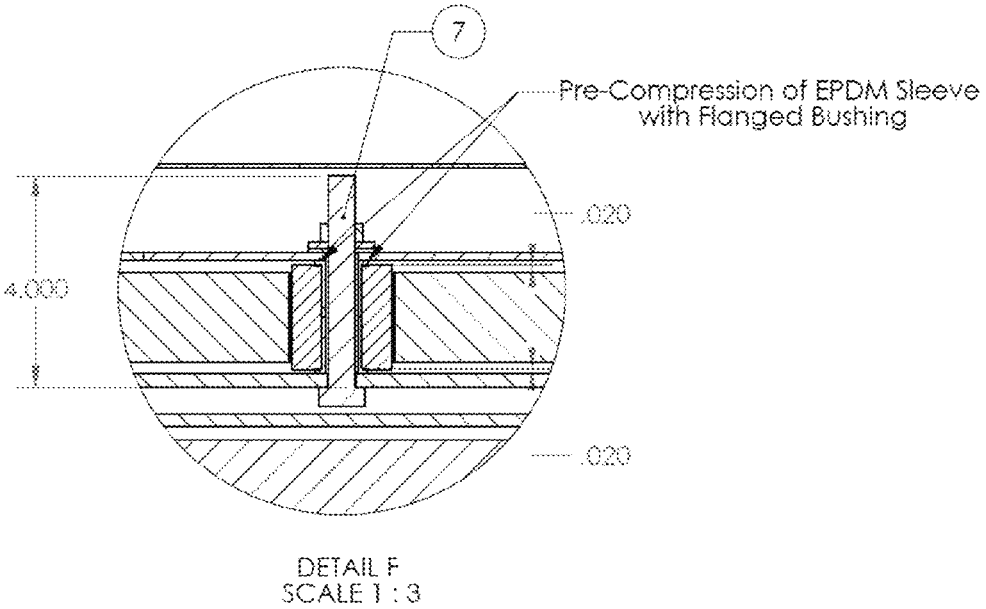
FIG. 9A shows a detail view of element F of the glass-clad polycarbonate laminate rapid deployment cover system depicted in FIG. 7A.
Figure 10A:
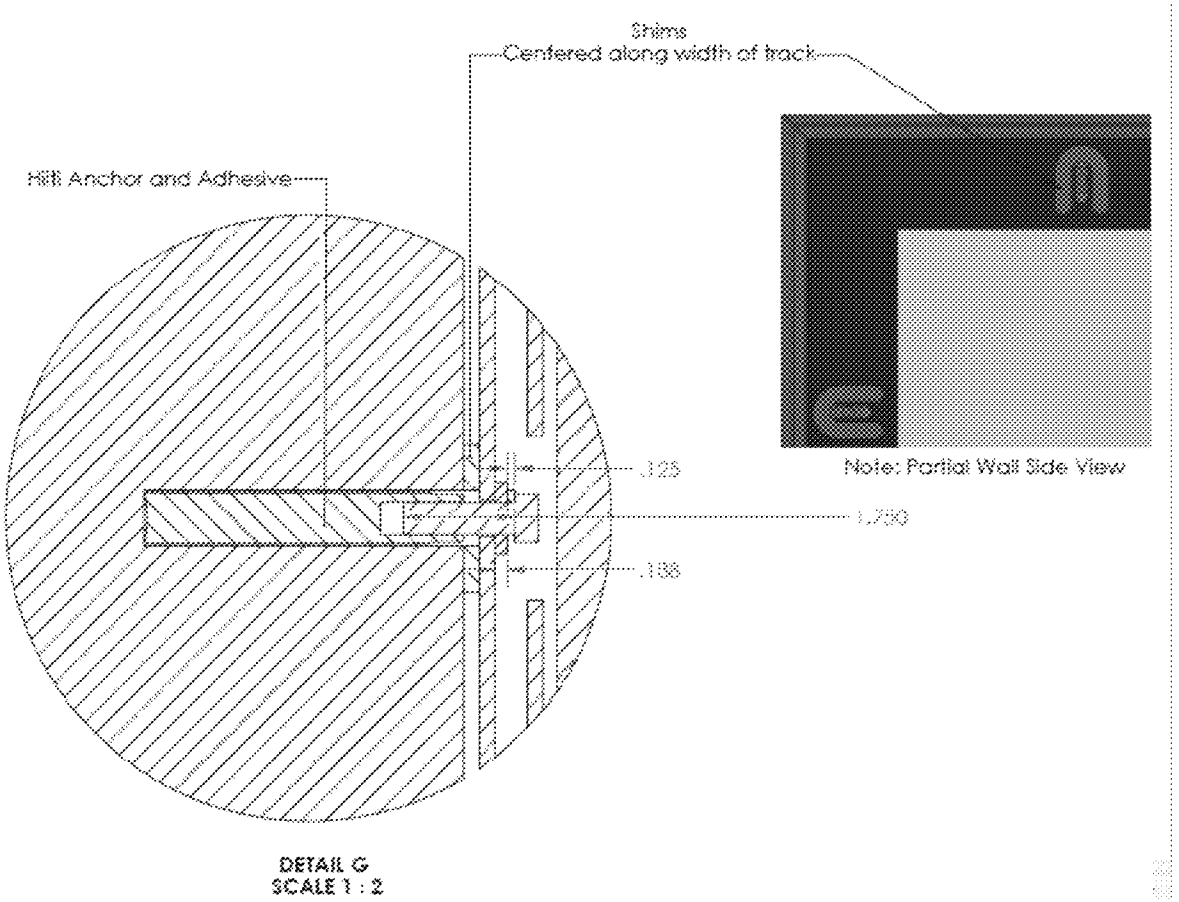
FIG. 10A shows a detail view of element G of the glass-clad polycarbonate laminate rapid deployment cover system depicted in FIG. 8A.
Figure 11A:
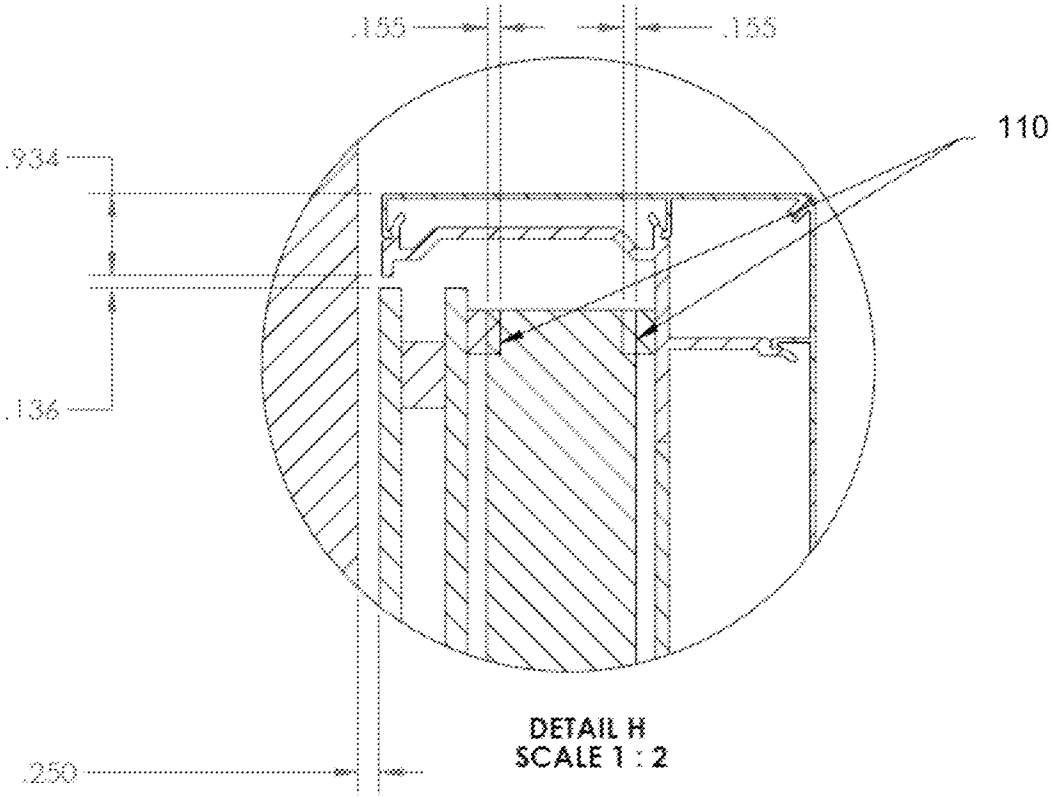
FIG. 11A shows a detail view of element H of the glass-clad polycarbonate laminate rapid deployment cover system depicted in FIG. 8A.
Figure 12A:
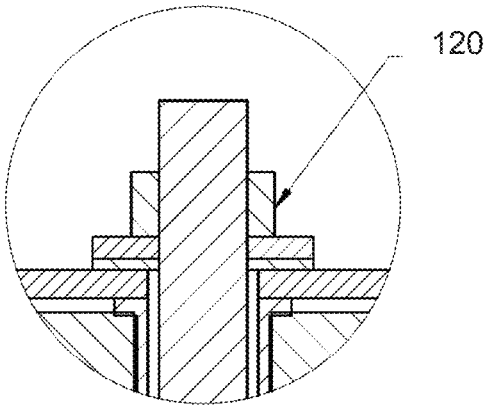
FIG. 12A shows a detail view of element I of the glass-clad polycarbonate laminate rapid deployment cover system depicted in FIG. 7A.

FIG. 8A shows a view of section E-E of the rapid deployment cover system depicted in FIG. 6A. FIG. 9A shows a view of detail F of the rapid deployment cover system depicted in FIG. 7A. FIG. 10A shows a view of detail G of the rapid deployment cover system depicted in FIG. 8A. FIG. 11A shows a view of detail H of the rapid deployment cover system depicted in FIG. 8A with pre-compression of the glazing tape with the laminate shown at 110. FIG. 12A shows a view of detail I of the rapid deployment cover system depicted in FIG. 7A having a lockout nut with nylon insert 120 (torque to 15 ft-lbs).

Figure 2B:
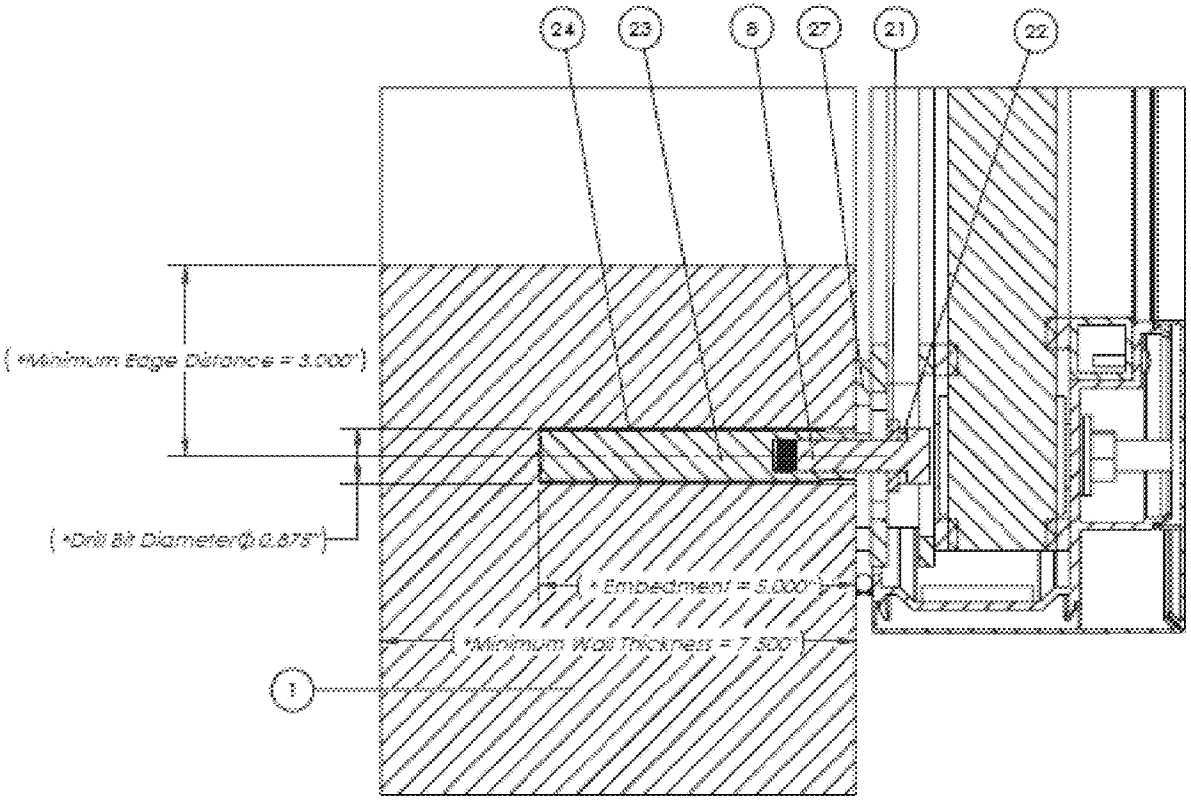
FIG. 2B shows a view of section B-B of the polycarbonate rapid deployment cover system depicted in FIG. 1B.
Figure 3B:
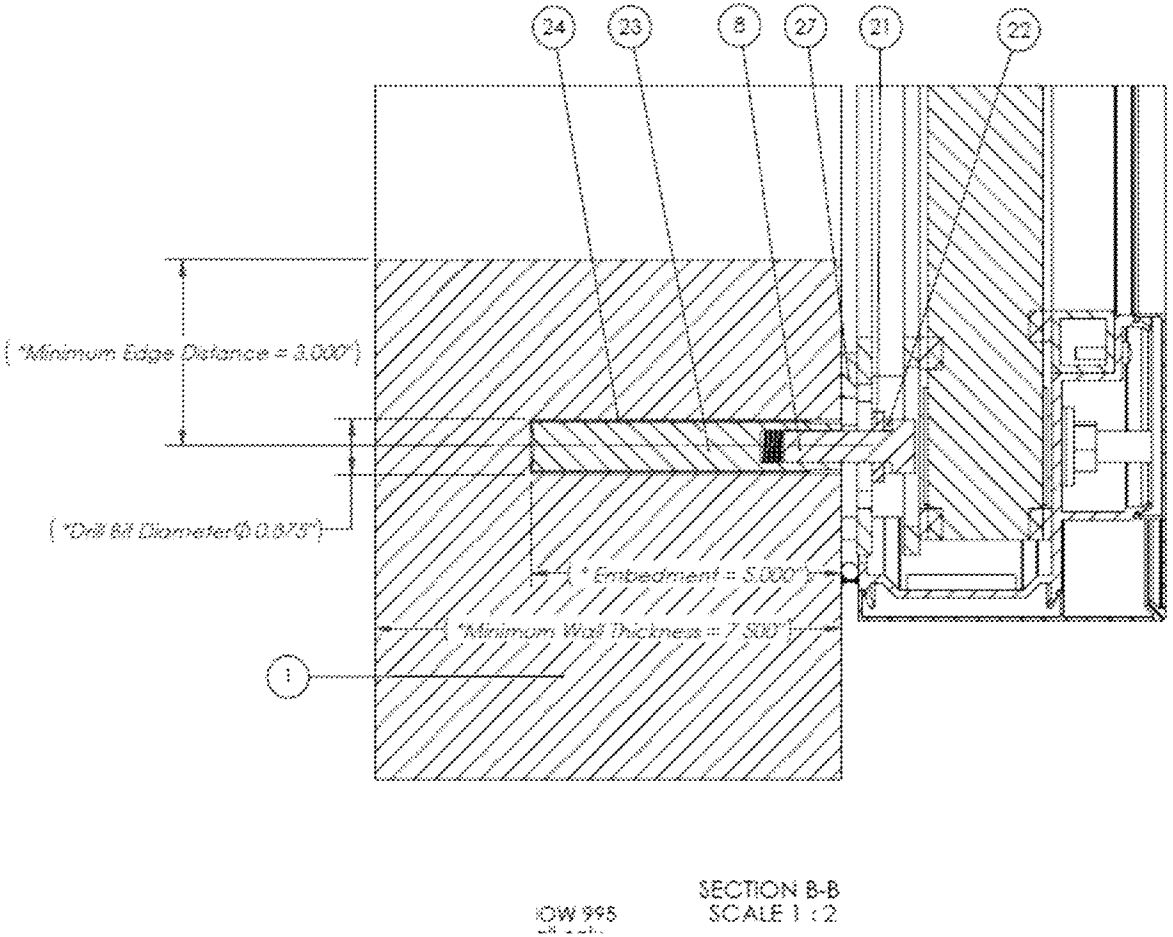
FIG. 3B shows a view of section C-C of the polycarbonate rapid deployment cover system depicted in FIG. 1B.
Figure 5B:
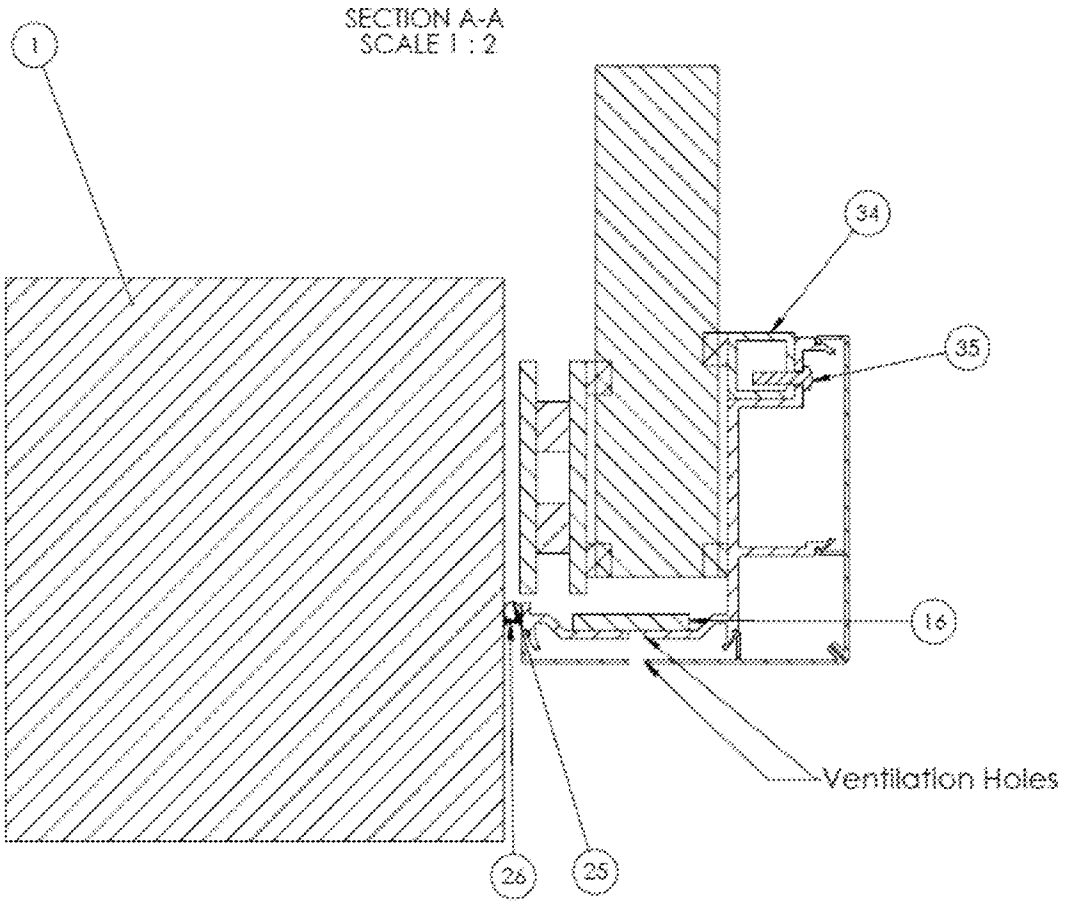
FIG. 5B shows a view of section A-A of the polycarbonate rapid deployment cover system depicted in FIG. 1B.

FIGS. 1B through 12B illustrate various elements of the polycarbonate laminate rapid deployment cover system of the present invention, without any glass, that correspond to the descriptions above of FIGS. 1A through 14A, which include a glass-clad polycarbonate laminate. FIG. 1B shows a front view of the polycarbonate laminate rapid deployment cover system of the present invention. FIG. 2B shows a view of section B-B of the rapid deployment cover system depicted in FIG. 1B. FIG. 3B shows a view of section C-C of the rapid deployment cover system depicted in FIG. 1B. FIG. 4B shows the rapid deployment cover system of the present invention mounted on an existing opening. FIG. 5B shows a view of section A-A of the rapid deployment cover system depicted in FIG. 1B.

Figure 6B:
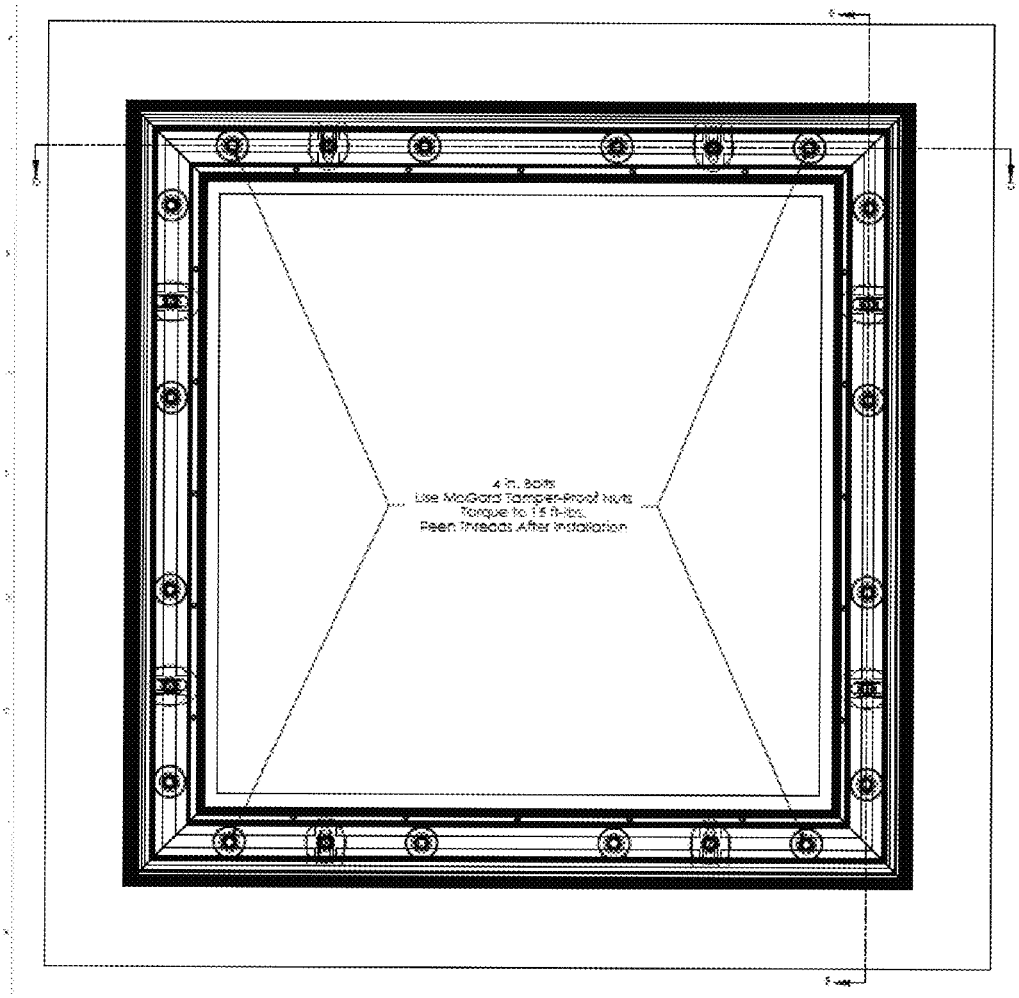
FIG. 6B shows the polycarbonate rapid deployment cover system of the present invention with tamper-proof nuts.
Figure 7B:
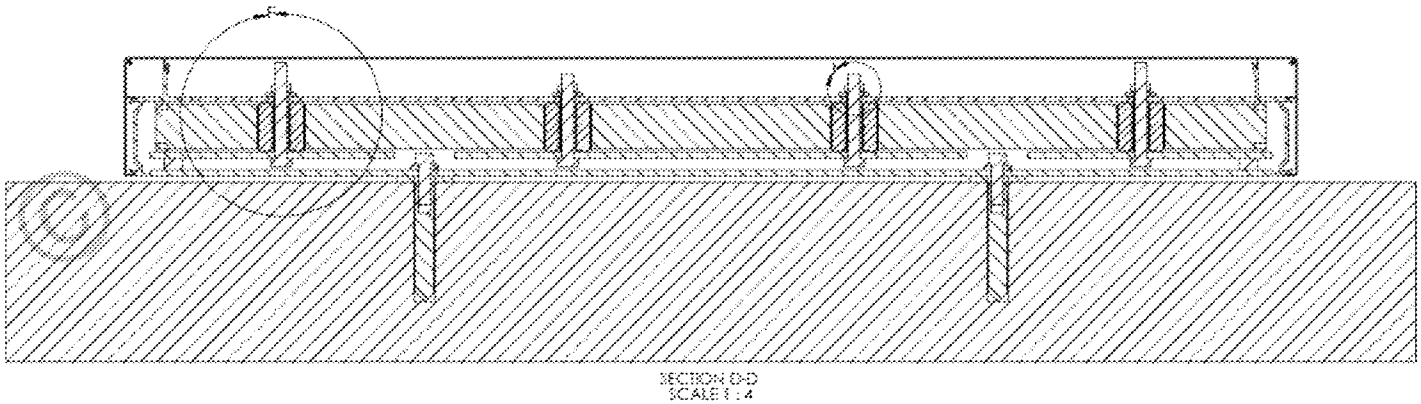
FIG. 7B shows a view of section D-D of the polycarbonate rapid deployment cover system depicted in FIG. 6B.
Figure 8B:
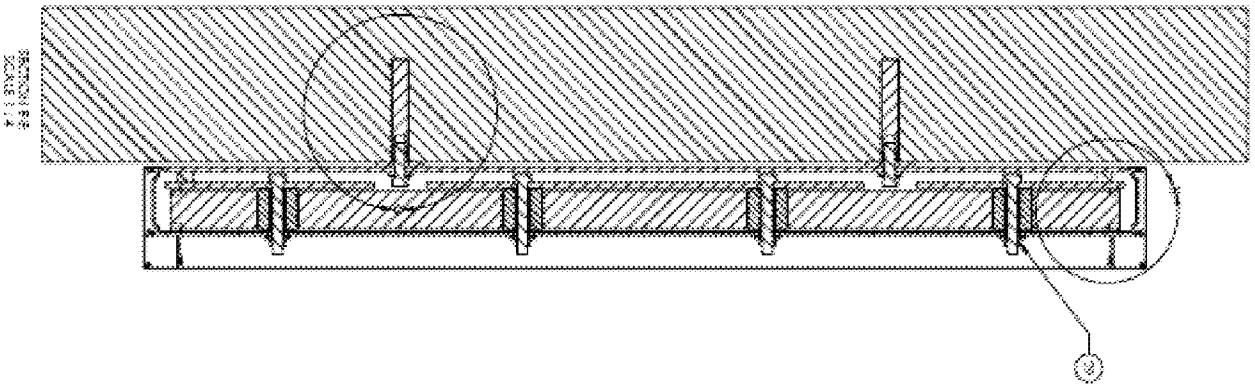
FIG. 8B shows a view of section E-E of the polycarbonate rapid deployment cover system depicted in FIG. 6B.
Figure 9B:
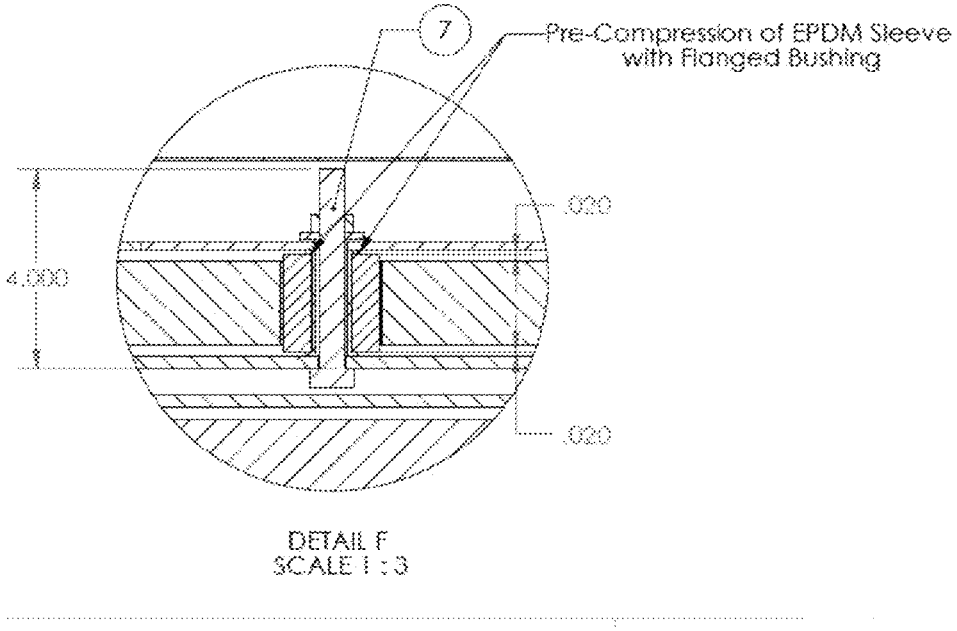
FIG. 9B shows a detail view of element F of the polycarbonate rapid deployment cover system depicted in FIG. 7B.
Figure 10B:
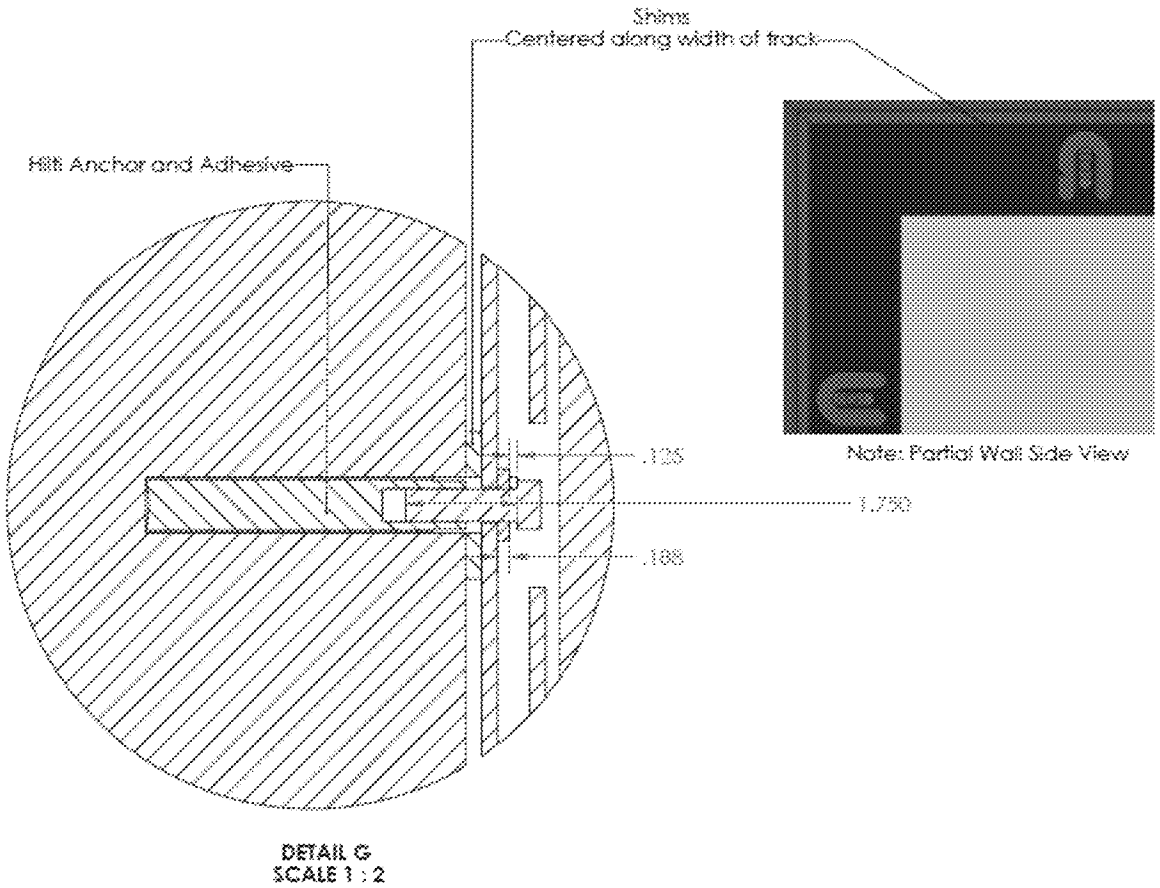
FIG. 10B shows a detail view of element G of the polycarbonate rapid deployment cover system depicted in FIG. 8B.
Figure 11B:
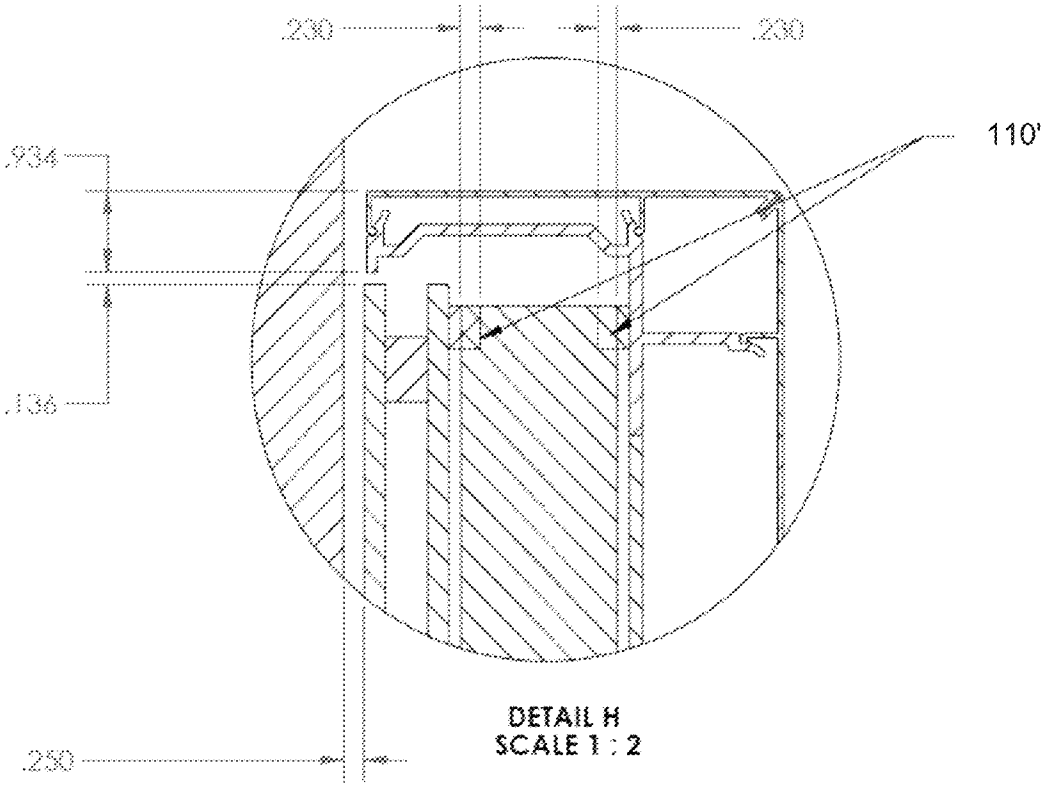
FIG. 11B shows a detail view of element H of the polycarbonate rapid deployment cover system depicted in FIG. 8B.
Figure 12B:
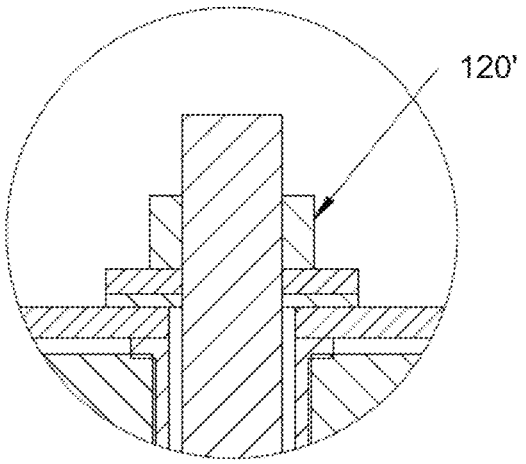
FIG. 12B shows a detail view of element I of the polycarbonate rapid deployment cover system depicted in FIG. 7B.

FIG. 6B depicts the polycarbonate laminate embodiment of the rapid deployment cover system of the present invention with tamper-proof nuts. FIG. 7B shows a view of section D-D of the rapid deployment cover system depicted in FIG. 6B. FIG. 8B shows a view of section E-E of the rapid deployment cover system depicted in FIG. 6B. FIG. 9B shows a view of detail F of the rapid deployment cover system depicted in FIG. 7B. FIG. 10B shows a view of detail G of the rapid deployment cover system depicted in FIG. 8B. FIG. 11B shows a view of detail H of the rapid deployment cover system depicted in FIG. 8B with pre-compression of the glazing tape with the laminate shown at 110'. FIG. 12B shows a view of detail I of the rapid deployment cover system depicted in FIG. 7B having a lockout nut with nylon insert 120' (torque to 15 ft-lbs).

Figure 13:
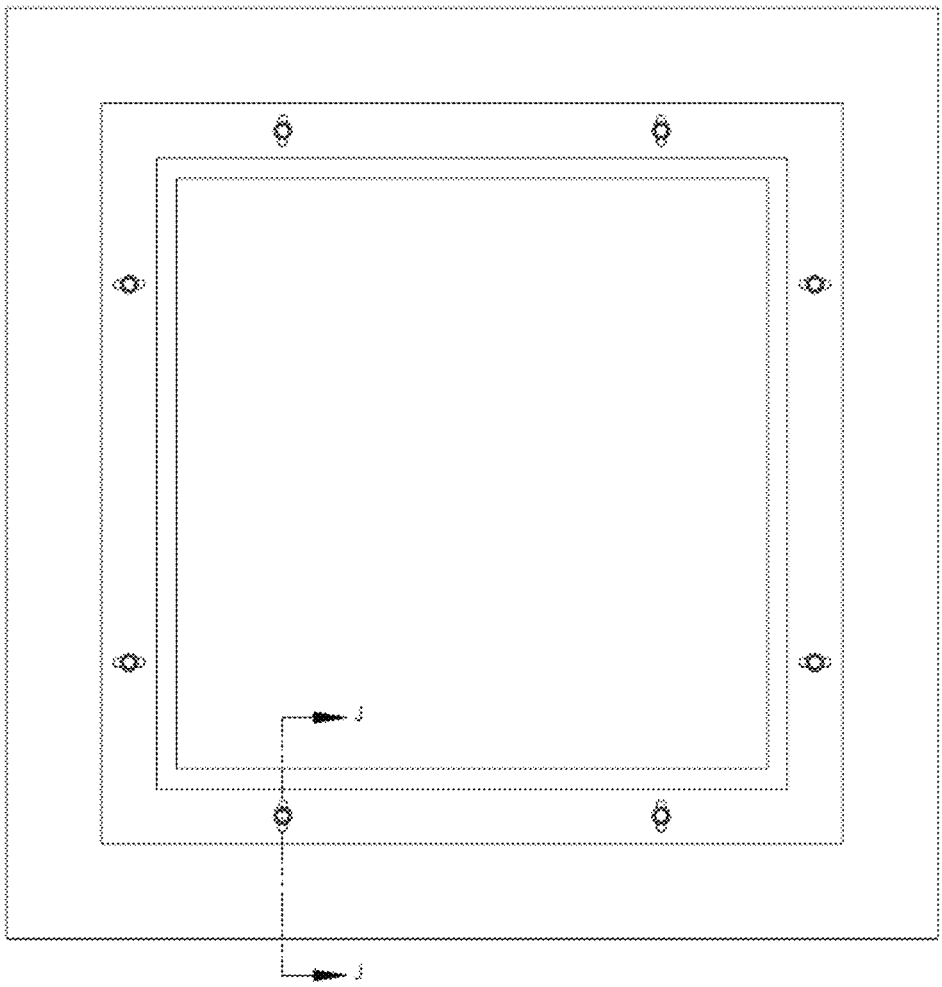
FIG. 13 shows another embodiment of the rapid deployment cover system of the present invention.
Figure 14:
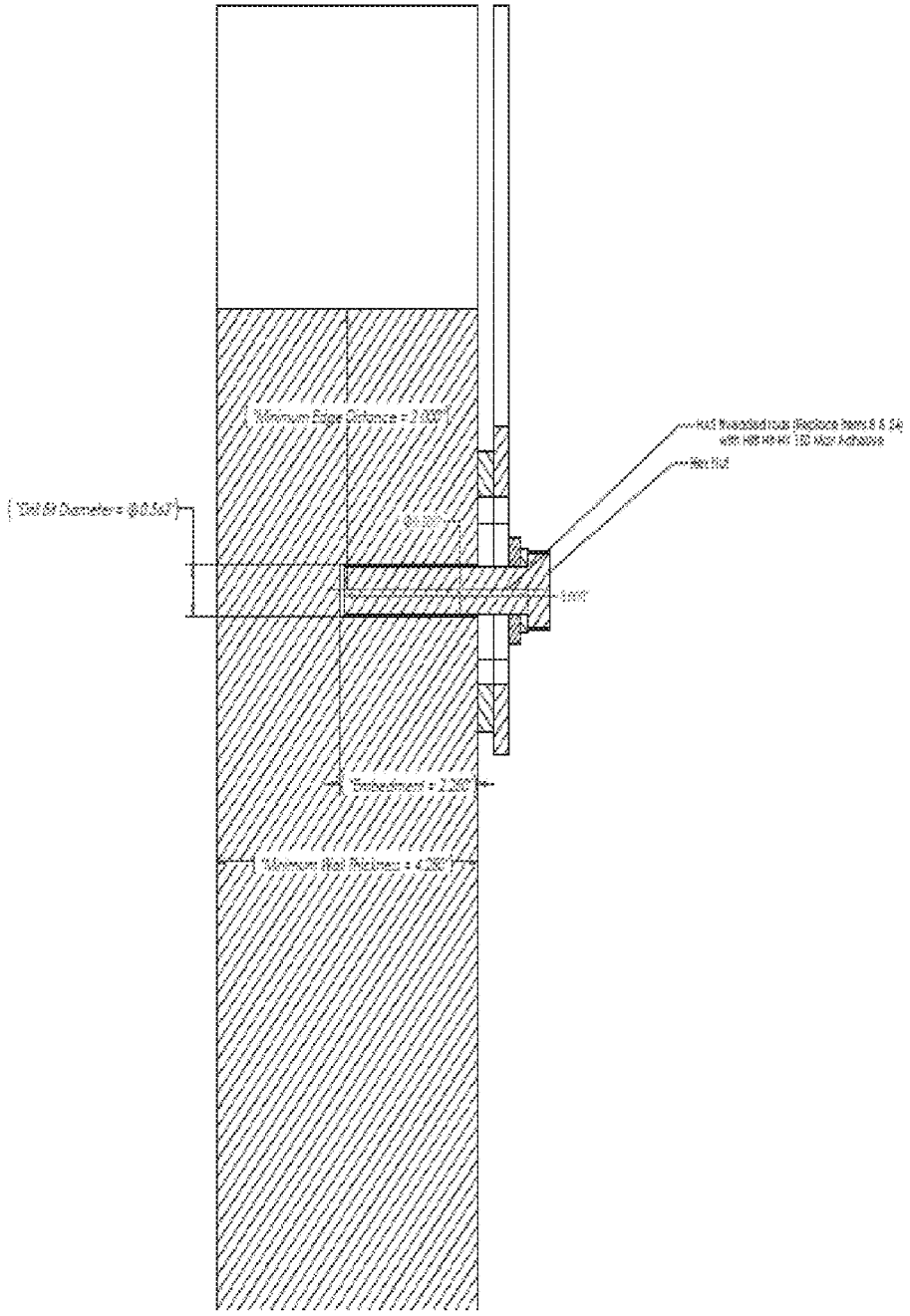
FIG. 14 shows a view of section J-J of an alternative mounting scheme for the inventive rapid deployment cover system depicted in FIG. 13.

FIG. 13 shows another embodiment of the rapid deployment cover system of the present invention. FIG. 14 shows a view of section J-J of the rapid deployment cover system depicted in FIG. 13.

Figure 15B:
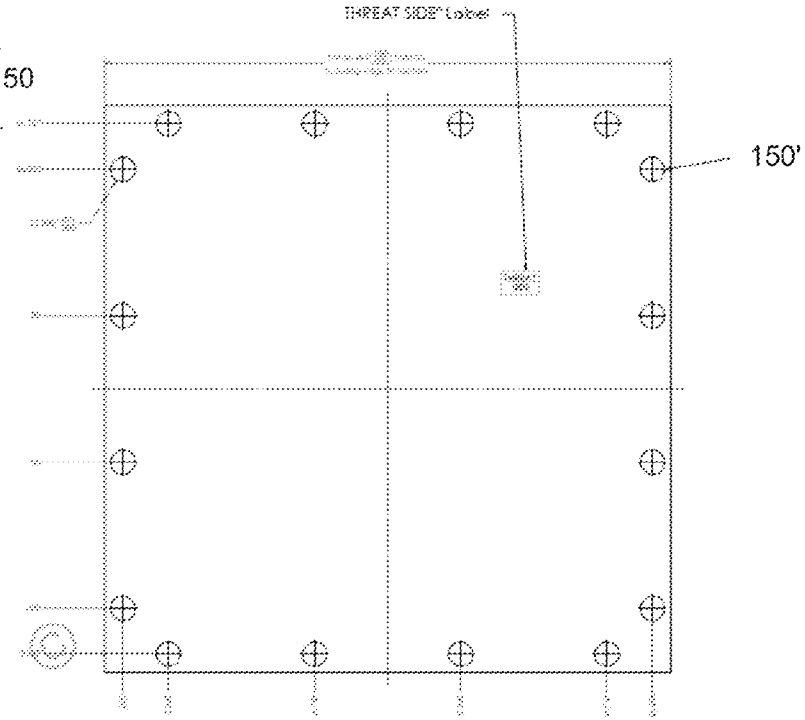
FIG. 15B shows a view of the "threat" side of the polycarbonate laminate embodiment of the rapid deployment cover system of the present invention.
Figure 15A:
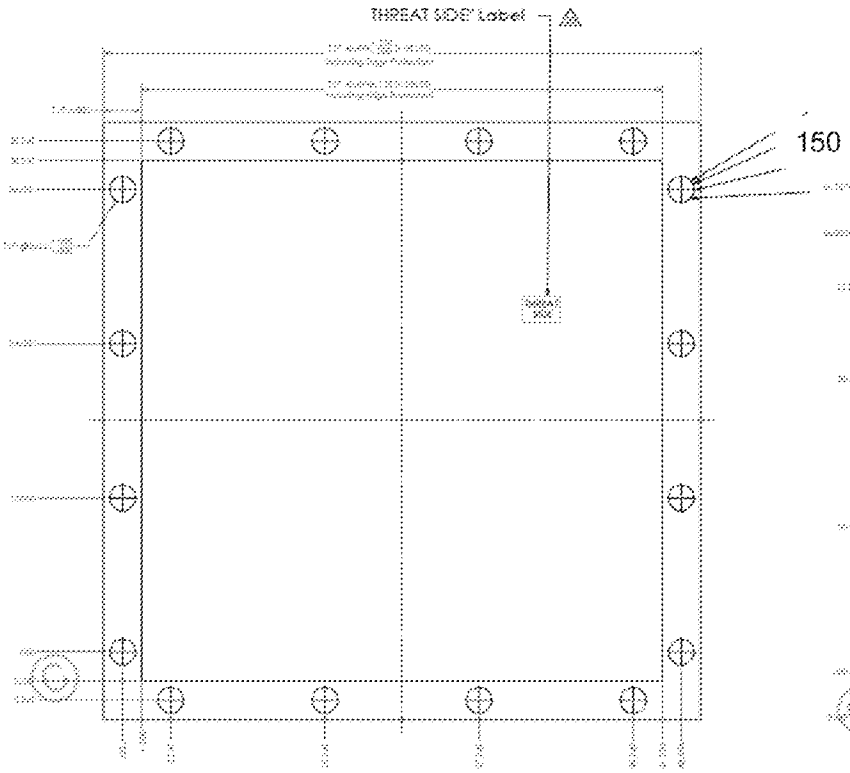
FIG. 15A shows a view of the "threat" side of the glass-clad polycarbonate laminate embodiment of the rapid deployment cover system of the present invention.
Figure 17B:
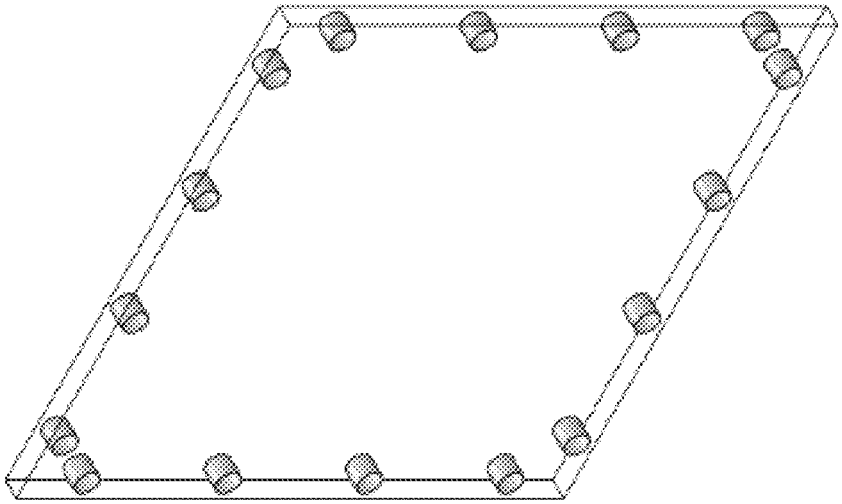
FIG. 17B shows a perspective view illustrating the "threat" side of the polycarbonate laminate used in the rapid deployment cover system of the present invention.
Figure 17A:
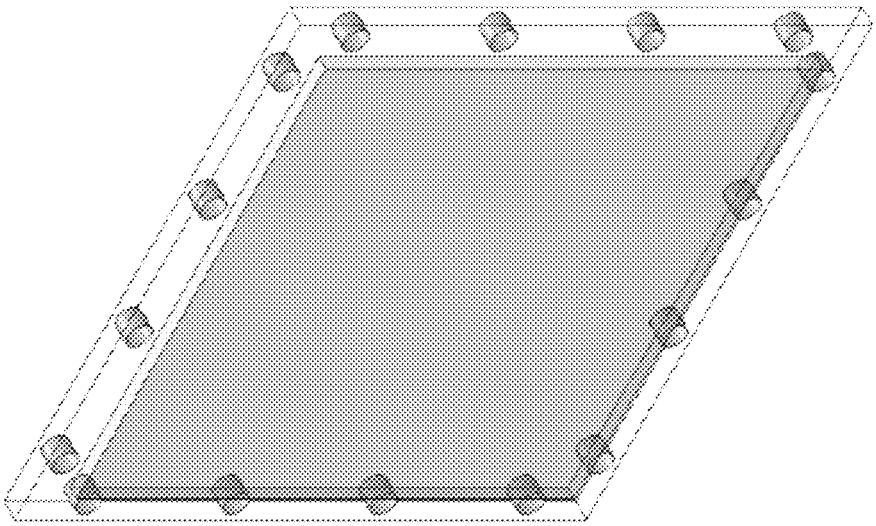
FIG. 17A shows a perspective view illustrating the "threat" side of the glass-clad polycarbonate laminate used in the rapid deployment cover system of the present invention.
Figure 18A:
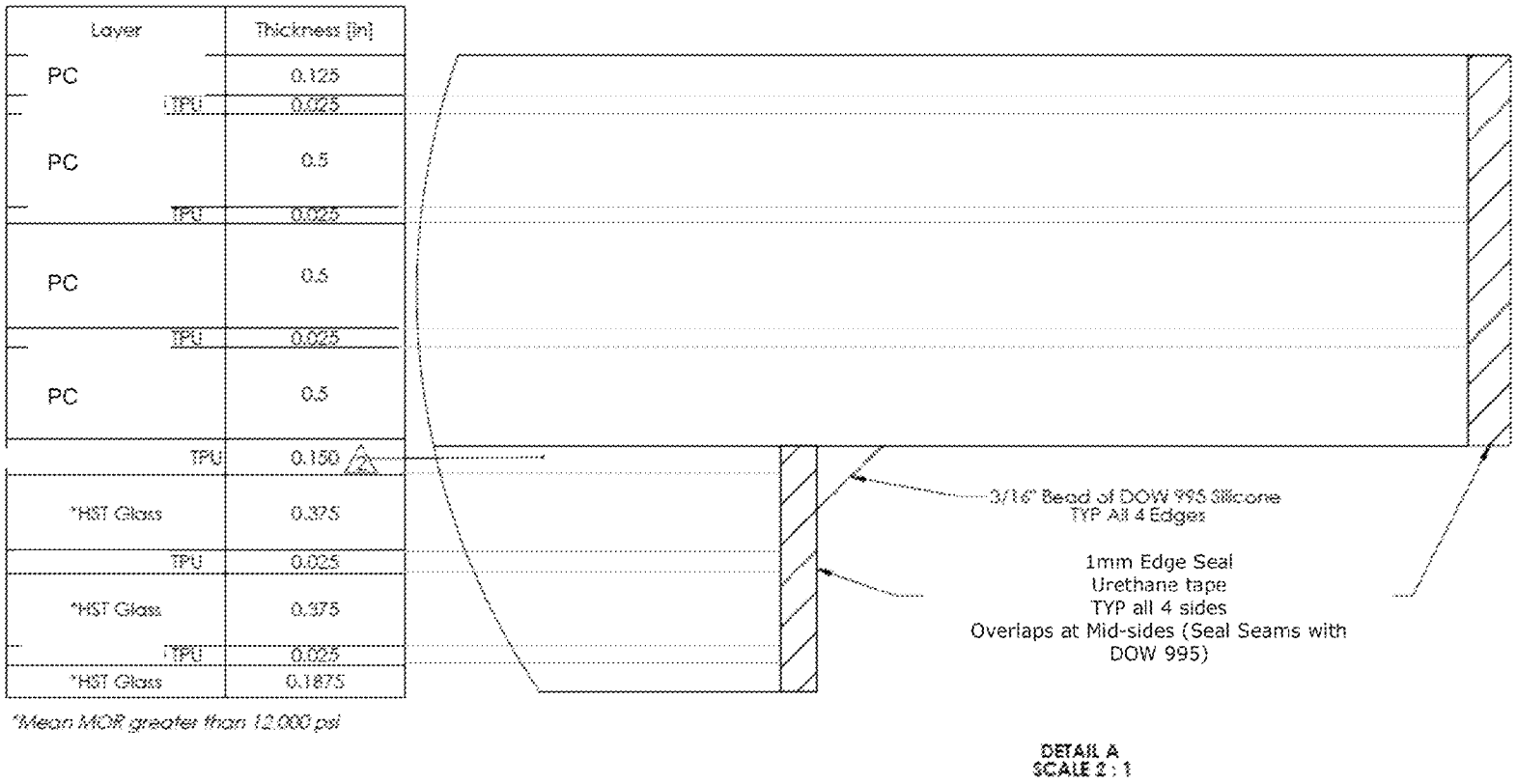
FIG. 18A shows a detail view of the layer structure of glass-clad polycarbonate laminate taken at "A" in FIG. 16A.

FIGS. 15A through 18A refer to a glass-clad polycarbonate laminate used in one embodiment of the rapid deployment cover system of the present invention. FIG. 15A shows a view of the "threat" side of the laminate. Drilled hole surface areas 150 may preferably be sealed with a elastomeric sealant (e.g., DOW 995-thickness <0.030") and excess silicone removed from the external surface for all holes. FIG. 16A shows a top-down view of the "threat" and "protection" sides of the laminate depicted in FIG. 15A. FIG. 17A shows a perspective view illustrating the "threat" side of the glass-clad polycarbonate laminate used in the rapid deployment cover system of the present invention with the shaded area being a single layer of glass, multiple layers of glass or a glass laminate. As shown in FIG. 17A, a plurality of holes is drilled through the polycarbonate laminate 2. It has been found that a hole of about 2 inches (about 5 cm) in diameter is large enough to accommodate both an elastomeric sleeve and a bolt to sufficiently support to the polycarbonate laminate in case of an external force, such that the polycarbonate laminate may bend and/or flex in response to that force without cracking. The elastomeric sleeve will also deform when the rapid deployment cover system experiences a force, such that less force will be placed upon the polycarbonate laminate. In addition, the holes of the polycarbonate laminate should be positioned away from the edge of the laminate to prevent the holes from tearing through to the edge of the laminate when there is a blast. Preferably the holes are located more than 0.25 inches (0.64 cm) away from the edge of the polycarbonate laminate, most preferably 3 inches (7.62 cm) or more away from the edge. FIG. 18A shows a detail view of the layer structure taken at "A" in FIG. 16A.

Figure 16A:
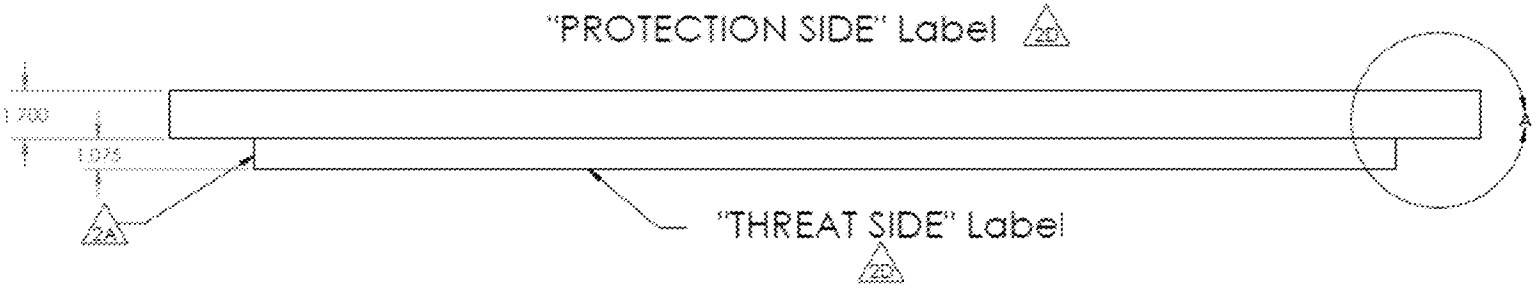
FIG. 16A shows a top-down view of the "threat" and "protection" sides of the glass-clad polycarbonate laminate depicted in FIG. 15A.
Figure 16B:
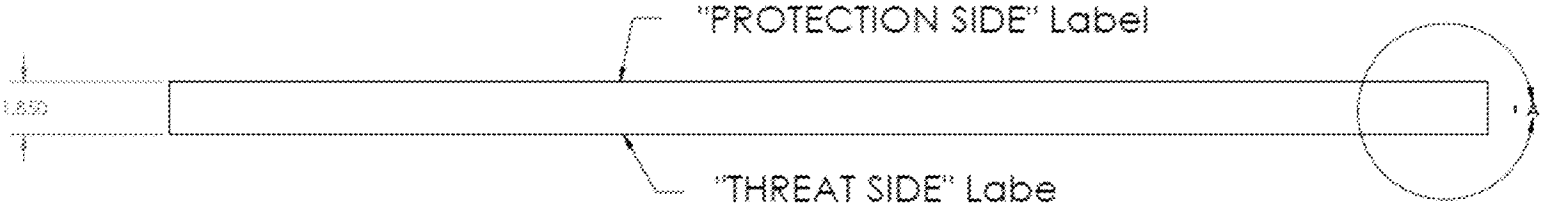
FIG. 16B shows a top-down view of the "threat" and "protection" sides of the polycarbonate laminate depicted in FIG. 15B.
Figure 18B:
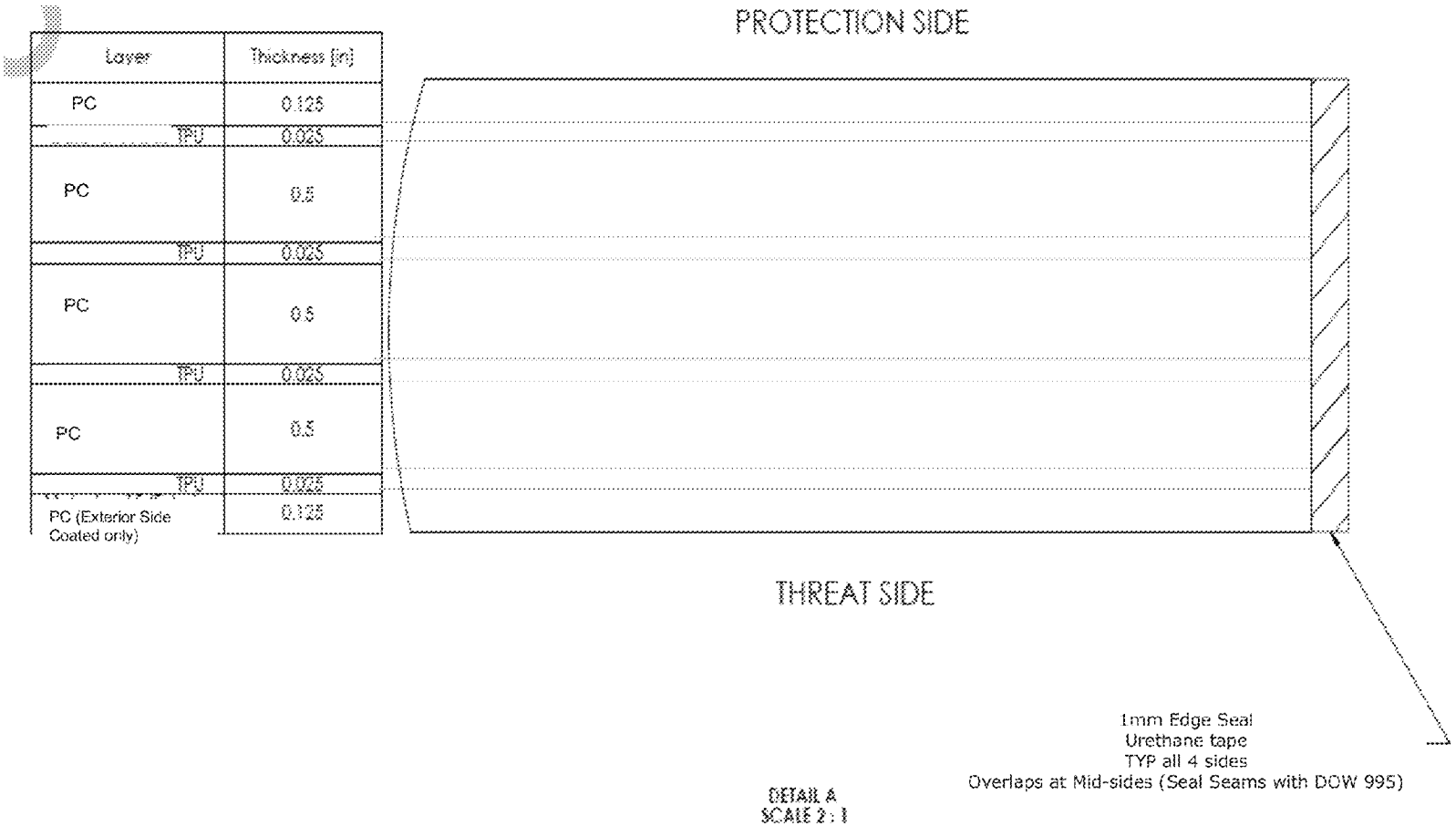
FIG. 18B shows a detail view of the layer structure of polycarbonate laminate taken at "A'" in FIG. 16B.

FIG. 15B shows a view of the "threat" side of the polycarbonate laminate used in one embodiment of the rapid deployment cover system of the present invention. Drilled hole surface areas 150' may preferably be sealed with a elastomeric sealant (e.g., DOW 995-thickness <0.030") and excess silicone removed from the external surface for all holes. FIG. 16B shows a top-down view of the "threat" and "protection" sides of the laminate depicted in FIG. 15B. FIG. 17B shows a perspective view illustrating the "threat" side of the polycarbonate laminate 2' used in the rapid deployment cover system of the present invention. FIG. 18B shows a detail view of the layer structure taken at "A'" in FIG. 16B.

Figure 19:
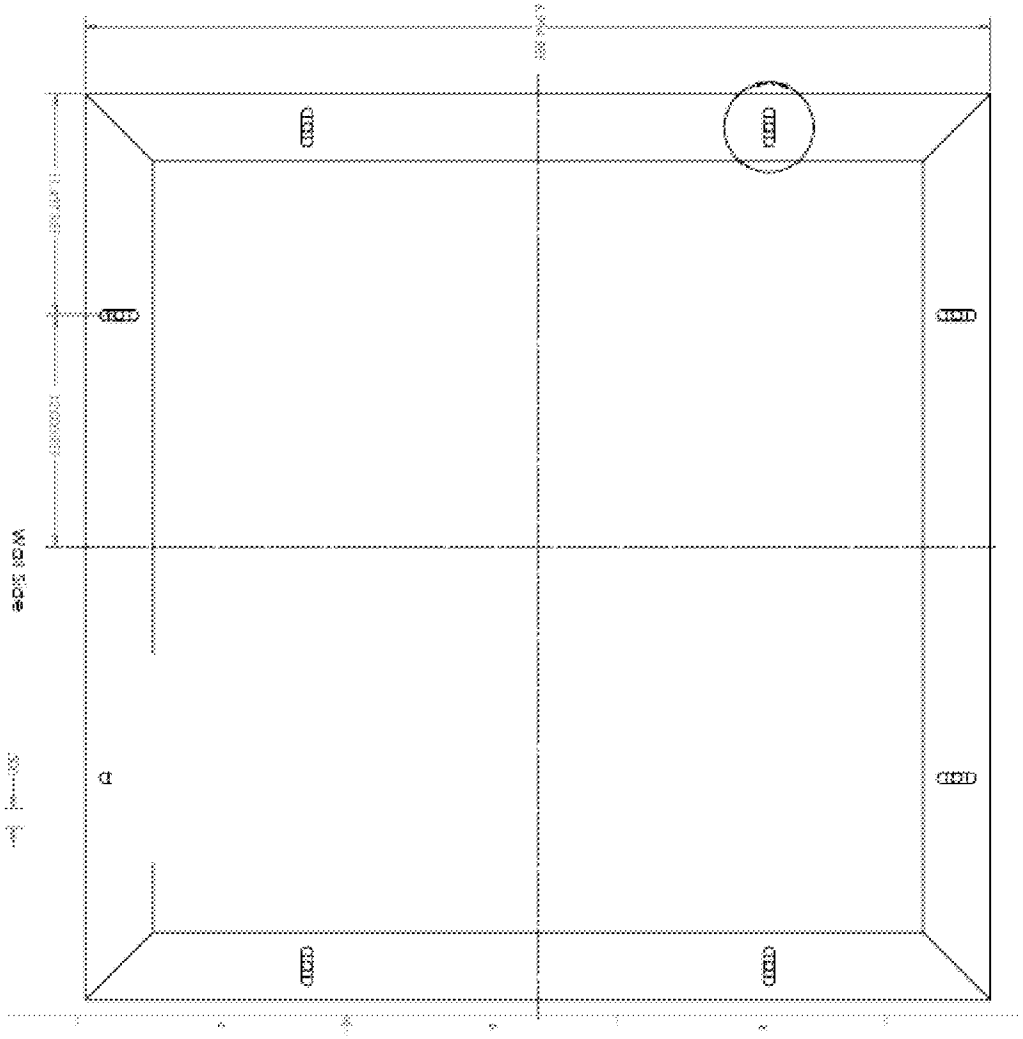
FIG. 19 shows the wall side of the track used to hold the laminate in the inventive rapid deployment cover system.
Figure 20:
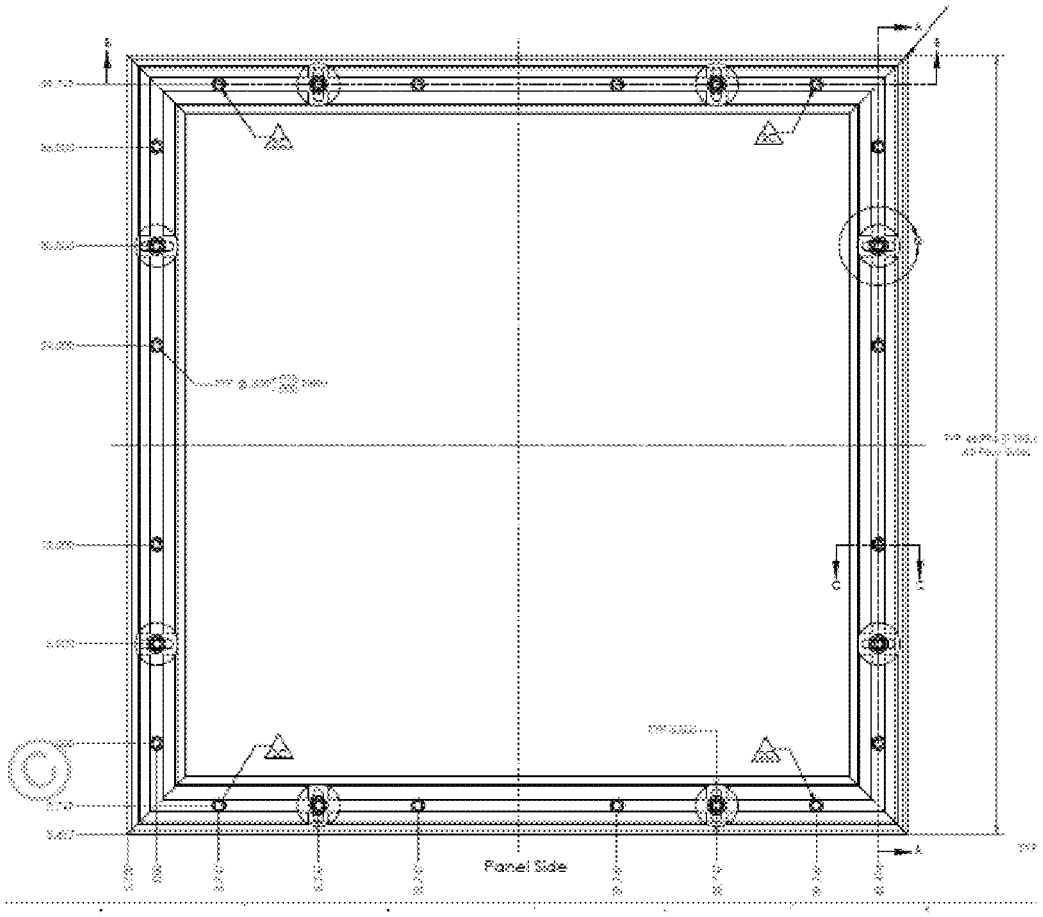
FIG. 20 shows the panel side of the track used to hold the laminate in the inventive rapid deployment cover system of the present invention.
Figure 21:
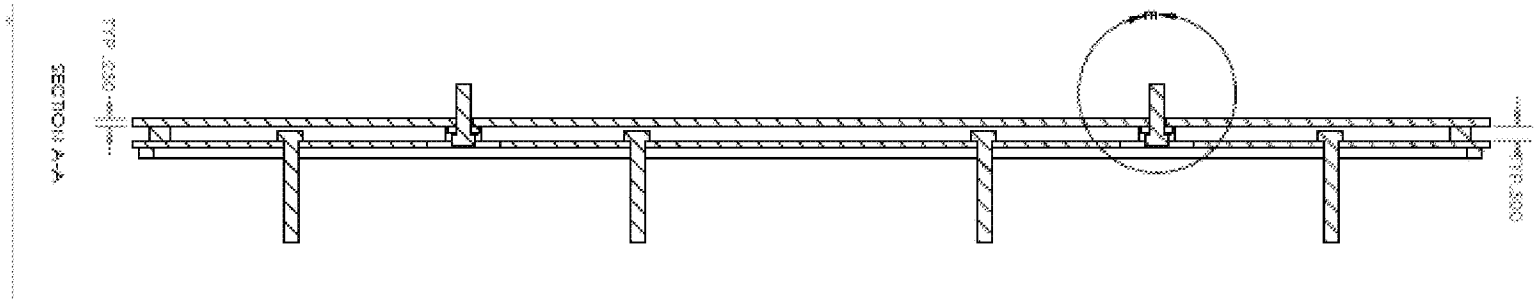
FIG. 21 shows a view of section A-A of the track used to hold the laminate in the inventive rapid deployment cover system depicted in FIG. 20.
Figure 22:
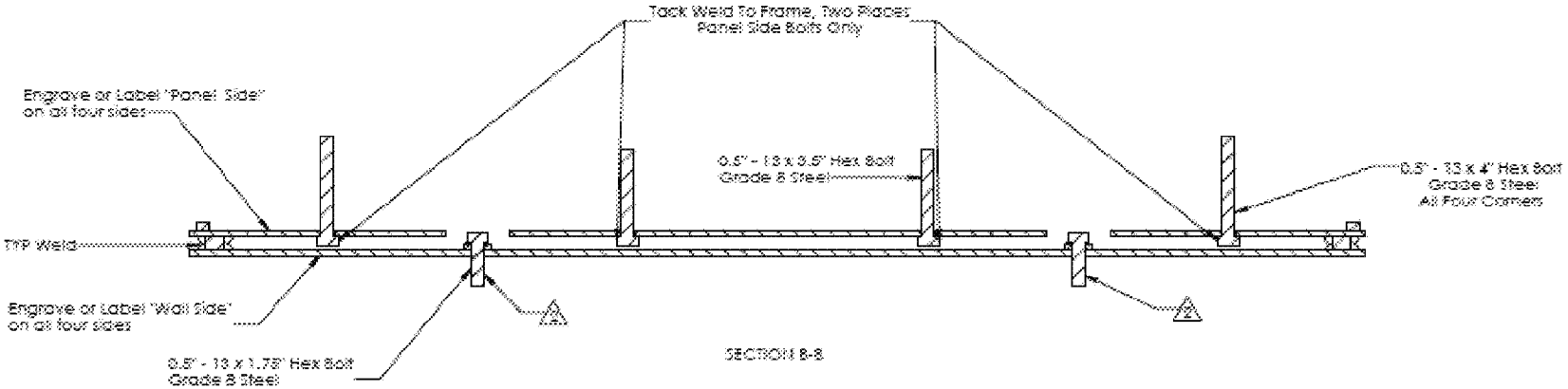
FIG. 22 shows a view of section B-B of the track used to hold the laminate in the inventive rapid deployment cover system depicted in FIG. 20.
Figure 24:
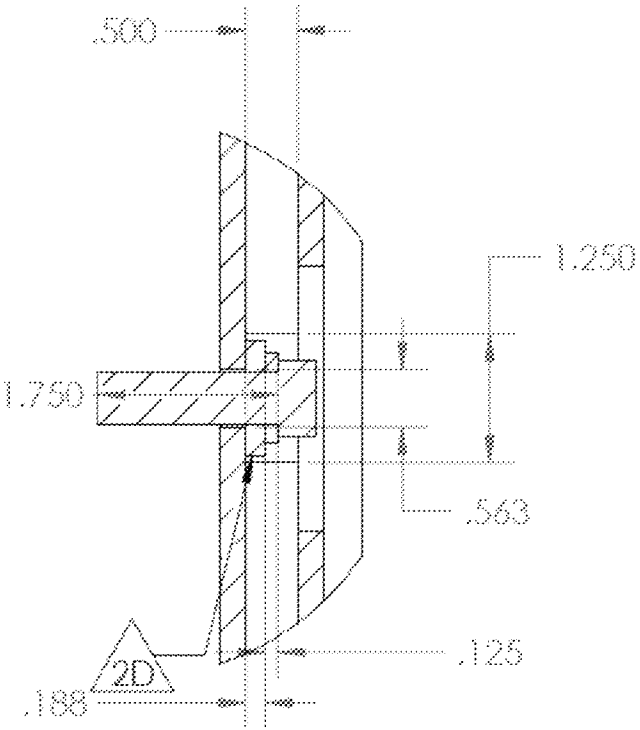
FIG. 24 shows a detail view of element E of the track used to hold the laminate in the inventive rapid deployment cover system depicted in FIG. 20.
Figure 23:
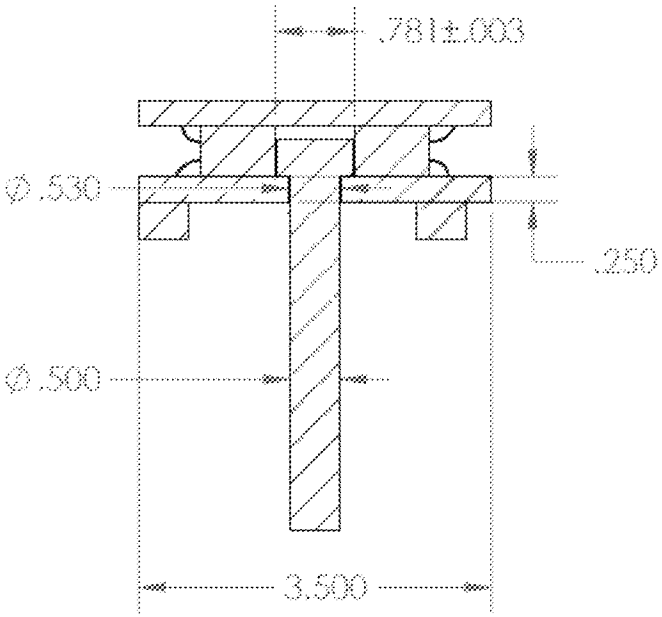
FIG. 23 shows a view of section C-C of the track used to hold the laminate in the inventive rapid deployment cover system depicted in FIG. 20.
Figure 26:
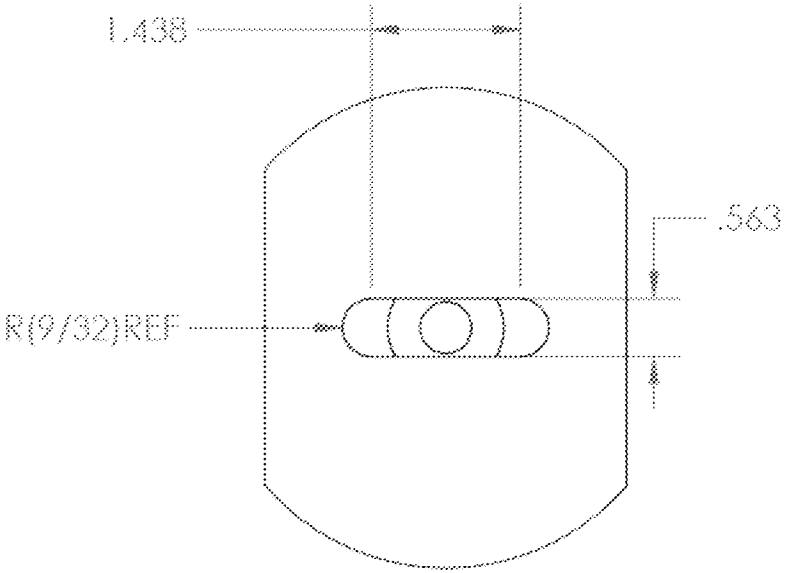
FIG. 26 shows a detail view of element F of the track used to hold the laminate in the inventive rapid deployment cover system depicted in FIG. 20.
Figure 25:
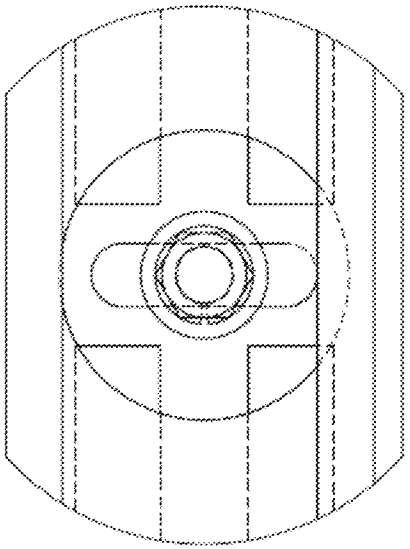
FIG. 25 shows a detail view of element G of the track used to hold the laminate in the inventive rapid deployment cover system depicted in FIG. 20.
Figure 28:
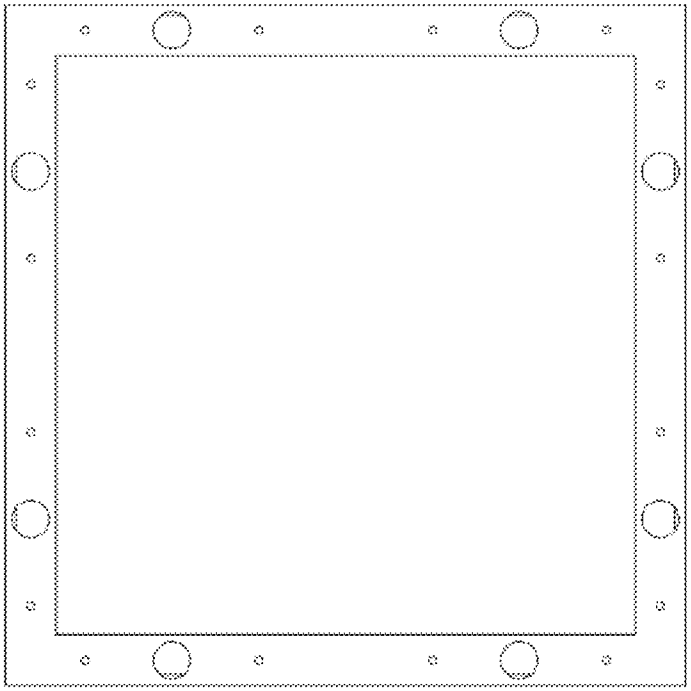
FIG. 28 shows the wall side of the track used to hold the laminate in the inventive rapid deployment cover system.
Figure 27:
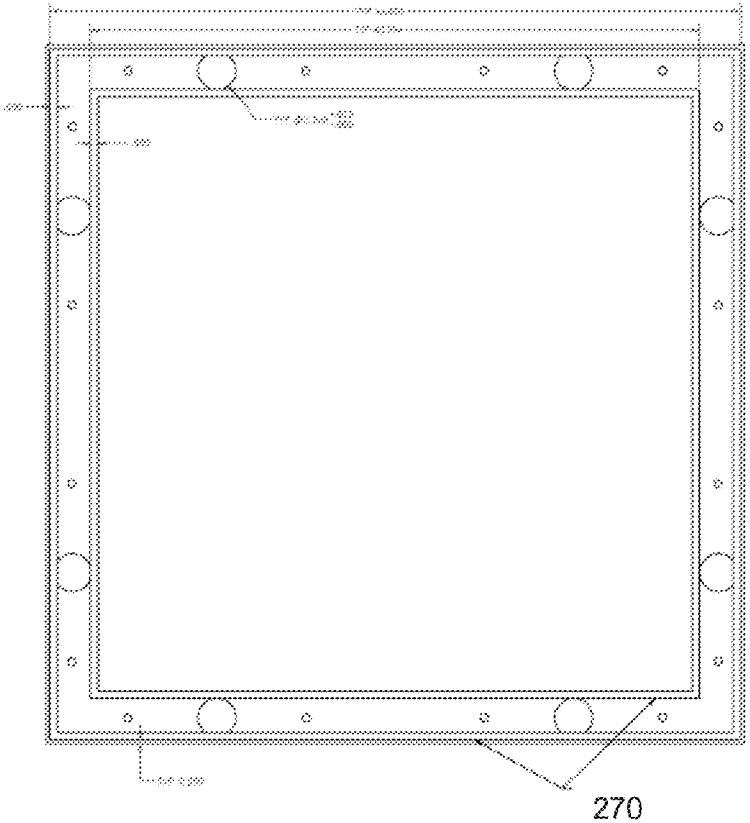
FIG. 27 shows the panel side of the track used to hold the laminate in the inventive rapid deployment cover system.
Figure 29:
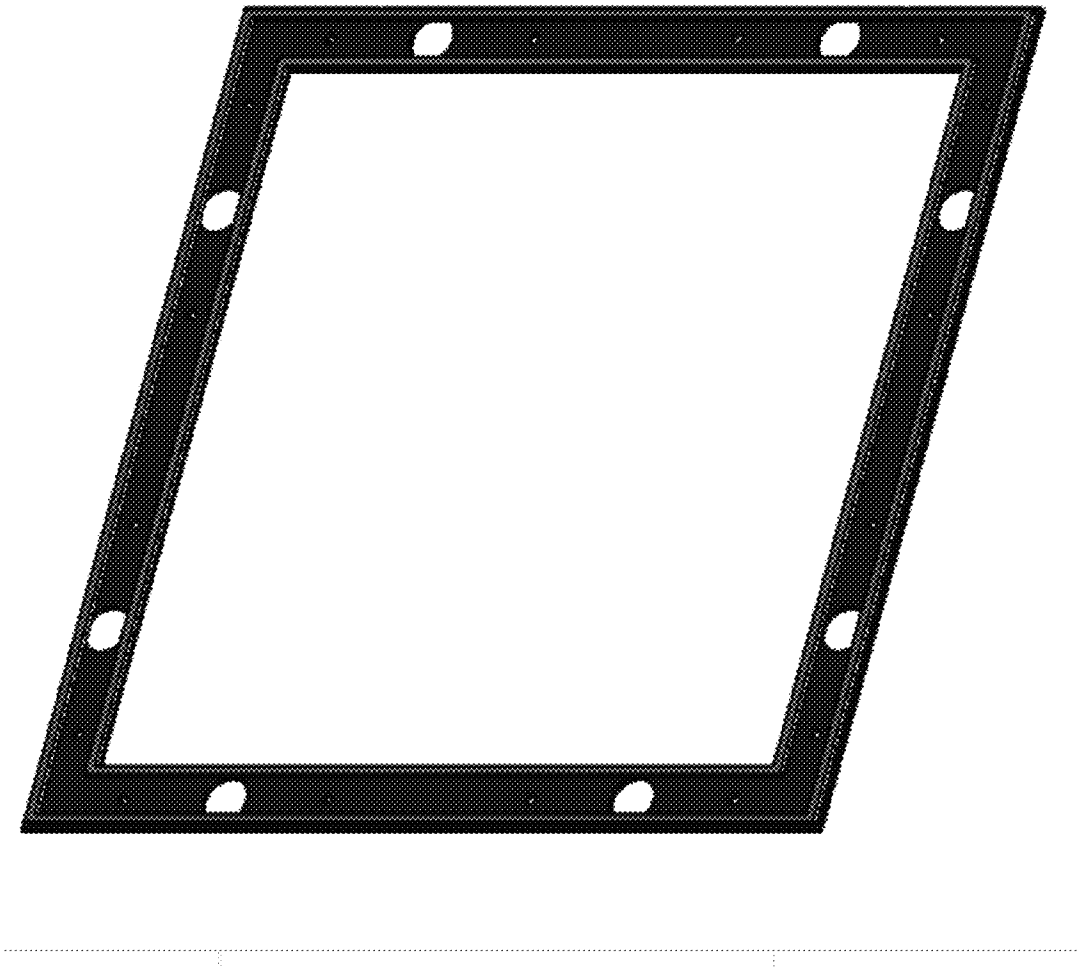
FIG. 29 shows a perspective view of the track used to hold the laminate in the rapid deployment cover system of the present invention.

FIGS. 19 through 29 illustrate various elements of the mounting track used to hold the laminate in the rapid deployment cover system of the present invention. FIG. 19 shows the wall side of the mounting track. FIG. 20 shows the panel (laminate) side of the mounting track. FIG. 21 shows a view of section A-A of the mounting track depicted in FIG. 20. FIG. 22 shows a view of section B-B of the mounting track depicted in FIG. 20. FIG. 23 shows a view of section C-C of the mounting track depicted in FIG. 20. FIG. 24 shows a view of detail E of the mounting track depicted in FIG. 20. FIG. 25 shows a view of detail G of the mounting track depicted in FIG. 20. FIG. 26 shows a view of detail F of the track depicted in FIG. 20. As noted in FIGS. 25 and 26, the bolt attached to the wall may be moved slightly from side to side, and still fit within the mounting track. This flexibility in placement allows for easier installation, especially in metal reinforced walls where a bolt may not be embedded in the wall in certain locations. If, for example, rebar is found in one location where a user wishes to attach a bolt to the wall, he or she may instead install the bolt at an adjacent location without having to alter the location of the mounting track. FIG. 27 shows the panel (laminate) side of the mounting track used to hold the laminate in the rapid deployment cover system of the present invention with glazing tape at 270. FIG. 28 shows the wall side of the mounting track used to hold the laminate in the rapid deployment cover system of the present invention. FIG. 29 shows a perspective view of the mounting track used to hold the laminate in the rapid deployment cover system of the present invention.

Figure 31:
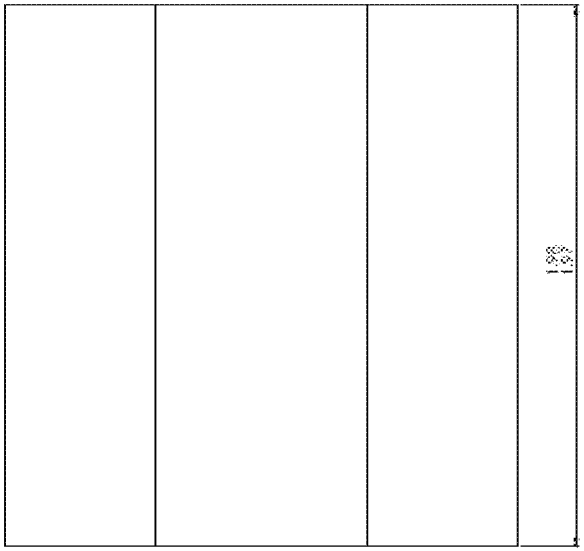
FIG. 31 shows a cross-section view of the elastomeric sleeve of the rapid deployment cover system of the present invention.
Figure 30:
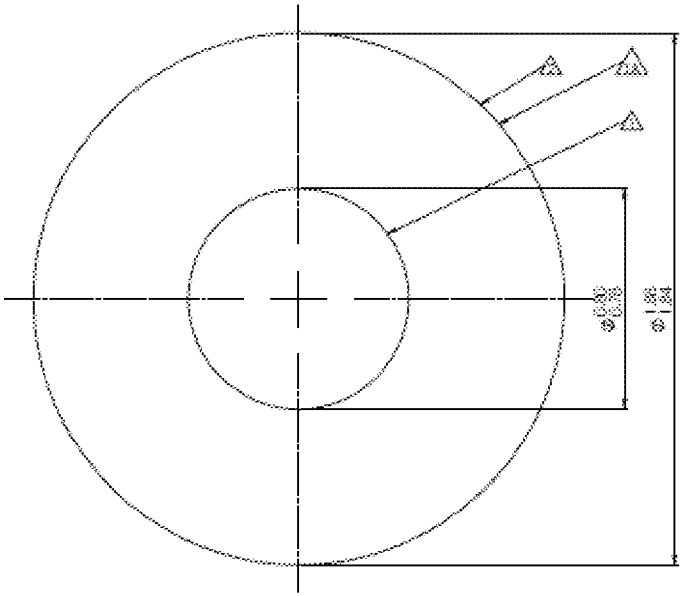
FIG. 30 shows a front view of the elastomeric sleeve of the rapid deployment cover system of the present invention.
Figure 32:
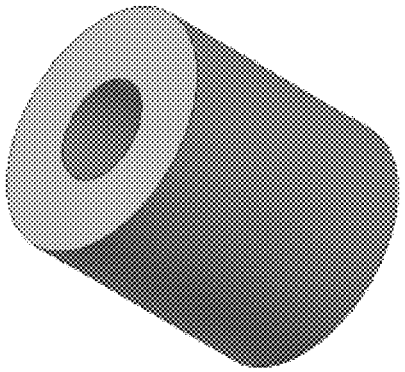
FIG. 32 shows a perspective view of the elastomeric sleeve of the rapid deployment cover system of the present invention.

FIGS. 30 through 32 illustrate the elastomeric sleeve used in the rapid deployment cover system of the present invention. In a preferred embodiment of the present invention, the elastomeric sleeve has a thickness of about 0.535 inches (or about 1.36 cm), to accommodate a bolt of sufficient structural strength, and a hole in the polycarbonate laminate of about 2 inches (about 5.1 cm). In this embodiment, the diameter of the hole is approximately 3.7 times the thickness of the elastomeric sleeve. FIG. 30 shows a front view of the elastomeric sleeve. Although a variety of elastomeric materials may be used to make the sleeve, preference is given to peroxide cured ethylene propylene diene monomer (EPDM) rubber with about a 40+/−5 Shore A hardness, 1450 psi minimum tensile strength and 400% elongation. FIG. 31 shows a cross-section view of the elastomeric sleeve. FIG. 32 shows a perspective view of the elastomeric sleeve.

Figure 33:
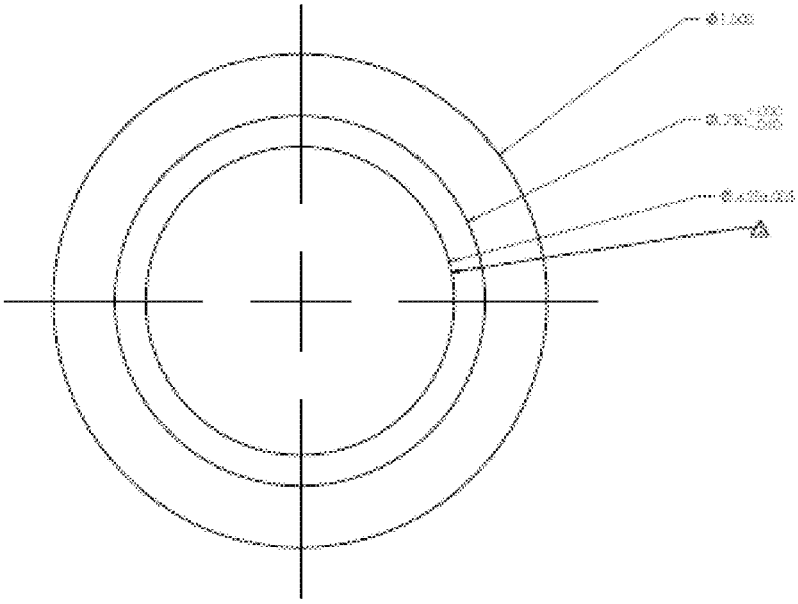
FIG. 33 shows a front view of the bushing of the rapid deployment cover system of the present invention.
Figure 35:
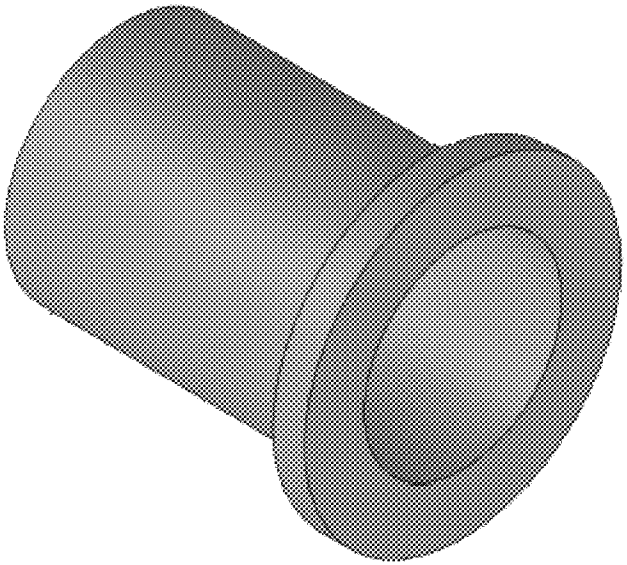
FIG. 35 shows a perspective view of the bushing of the rapid deployment cover system of the present invention.
Figure 34:
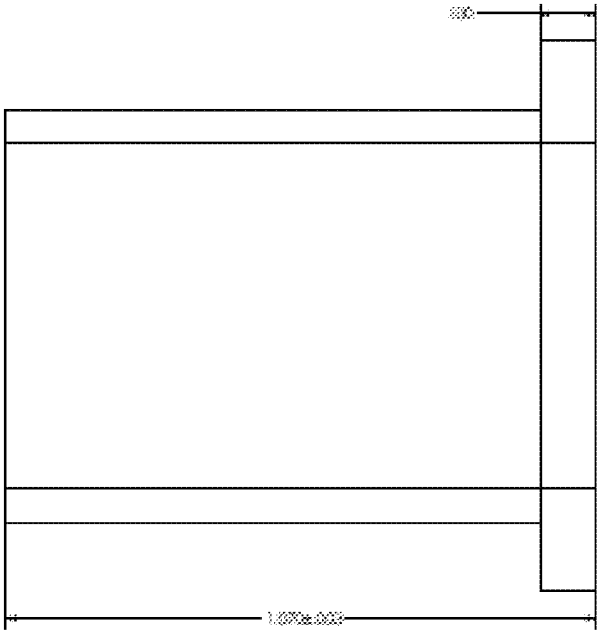
FIG. 34 shows a cross-section view of the bushing of the rapid deployment cover system of the present invention.

FIGS. 33 through 35 illustrate the bushing used in the rapid deployment cover system of the present invention. FIG. 33 shows a front view of the bushing. FIG. 34 shows a cross-section view of the bushing. FIG. 35 shows a perspective view of the bushing.

Figure 36A:
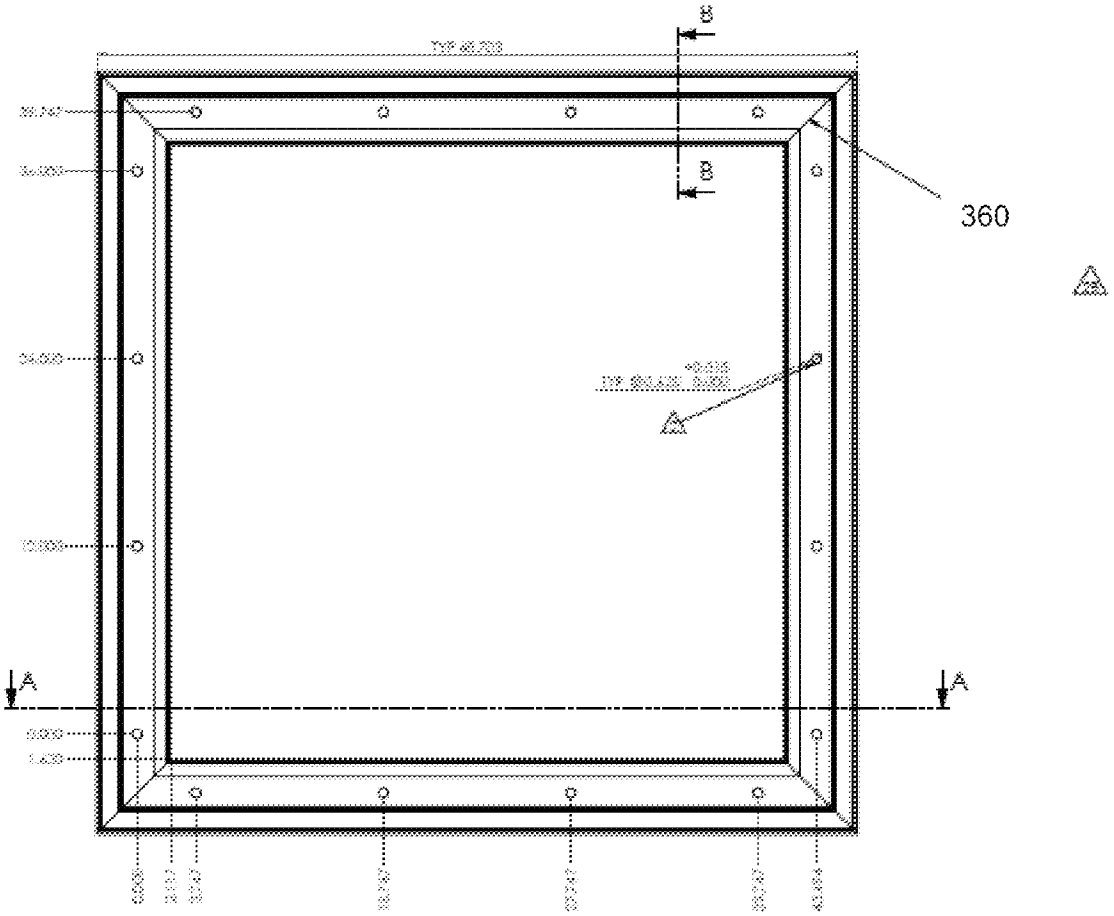
FIG. 36A shows a front view of the pressure plate of the glass-clad polycarbonate laminate embodiment of the inventive rapid deployment cover system.
Figure 36B:
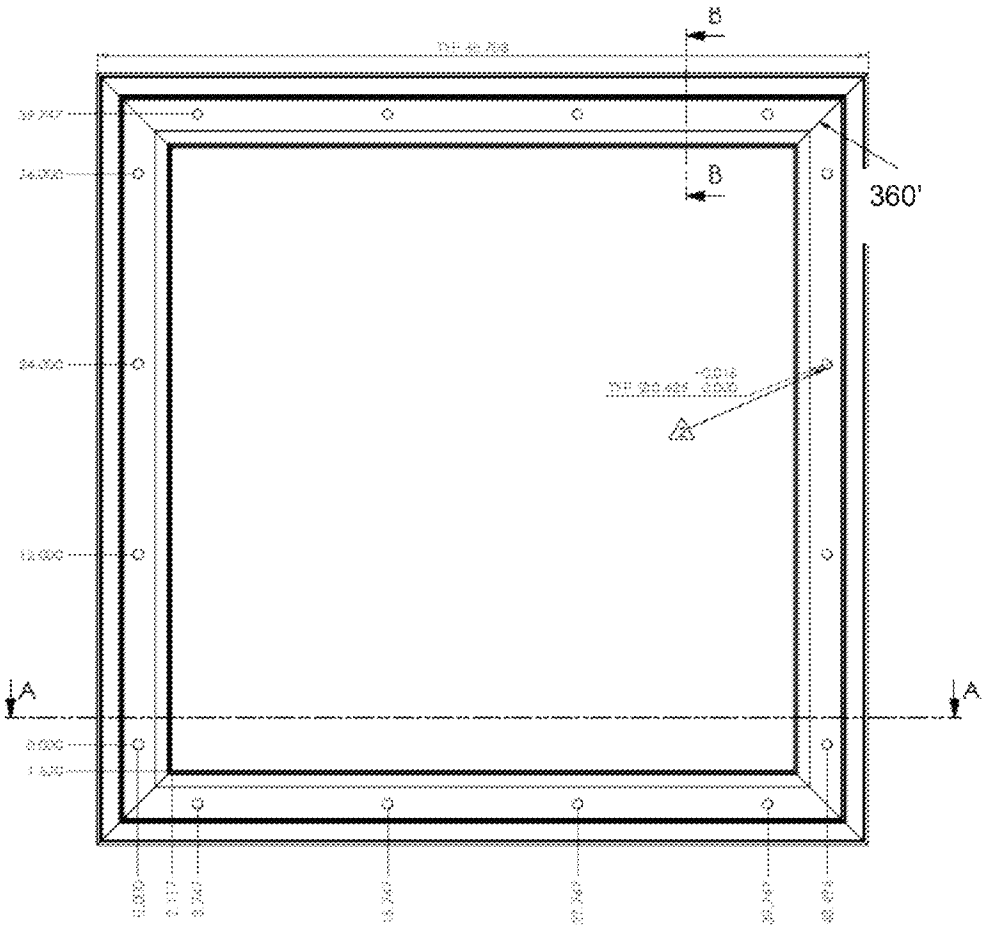
FIG. 36B shows a front view of the pressure plate of the polycarbonate laminate embodiment of the inventive rapid deployment cover system.
Figure 37A:
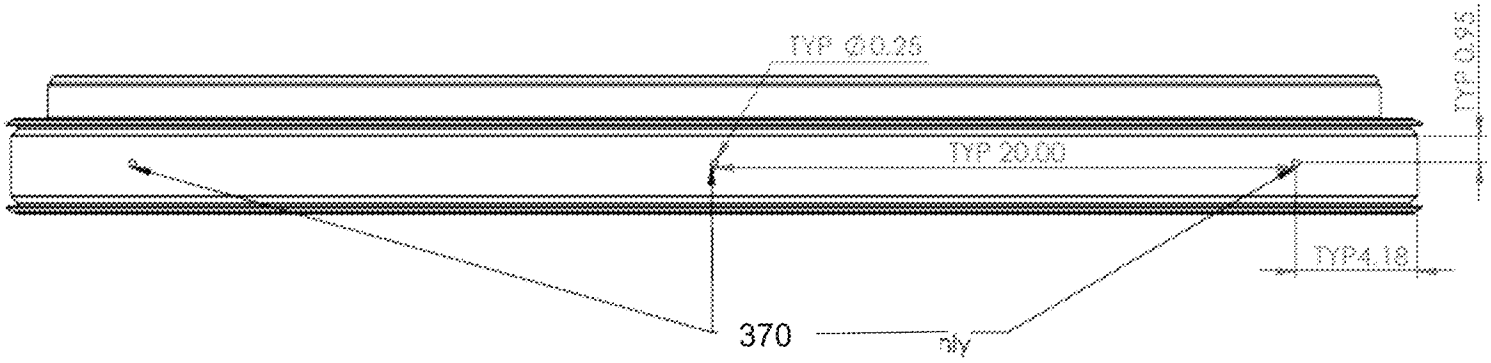
FIG. 37A shows an edge view of the pressure plate of the glass-clad polycarbonate laminate embodiment of the inventive rapid deployment cover system.
Figure 37B:
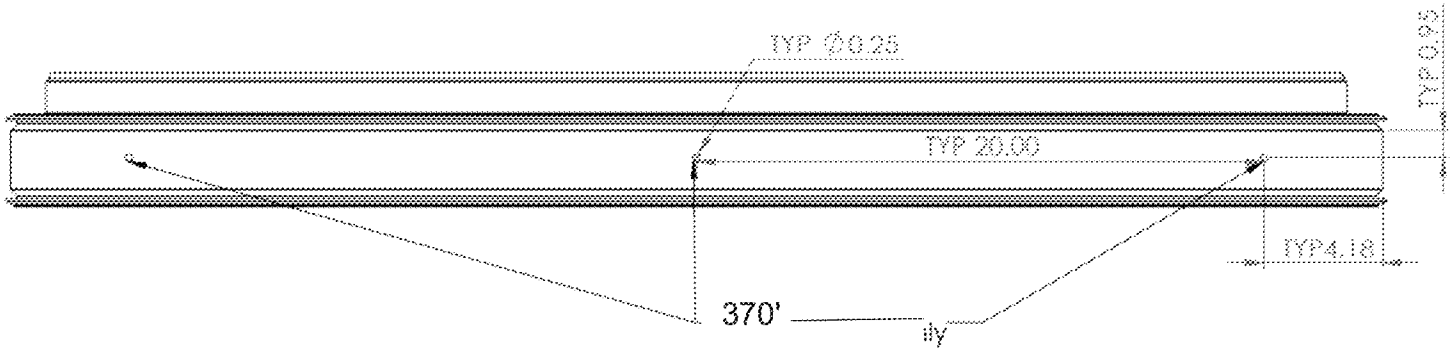
FIG. 37B shows an edge view of the pressure plate of the polycarbonate laminate embodiment of the inventive rapid deployment cover system.
Figure 38A:
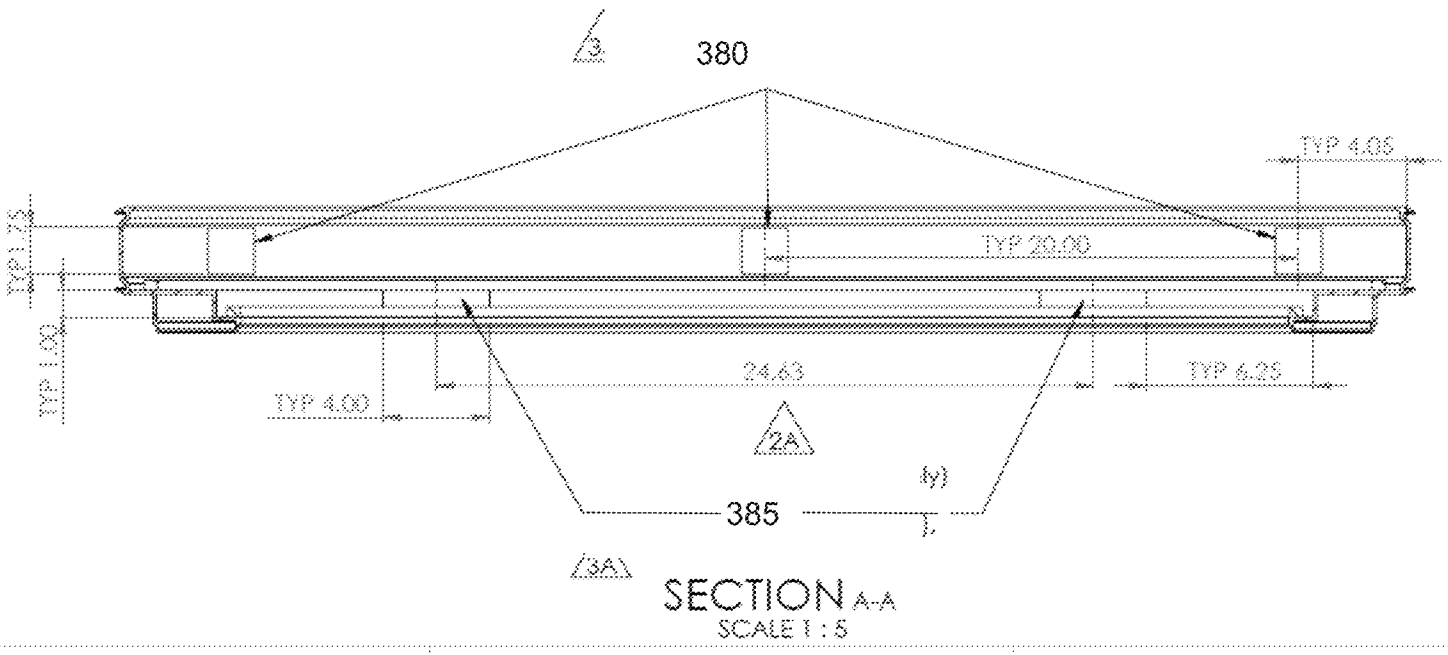
FIG. 38A shows a view of section A-A of the pressure plate depicted in FIG. 36A.
Figure 38B:
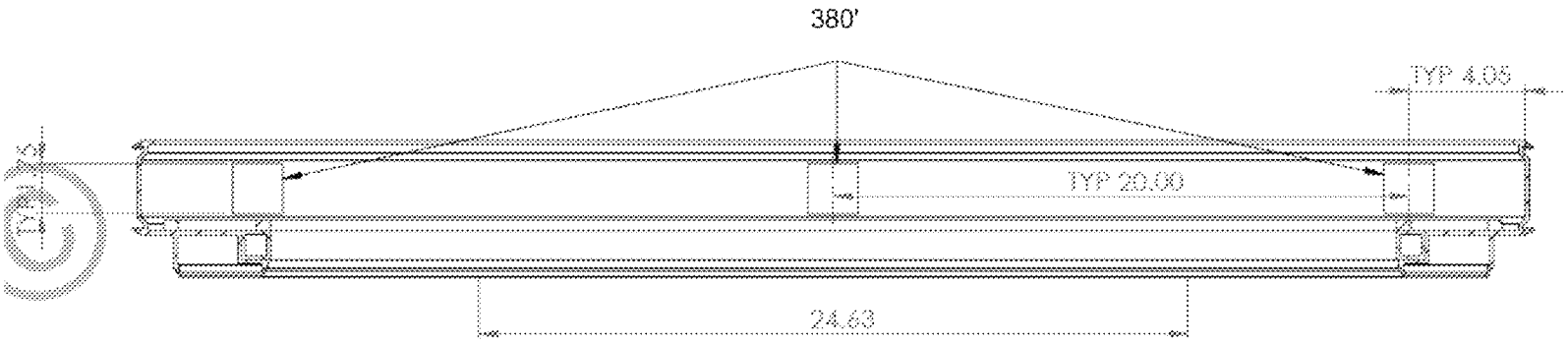
FIG. 38B shows a view of section A-A of the pressure plate depicted in FIG. 36B.
Figure 39A:
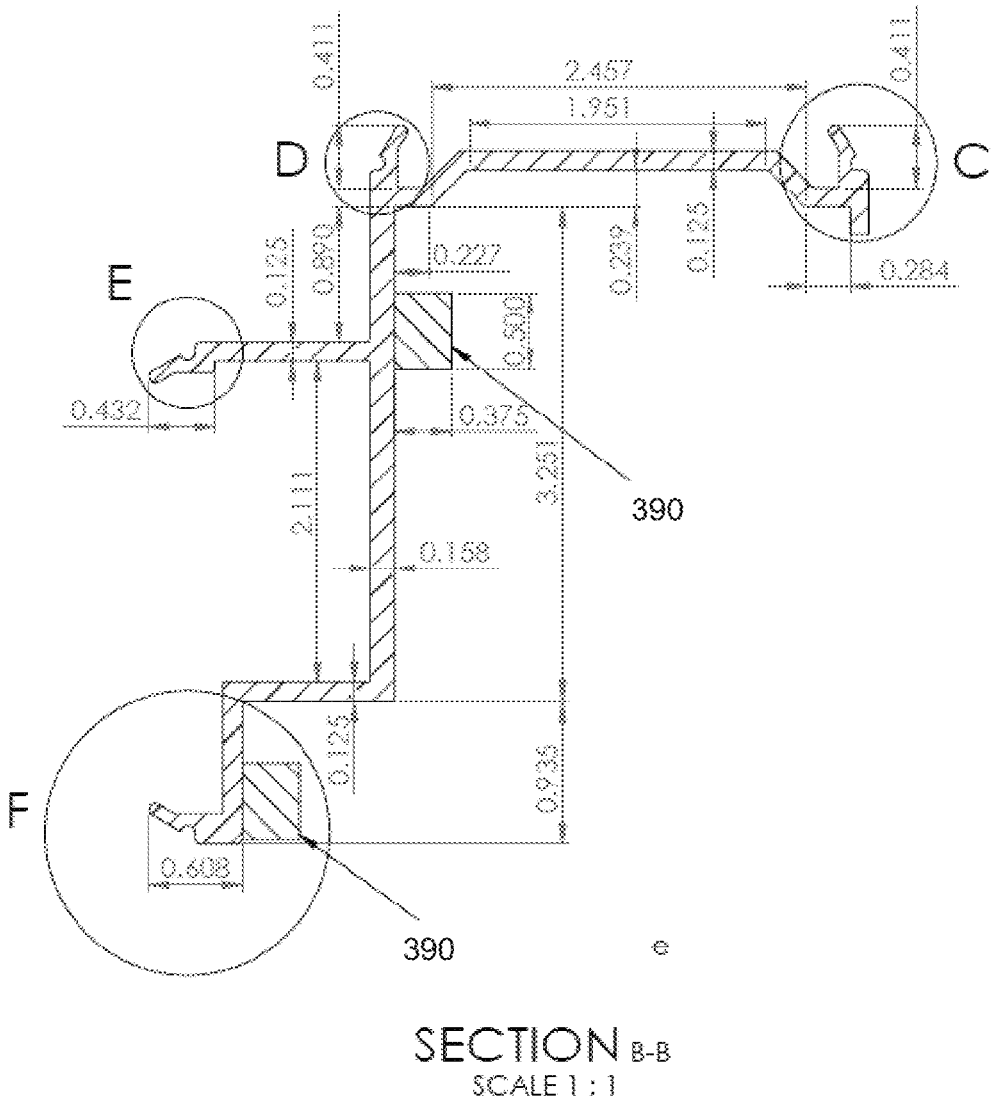
FIG. 39A shows a view of section B-B of the pressure plate depicted in FIG. 36A.
Figure 39B:
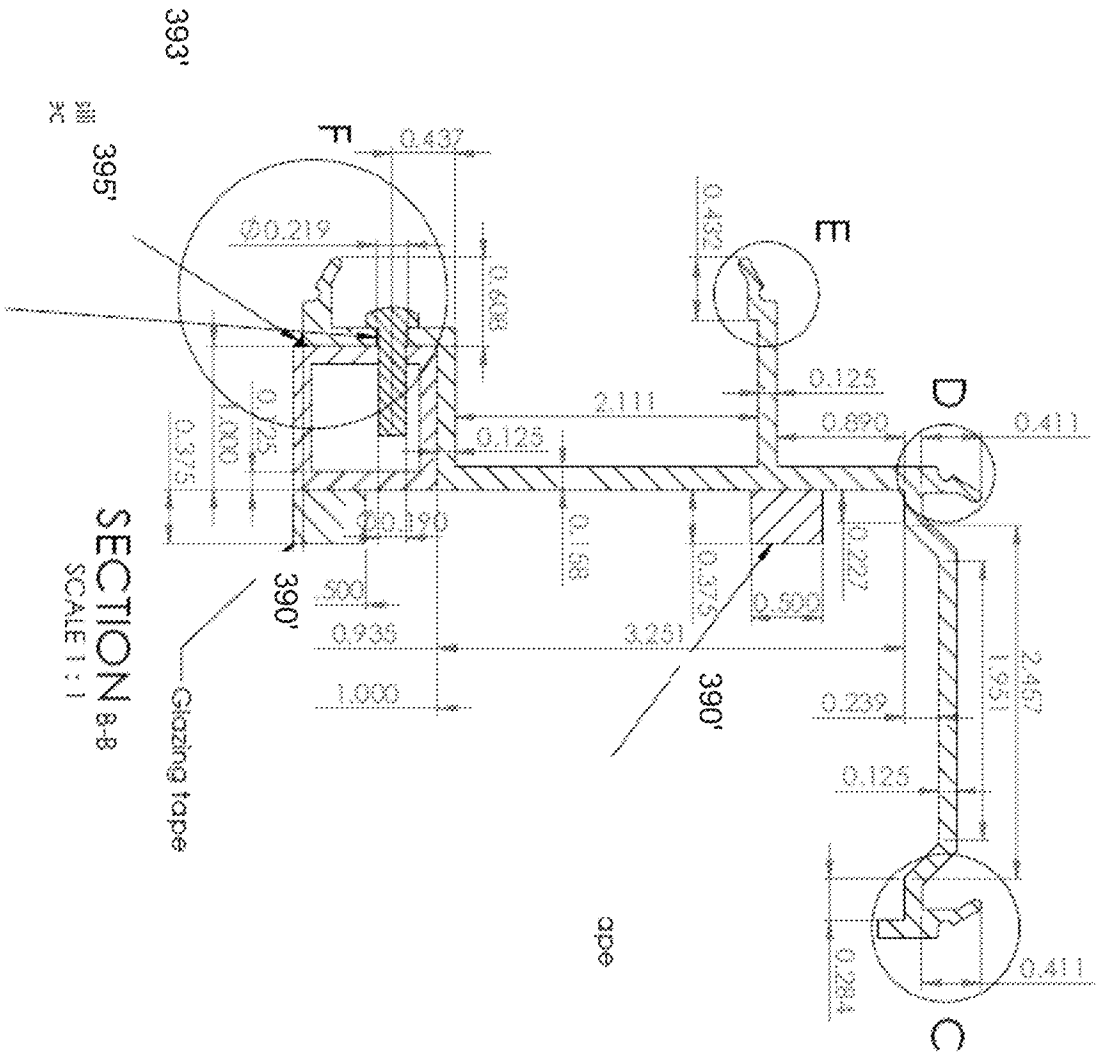
FIG. 39B shows a view of section B-B of the pressure plate depicted in FIG. 36B.
Figure 40B:
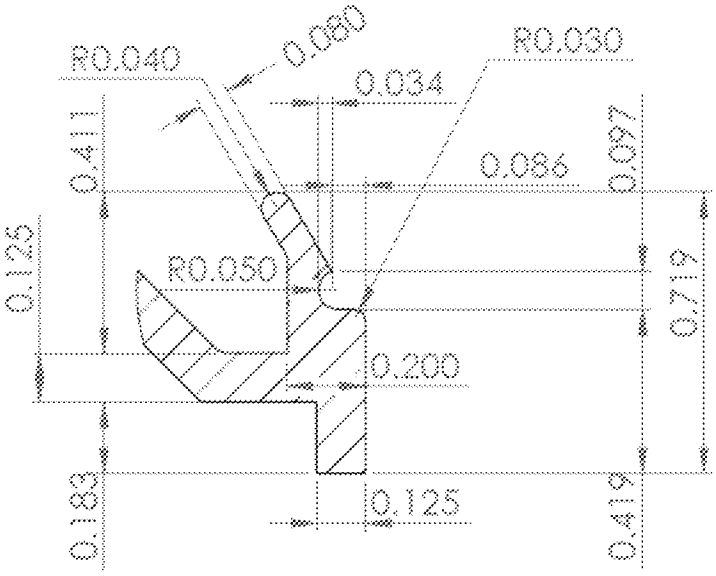
FIG. 40B shows a detail view of element C of the pressure plate depicted in FIG. 36B.
Figure 40A:
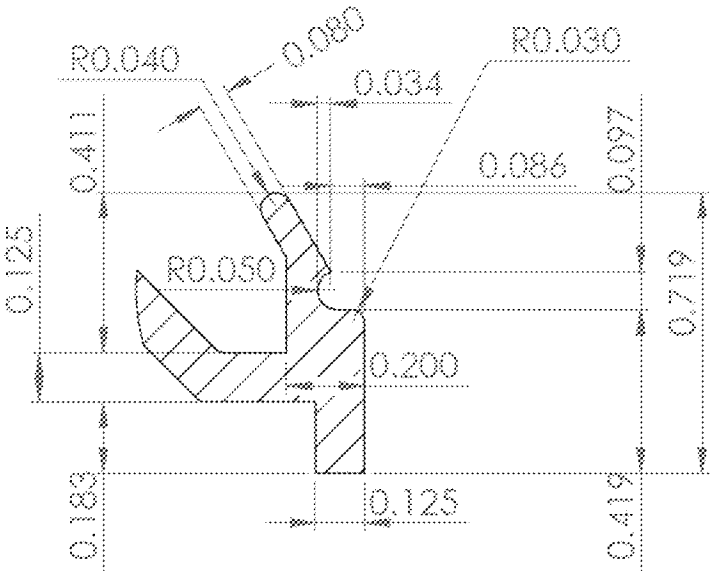
FIG. 40A shows a detail view of element C of the pressure plate depicted in FIG. 36A.
Figure 41B:
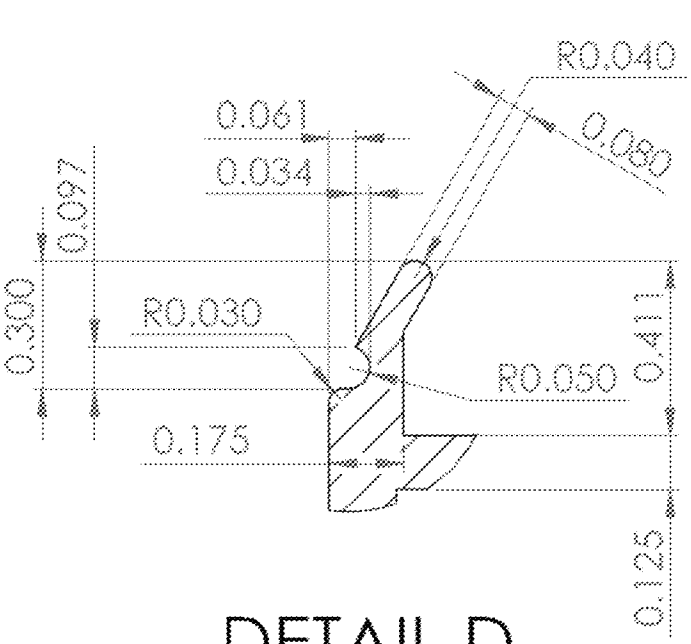
FIG. 41B shows a detail view of element D of the pressure plate depicted in FIG. 36B.
Figure 41A:
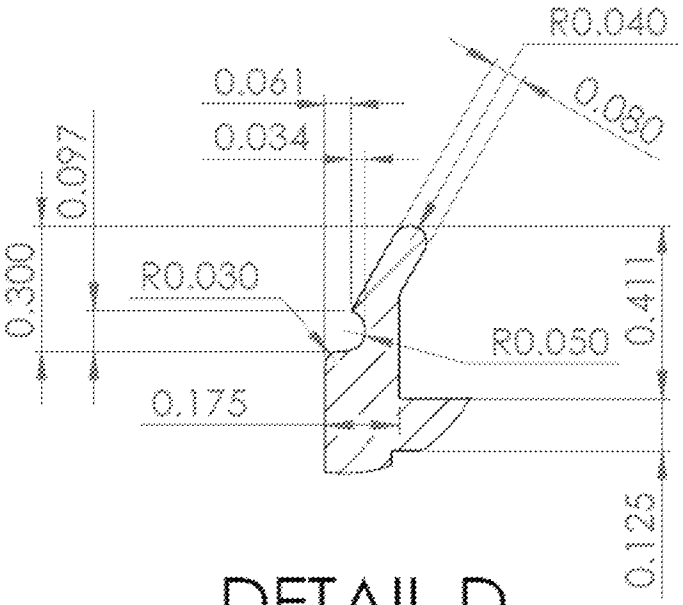
FIG. 41A shows a detail view of element D of the pressure plate depicted in FIG. 36A.
Figure 42B:
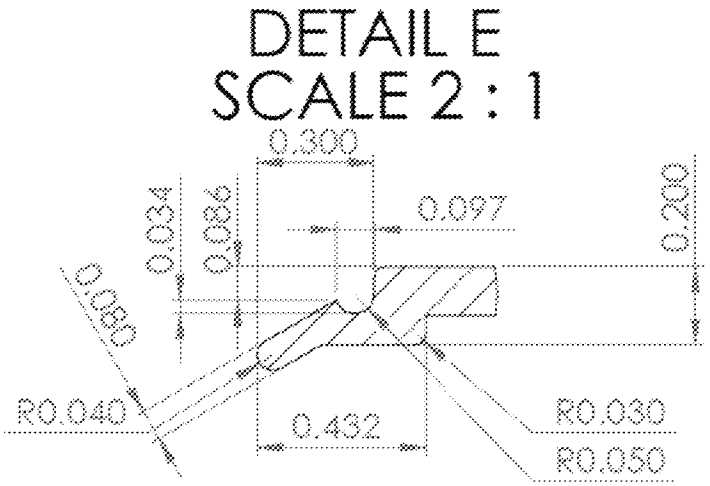
FIG. 42B shows a detail view of element E of the pressure plate depicted in FIG. 36B.
Figure 42A:
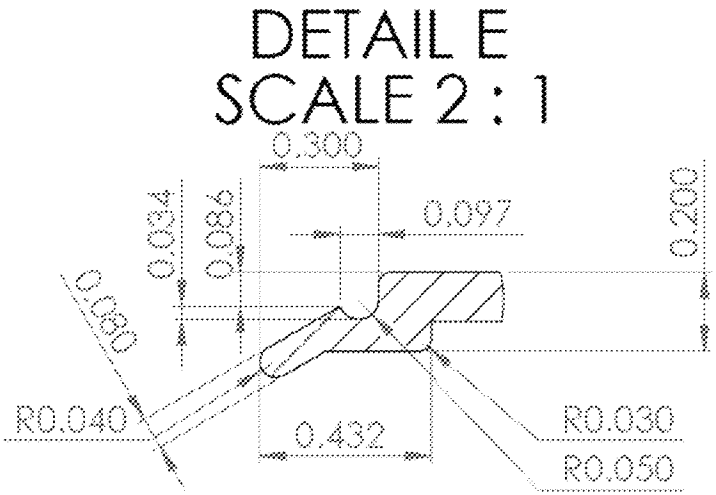
FIG. 42A shows a detail view of element E of the pressure plate depicted in FIG. 36A.
Figure 43B:
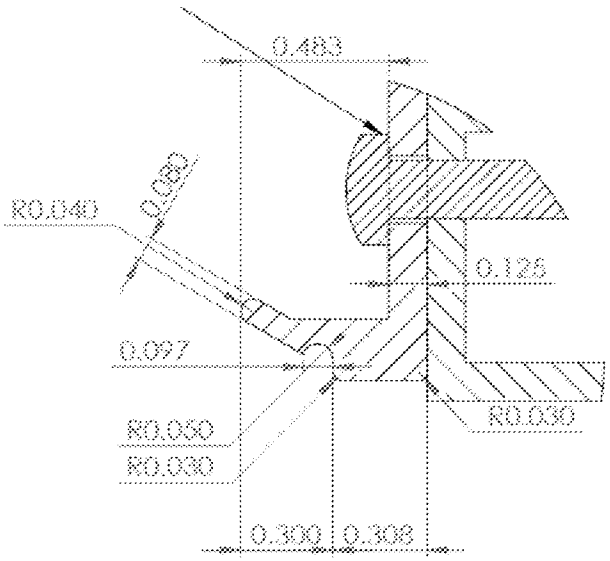
FIG. 43B shows a detail view of element F of the pressure plate depicted in FIG. 36B.
Figure 43A:
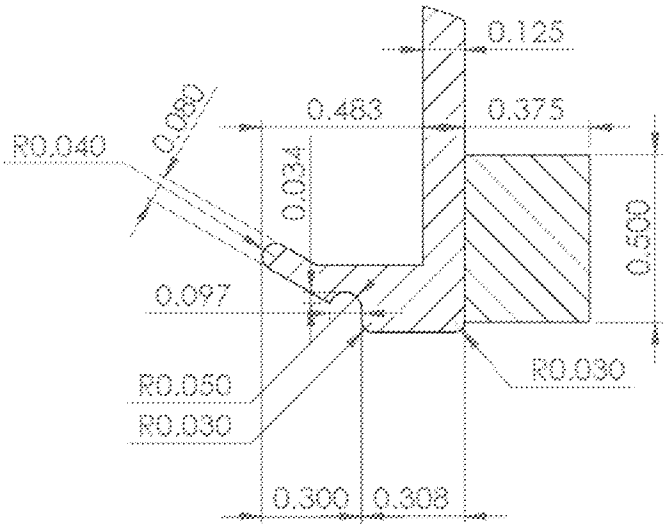
FIG. 43A shows a detail view of element F of the pressure plate depicted in FIG. 36A.
Figure 44A:
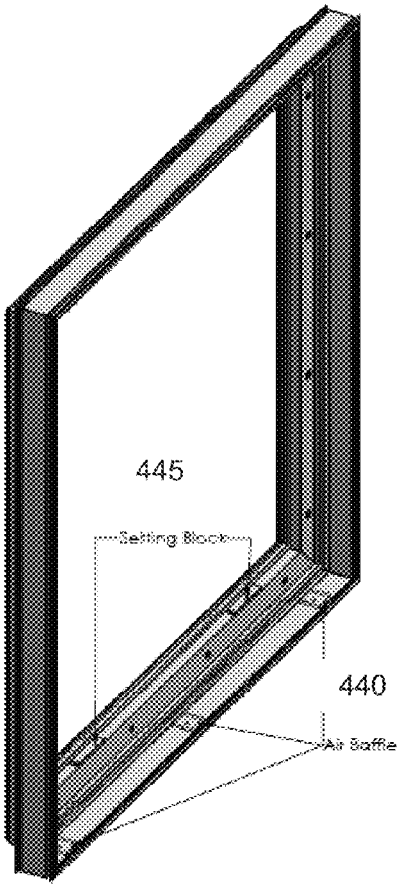
FIG. 44A shows a perspective view of the pressure plate of the glass-clad polycarbonate laminate embodiment of the inventive rapid deployment cover system.
Figure 44B:
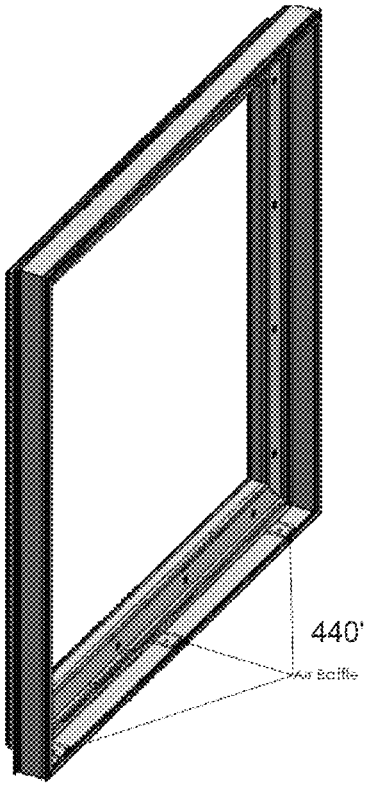
FIG. 44B shows a perspective view of the pressure plate of the polycarbonate laminate embodiment of the inventive rapid deployment cover system.
Figure 45A:
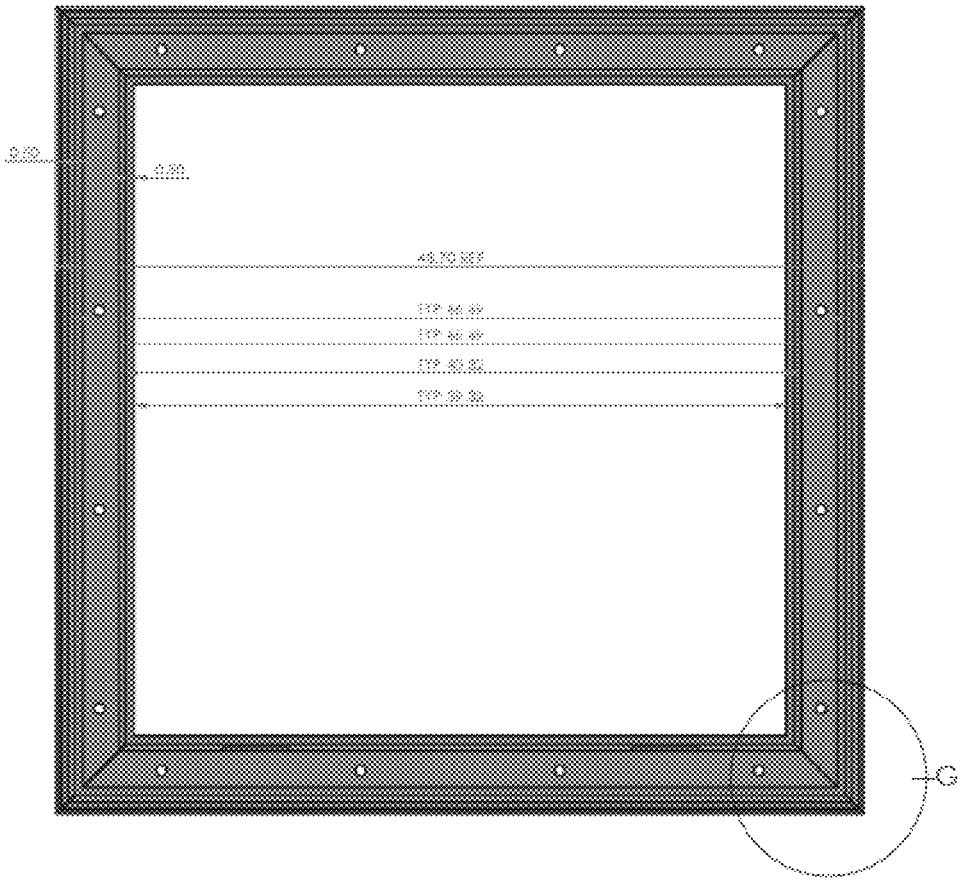
FIG. 45A shows a front view of the pressure plate of the glass-clad polycarbonate laminate embodiment of the inventive rapid deployment cover system.
Figure 45B:
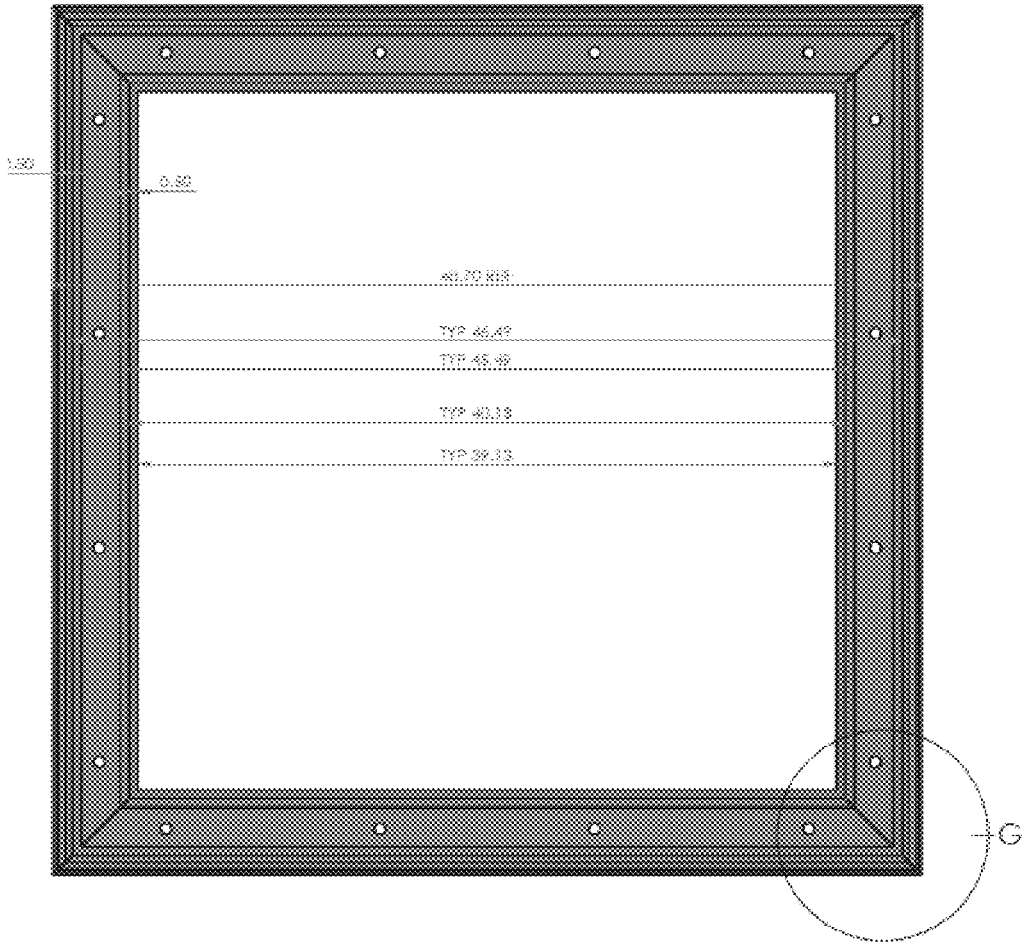
FIG. 45B shows a front view of the pressure plate of the polycarbonate laminate embodiment of the inventive rapid deployment cover system.
Figure 46A:
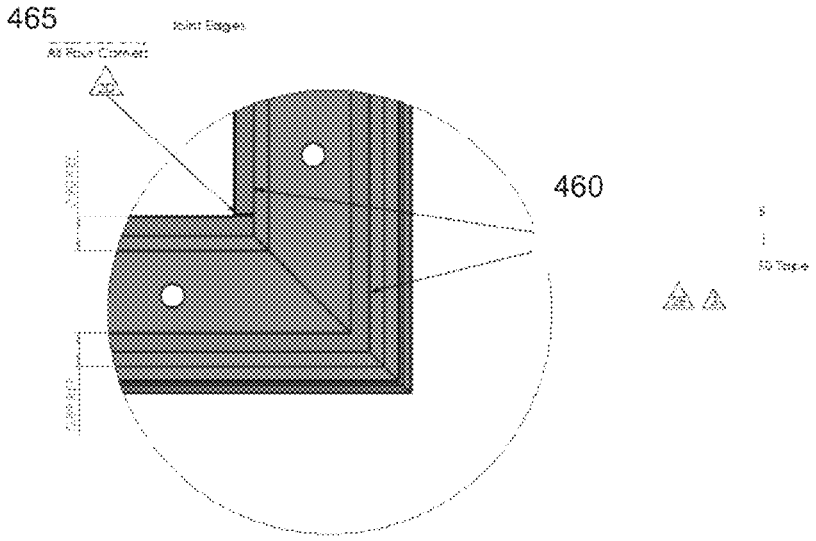
FIG. 46A shows a detail view of element G of the pressure plate depicted in FIG. 45A.

FIGS. 36A through 46A illustrate various elements of the pressure plate used with the glass-clad polycarbonate laminate in one embodiment of the rapid deployment cover system of the present invention. FIG. 36A shows a front view of the pressure plate. A 45-degree miter cut and weld on each corner is depicted at 360. The entire joint length may preferably be sealed with an elastomeric sealant (e.g., Dow 995) on the exterior surface. FIG. 37A shows an edge view of the pressure plate with air holes 370 preferably on the bottom side only. FIG. 38A shows a view of section A-A of the pressure plate depicted in FIG. 36A having air baffles 380 preferably on the bottom only to cover air holes. The baffles 380 are preferably adhered with an elastomeric sealant (e.g., Dow 995). Setting blocks 385 may also be provided preferably on the bottom only and preferably made of ethylene propylene diene monomer (EPDM) rubber and adhered with an elastomeric sealant (e.g., Dow 995). FIG. 39A shows a view of section B-B of the pressure plate depicted in FIG. 36A with glazing tape 390. FIG. 40A shows a view of detail C of the pressure plate depicted in FIG. 36A. FIG. 41A shows a view of detail D of the pressure plate depicted in FIG. 36A. FIG. 42A shows a view of detail E of the pressure plate depicted in FIG. 36A. FIG. 43A shows a view of detail F of the pressure plate depicted in FIG. 36A. FIG. 44A shows a perspective view of the pressure plate with air baffles 440 and setting block 445. FIG. 45A shows a front view of the pressure plate. FIG. 46A shows a detail view of detail G of the pressure plate depicted in FIG. 45A with 460 denoting glazing tape and 465 indicating the position where a 1/16 inch bead of elastomeric sealant (e.g., Dow 995) is placed on the glass side only at each corner.

Figure 46B:
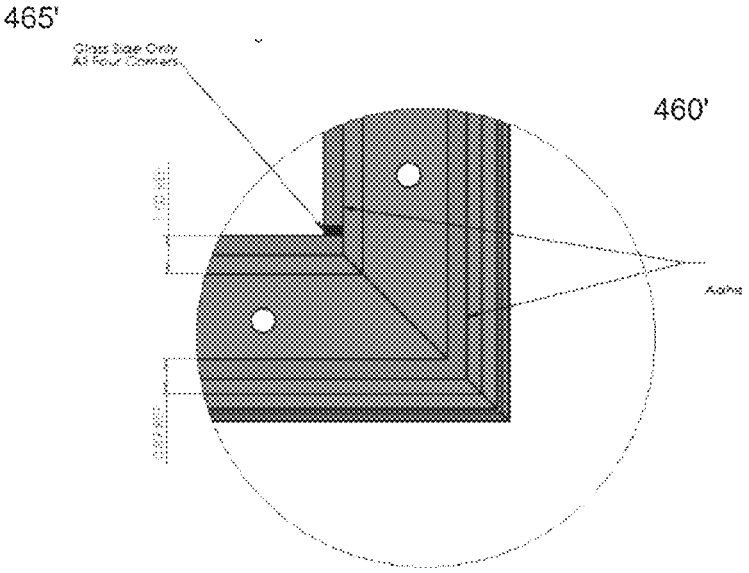
FIG. 46B shows a detail view of element G of the pressure plate depicted in FIG. 45B.

FIGS. 36B through 46B illustrate various elements of the pressure plate used with the polycarbonate laminate in one embodiment of the rapid deployment cover system of the present invention. FIG. 36B shows a front view of the pressure plate. A 45-degree miter cut and weld on each corner is depicted at 360'. FIG. 37B shows an edge view of the pressure plate with air holes 370' preferably on the bottom side only. FIG. 38B shows a view of section A-A of the pressure plate depicted in FIG. 36B having air baffles 380' preferably on the bottom only to cover air holes. The baffles 380' are preferably adhered with an elastomeric sealant (e.g., Dow 995). FIG. 39B shows a view of section B-B of the pressure plate depicted in FIG. 36B with glazing tape 390'. Elastomeric sealant (e.g., Dow 995) is preferably applied around all four edges at 393'. A clearance hole may be drilled into the pressure plate at 395' and a self drilling sheet metal screw drilled into the aluminum square tubing guided by the clearance hole 395' FIG. 40B shows a detail view of detail C of the pressure plate depicted in FIG. 36B. FIG. 41B shows a detail view of detail D of the pressure plate depicted in FIG. 36B. FIG. 42B shows a detail view of detail E of the pressure plate depicted in FIG. 36B. FIG. 43B shows a detail view of detail F of the pressure plate depicted in FIG. 36B with screws 430' sealed with an elastomeric sealant (e.g., Dow 995). FIG. 44B shows a perspective view of the pressure plate with air baffles 440'. FIG. 45B shows a front view of the pressure plate used with the polycarbonate laminate in one embodiment of the rapid deployment cover system of the present invention. FIG. 46B shows a detail view of detail G of the pressure plate depicted in FIG. 45B with 460' denoting glazing tape and 465' indicating the position where a 1/16 inch bead of elastomeric sealant (e.g., Dow 995) is placed on the glass side only at each corner.

Figure 47:
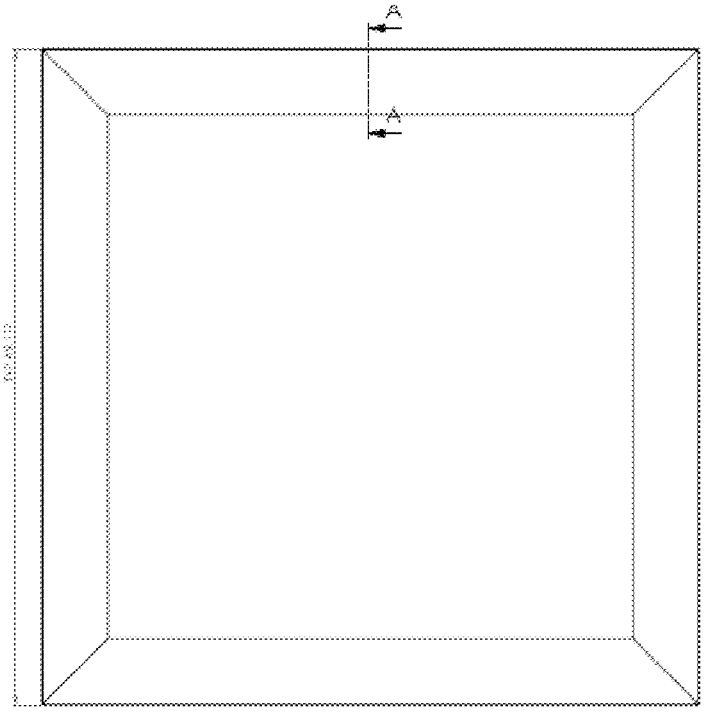
FIG. 47 shows a front view of the frame cover of the inventive rapid deployment cover system.
Figure 48:
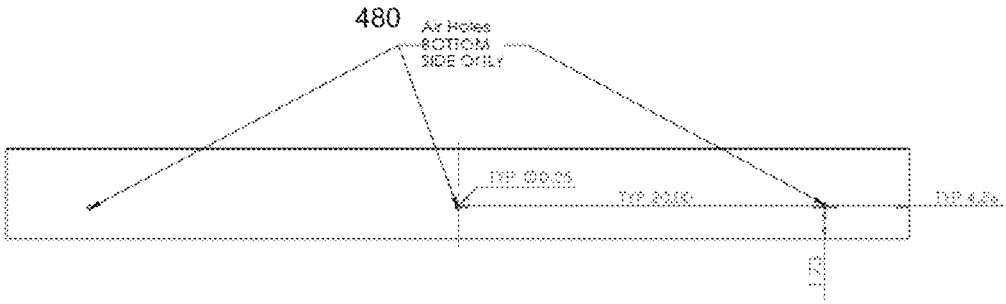
FIG. 48 shows an edge view of the frame cover of the inventive rapid deployment cover system.
Figure 49:
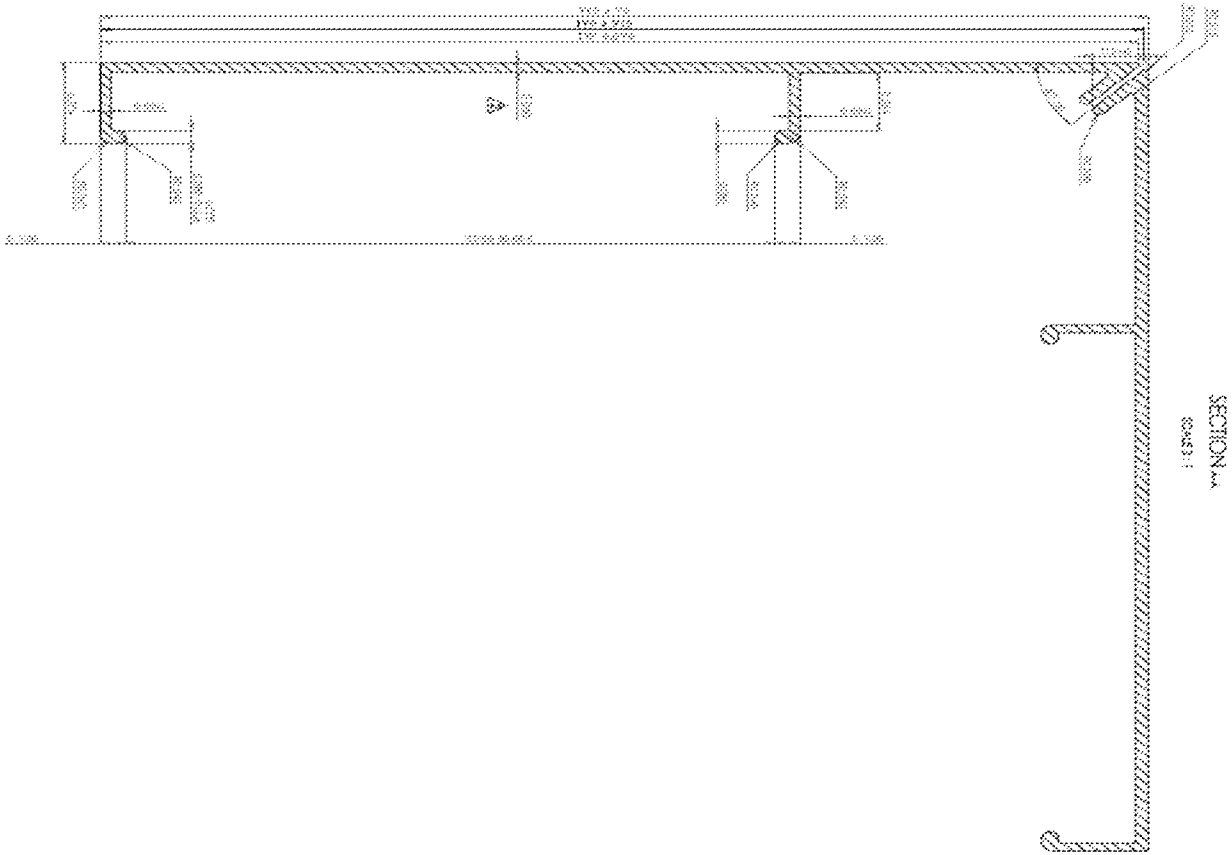
FIG. 49 shows a view of section A-A of the frame cover of the inventive rapid deployment cover system depicted in FIG. 47.
Figure 50:
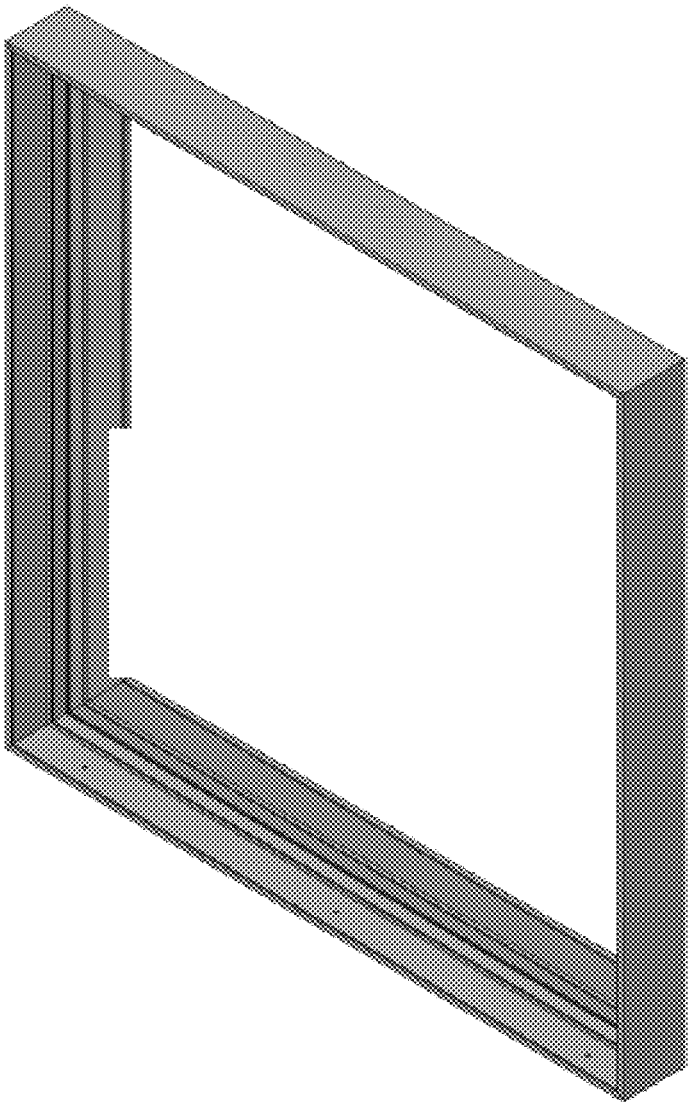
FIG. 50 shows a perspective view of the frame cover of the inventive rapid deployment cover system depicted in FIG. 47.

FIGS. 47 through 50 illustrate the frame cover used in the rapid deployment cover system of the present invention. FIG. 47 shows a front view of the frame cover. FIG. 48 shows an edge view of the frame cover with air holes 480 preferably only in the bottom side. FIG. 49 shows a view of section A-A of the frame cover depicted in FIG. 47 with both covers being identical. FIG. 50 shows a perspective view of the frame cover depicted in FIG. 47.

Figure 52:
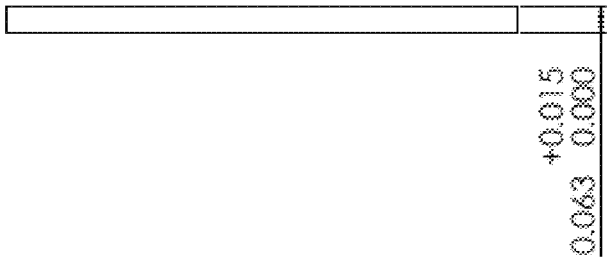
FIG. 52 shows a cross-section view of the elastomeric washer of the inventive rapid deployment cover system.
Figure 51:
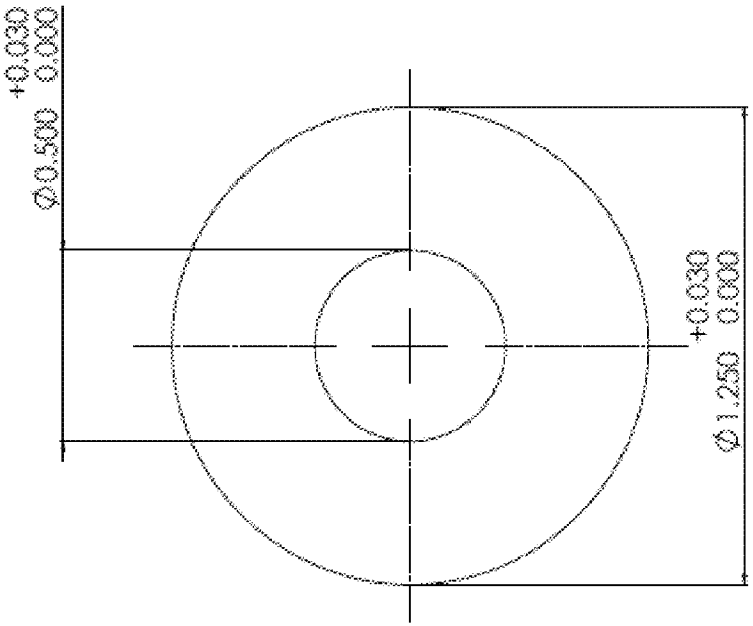
FIG. 51 shows a front view of the elastomeric washer of the inventive rapid deployment cover system.
Figure 53:
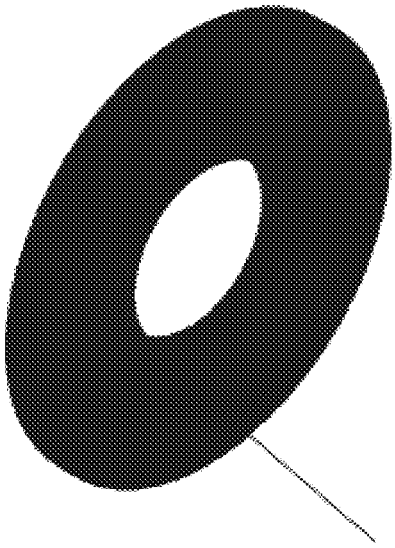
FIG. 53 shows a perspective view of the elastomeric washer of the inventive rapid deployment cover system.

FIGS. 51 through 53 illustrate the elastomeric washer used in the rapid deployment cover system of the present invention. Although any of a variety of elastomeric materials may be used to make the washer, preference is given to ethylene propylene diene monomer (EPDM) rubber. FIG. 51 shows a front view of the elastomeric washer. FIG. 52 shows a cross-section view of the elastomeric washer. FIG. 53 shows a perspective view of the elastomeric washer. Double sided tape may be applied to one side 530 of the washer.

The rapid deployment cover system of the present invention were tested for forced-entry, ballistics and blast resistance with the following results:

| Cover Type | Forced-Entry US Dept of State | Ballistics UL Standard 752 | Blast (*laminant only) | Severe Storm DoE Standard 1020* (*wind and tornado hazard only) |
|---|---|---|---|---|
| glass-clad polycarbonate | 15R-minute simulated assault | UL 8 | *>41 psi | compliant |
| polycarbonate | 15N-minute simulated assault | UL 3 | *>41 psi | compliant |

Also, it is contemplated that any optional feature of the inventive variations described may be set forth and claimed independently, or in combination with any one or more of the features described herein. Reference to a singular item, includes the possibility that there are plural of the same items present. More specifically, as used herein and in the appended claims, the singular forms "a," "an," "said," and "the" include plural referents unless the specifically stated otherwise. In other words, use of the articles allow for "at least one" of the subject item in the description above as well as the claims below. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation. Without the use of such exclusive terminology, the term "comprising" in the claims shall allow for the inclusion of any additional element—irrespective of whether a given number of elements are enumerated in the claim, or the addition of a feature could be regarded as transforming the nature of an element set forth in the claims. Stated otherwise, unless specifically defined herein, all technical and scientific terms used herein are to be given as broad a commonly understood meaning as possible while maintaining claim validity.

The foregoing examples of the present invention are offered for the purpose of illustration and not limitation. It will be apparent to those skilled in the art that the embodiments described herein may be modified or revised in various ways without departing from the spirit and scope of the invention. The scope of the invention is to be measured by the appended claims.

What is claimed is:

1. A rapid deployment cover system for a wall having an opening, the system comprising:

a mounting track attached to the wall;

a polycarbonate laminate having a first side adjacent to the mounting track, a second side and a plurality of holes through the first and second sides;

a pressure plate adjacent to the second side of the polycarbonate laminate;

a first plurality of bolts, wherein each such bolt is fixedly attached to the pressure plate, and passes through one of the holes in the polycarbonate laminate; and a plurality of elastomeric sleeves, wherein each such sleeve is situated substantially around one of the bolts and within one of the holes of the polycarbonate laminate.

2. The rapid deployment cover system of claim 1, wherein the first plurality of bolts is fixedly attached to both the pressure plate and the mounting track, and the mounting track is attached to the wall by a second plurality of bolts.

3. The rapid deployment cover system of claim 2, wherein the mounting track is attached to the wall by 4 to 8 bolts of the second plurality of bolts.

4. The rapid deployment cover system of claim 1, wherein the first plurality of bolts are fixedly attached to the wall.

5. The rapid deployment cover system of claim 4, wherein the mounting track is attached to the wall by 4 to 8 bolts.

6. The rapid deployment cover system of claim 1, further comprising one or more shims disposed between the mounting plate and the wall.

7. The rapid deployment cover system of claim 6, wherein the shims are constructed of an elastomeric material.

8. The rapid deployment cover system of claim 6, wherein the shims create a space of at least 0.25 inches between the wall and the mounting plate.

9. The rapid deployment cover system of claim 1, wherein the first plurality of bolts are spaced at least 3 inches apart from each other.

10. The rapid deployment cover system of claim 9, wherein the first plurality of bolts are spaced at least 6 inches apart from each other.

11. The rapid deployment cover system of claim 1, wherein the plurality of holes in the polycarbonate laminate are about 2 inches in diameter.

12. The rapid deployment cover system of claim 1, wherein at least one of the plurality of holes in the polycarbonate laminate has a diameter of about 3.7 times a thickness of at least one of the elastomeric sleeves.

13. The rapid deployment cover system of claim 1, wherein at least one of the elastomeric sleeves has a thickness of about 0.535 inches.

14. The rapid deployment cover system of claim 1, wherein at least one of the elastomeric sleeves has a Shore A hardness of about 35 to about 45.

15. The rapid deployment cover system of claim 1, wherein at least one of the elastomeric sleeves has a tensile strength of about 1450 psi.

16. The rapid deployment cover system of claim 1, wherein at least one of the elastomeric sleeves is constructed of ethylene propylene diene monomer (EPDM).

17. The rapid deployment cover system of claim 1, further comprising at least one bushing disposed between at least one of the bolts and at least one of the elastomeric sleeves.

18. The rapid deployment cover system of claim 1, wherein the polycarbonate laminate comprises at least one edge, and the plurality of holes in the polycarbonate laminate are located at least 0.25 inches away from the at least one edge of the polycarbonate laminate.

19. The rapid deployment cover system of claim 18, wherein the plurality of holes in the polycarbonate laminate are located at least 3 inches away from the at least one edge of the polycarbonate laminate.

20. The rapid deployment cover system of claim 1, further comprising a pressure plate cover.

21. A method for installing a cover to a wall having an opening, the method comprising:

A) drilling 4 to 8 anchor holes in the wall around the opening;

B) fixing a mounting track to the 4 to 8 anchor holes in the wall; and

C) hanging a polycarbonate laminate having a first side adjacent to the mounting track, a second side and a plurality of holes through the first and second sides, (i) through the use of a pressure plate adjacent to the second side of the polycarbonate laminate, and (ii) also through the use of a first plurality of bolts, wherein each such bolt is fixedly attached to the pressure plate at one end, and passes through an elastomeric sleeve and a hole of the polycarbonate laminate.

22. The method of claim 21, wherein the first plurality of bolts is fixedly attached to both the pressure plate and the mounting track, and the mounting track is attached to the wall by a second plurality of bolts.

23. The method of claim 21, wherein the first plurality of bolts is fixedly attached to the wall.

24. The method of claim 21, further comprising:

D) installing one or more shims between the mounting plate and the wall.

25. The method of claim 24, wherein the shims create a space of at least 0.25 inches between the wall and the mounting plate.

26. The method of claim 21, wherein the first plurality of bolts are spaced at least 3 inches apart from each another.

27. The method of claim 26, wherein the first plurality of bolts are spaced at least 6 inches apart from each another.

28. The method of claim 21, wherein the plurality of holes in the polycarbonate laminate are about 2 inches in diameter.

29. The method of claim 21, wherein at least one of the plurality of holes in the polycarbonate laminate has a diameter of about 3.7 times the thickness of an elastomeric sleeve.

30. The method of claim 21, wherein each of the first plurality of bolts passes through a bushing.

31. The method of claim 21, wherein the polycarbonate laminate comprises at least one edge, and the plurality of holes in the polycarbonate laminate are located at least 0.25 inches away from the at least one edge of the polycarbonate laminate.

32. The method of claim 31, wherein the plurality of holes in the polycarbonate laminate are located at least 3 inches away from the at least one edge of the polycarbonate laminate.

33. The method of claim 21, further comprising:

E) installing a pressure plate cover.

* * * * *